United States Patent [19]

Inuzuka et al.

[11] Patent Number: 5,008,712

[45] Date of Patent: Apr. 16, 1991

[54] VARIABLE MAGNIFICATION COPYING APPARATUS AND AUTOMATIC SHUTDOWN THEREFOR

[75] Inventors: Tsuneki Inuzuka; Katsuyoshi Maeshima; Masahiro Tomosada, all of Tokyo, Japan

[73] Assignee: Canon Kabushiki Kaisha, Tokyo, Japan

[21] Appl. No.: 436,974

[22] Filed: Nov. 16, 1989

Related U.S. Application Data

[63] Continuation of Ser. No. 940,224, Dec. 8, 1986, abandoned, which is a continuation of Ser. No. 735,387, May 17, 1985, abandoned, which is a continuation of Ser. No. 311,865, Oct. 15, 1981, abandoned.

[30] Foreign Application Priority Data

| | | | |
|---|---|---|---|
| Oct. 17, 1980 | [JP] | Japan | 55-145268 |
| Oct. 17, 1980 | [JP] | Japan | 55-145269 |
| Dec. 27, 1980 | [JP] | Japan | 55-188402 |
| Jan. 19, 1981 | [JP] | Japan | 56-6946 |
| Jan. 21, 1981 | [JP] | Japan | 56-8489 |

[51] Int. Cl.[5] ..... G03G 15/04; G03G 21/00

[52] U.S. Cl. ..... 355/206; 355/208; 355/243; 355/311

[58] Field of Search ..... 355/205, 206, 208, 243, 355/311, 55, 209

[56] References Cited

U.S. PATENT DOCUMENTS

| | | | |
|---|---|---|---|
| 3,693,969 | 9/1972 | Sakamaki et al. | 271/57 |
| 3,873,189 | 3/1975 | Whitaker et al. | 355/55 X |
| 4,011,012 | 3/1977 | Kawai | 355/55 |
| 4,072,852 | 2/1978 | Hogan | 235/303.1 |
| 4,080,062 | 3/1978 | Torigai et al. | 355/57 X |
| 4,095,880 | 6/1978 | Shogren et al. | 355/243 |
| 4,099,860 | 7/1978 | Connin | 355/314 |
| 4,105,326 | 8/1978 | Mochimaru | 355/55 |
| 4,105,327 | 8/1978 | Gibson et al. | 355/59 |
| 4,113,378 | 9/1978 | Wirtz | 355/55 |
| 4,129,377 | 12/1978 | Miyamoto et al. | 355/243 X |

FOREIGN PATENT DOCUMENTS

| | | |
|---|---|---|
| 2103587 | 8/1971 | Fed. Rep. of Germany . |
| 2842392 | 4/1980 | Fed. Rep. of Germany . |
| 3004297 | 8/1980 | Fed. Rep. of Germany . |
| 53-97418 | 8/1978 | Japan . |
| 53-107849 | 9/1978 | Japan . |
| 53-116833 | 10/1978 | Japan . |
| 53-123131 | 10/1978 | Japan . |
| 53-126931 | 11/1978 | Japan . |
| 54-69438 | 6/1979 | Japan . |
| 54-72039 | 6/1979 | Japan . |
| 54-133143 | 10/1979 | Japan . |
| 55-62468 | 5/1980 | Japan . |
| 55-74552 | 6/1980 | Japan . |
| 1594653 | 8/1981 | United Kingdom . |

(List continued on next page.)

*Primary Examiner*—Fred L. Braun

*Attorney, Agent, or Firm*—Fitzpatrick, Cella, Harper, Scinto

[57] ABSTRACT

This invention relates to a copying apparatus with variable magnification capability, wherein the reduced and enlarged copying operations are achieved by varying the speed of a photosensitive drum, while controlling an optical system. The size of a copying material is compared with the size of a reproduced image at a selected magnification, and the comparison is displayed. Also, the size of copy material and the selected magnification can be changed during an interrupt process, and the scanning stroke and timing for image formation are controlled differently for different magnifications. The size of a copying material is compared with the size of a reproduced image at a selected magnification, and the comparison is displayed. Also, the size of copy material and the selected magnification can be changed during an interrupt process, and the scanning stroke and timing for image formation are controlled differently for different magnifications. the optical system is moved to a determined position for a selected magnification and an error signal is generated when the optical system does not arrive at the determined position within a predetermined time after the selected magnification is input by the operator. The image forming cycle is stopped or inhibited in response to generation of the error signal.

20 Claims, 49 Drawing Sheets

U.S. PATENT DOCUMENTS 4,139,300 2/1979 Katayama et al. ..... 355/206
4,192,609 3/1980 Tani et al. ..... 355/77
4,203,663 5/1980 Ogura et al. ..... 355/233
4,211,482 7/1980 Arai et al. ..... 355/57 X
4,217,052 8/1980 Tani et al. ..... 355/243 X
4,264,188 4/1981 Tomosada et al. ..... 355/55 X
4,277,163 7/1981 Ikesue et al. ..... 355/243
4,302,098 11/1981 Kan et al. ..... 355/55
4,310,241 1/1982 Inoue ..... 355/233 X
4,312,587 1/1982 Ariga et al. ..... 355/233
4,315,685 2/1982 Inuzuka et al. ..... 355/206
4,372,676 2/1983 Miyata et al. ..... 355/243 X
4,477,178 10/1984 Furuichi et al. ..... 355/14 R
4,811,051 3/1989 Masuda et al. ..... 355/14

FIG.3-3A
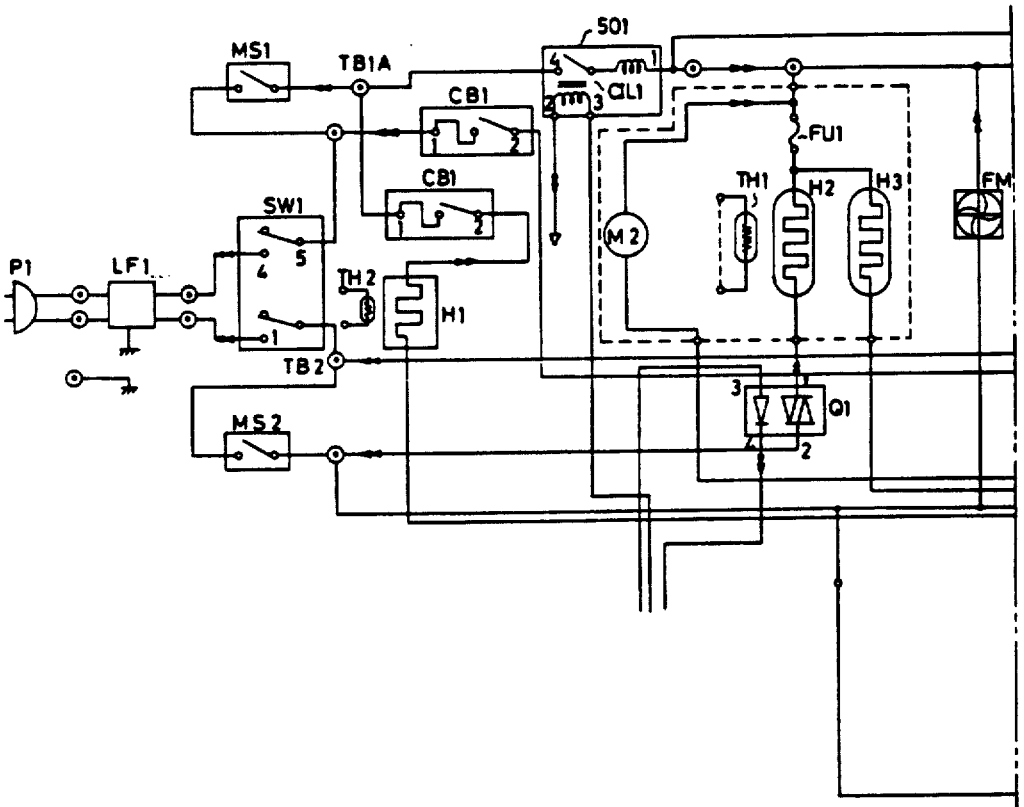
FIG 3-3
FIG.3-3A FIG.3-3B
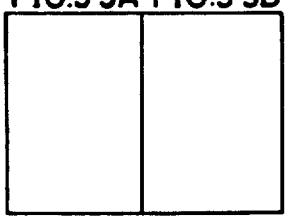

FIG.4-1
FIG.4-1A FIG.4-1B
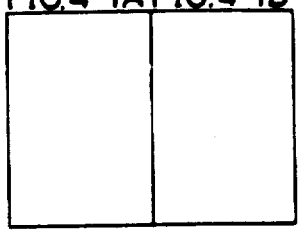
FIG.4-1A
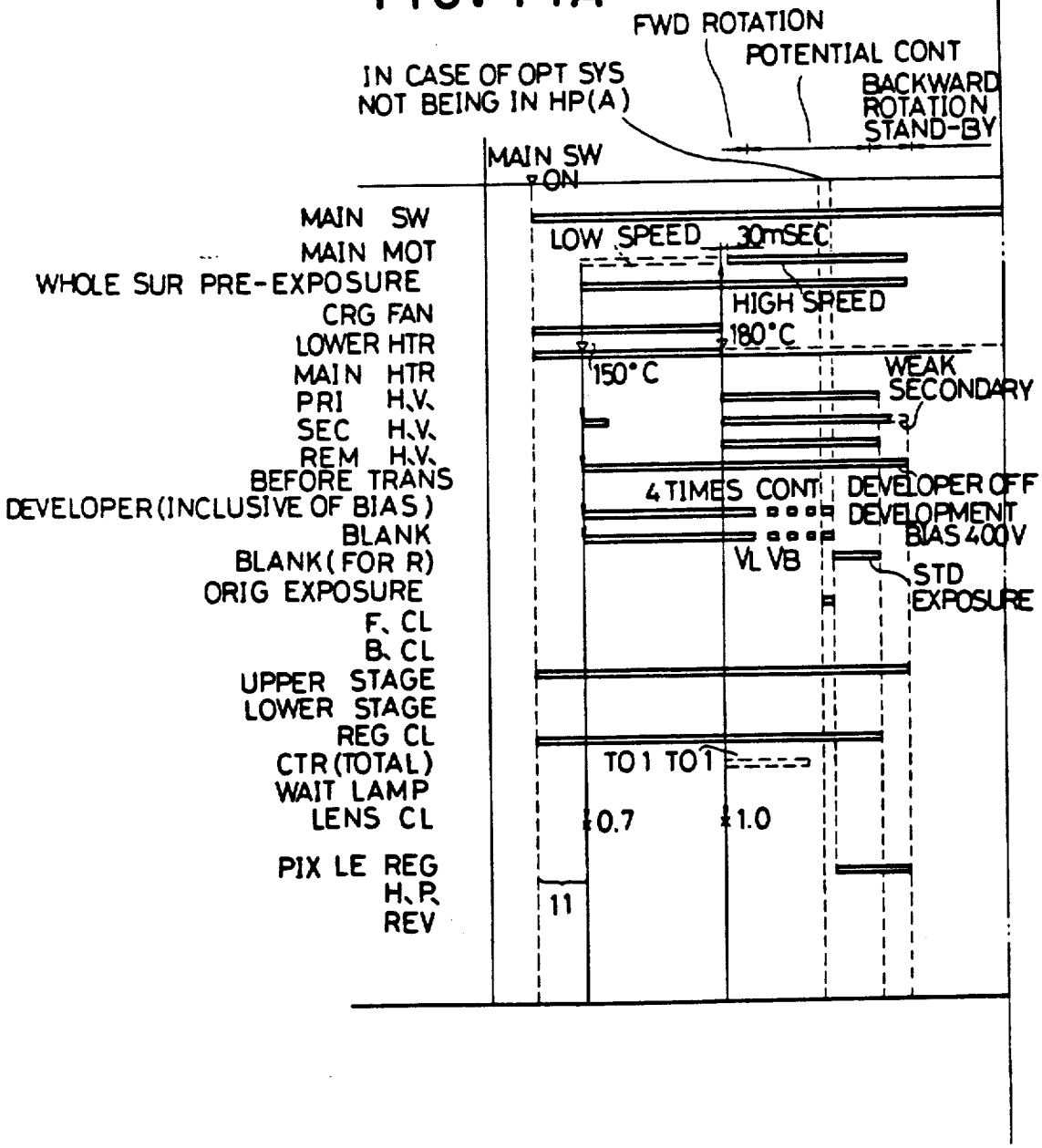

FIG.4-2
FIG.4-2A FIG.4-2B
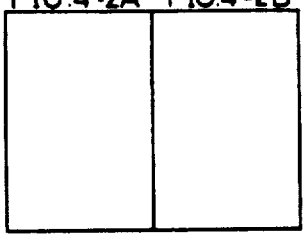
FIG.4-2A
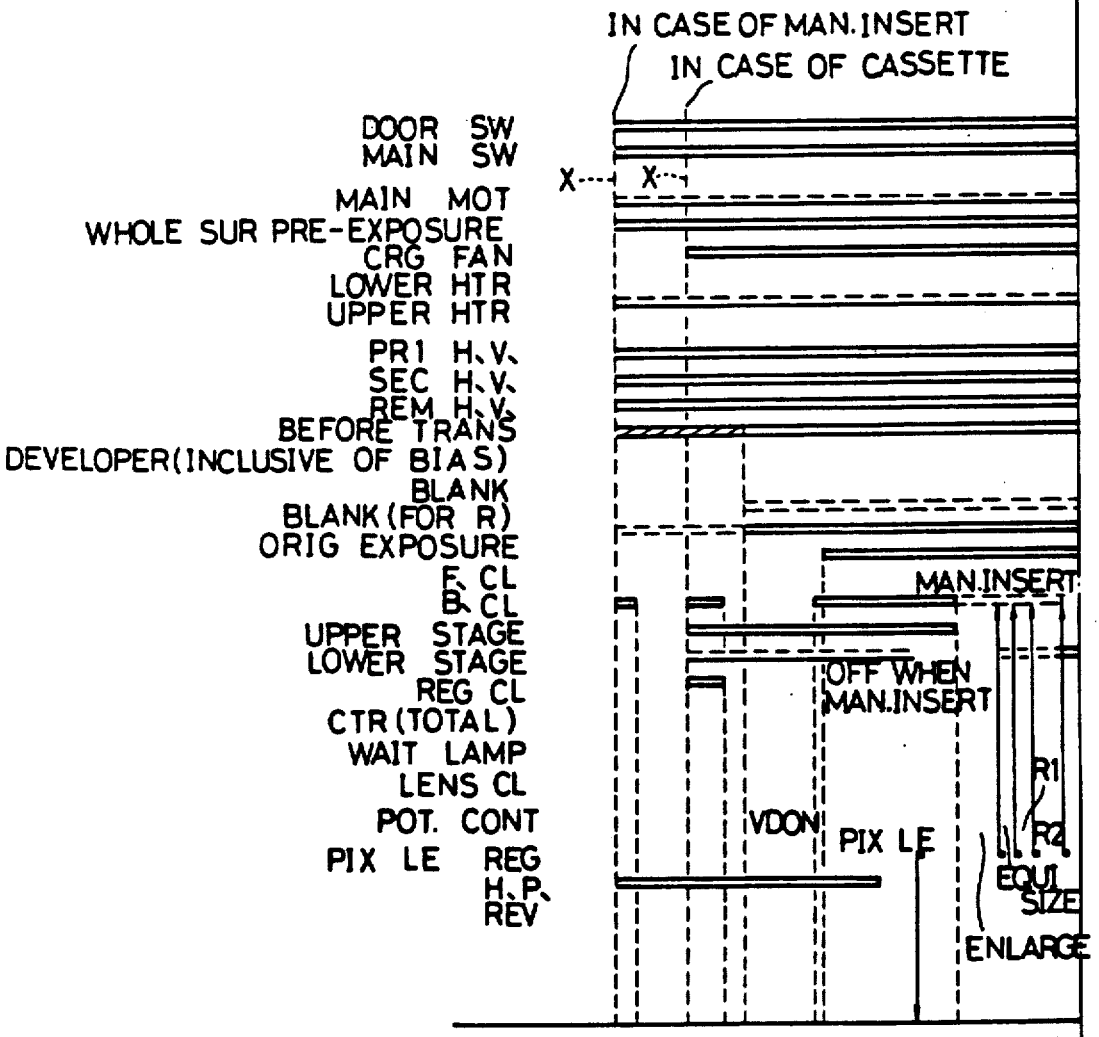

FIG.5—1
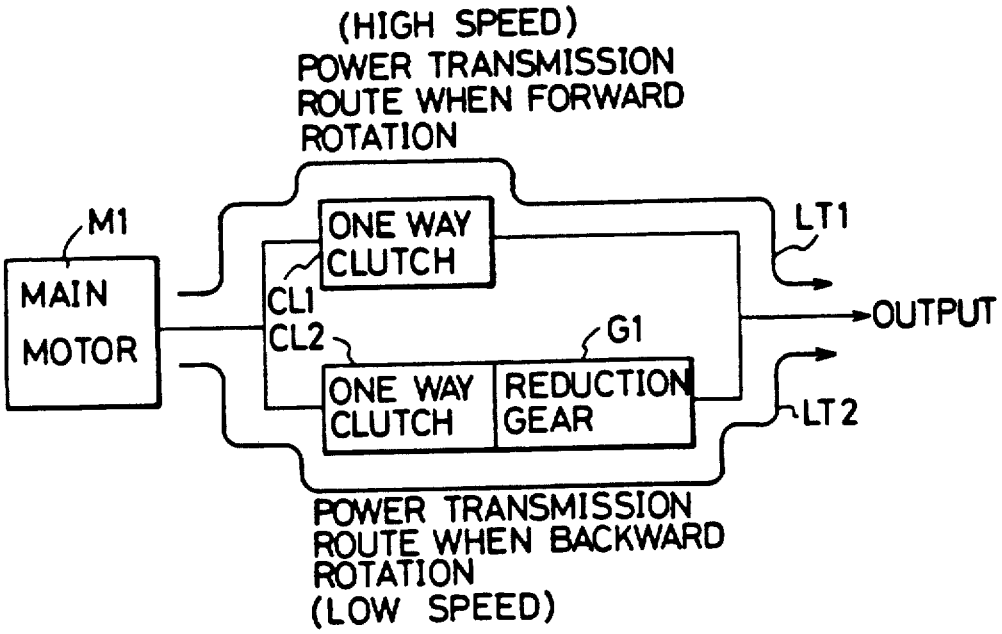
FIG.5—2
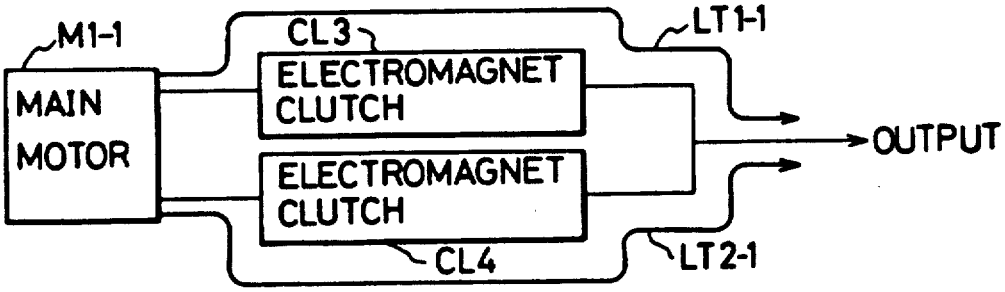

POWER ON
CLR RAM & I/O
60
RESET CEQ CONTROLLER
61
N
ALLOW INTERRUPT (BEGIN KEY & DISP)
62
Z
MAN SW ON
63
ALLOW KEY-IN
64
CLR & START 2HRS TIMER
65
SUB PAPER
66
SUB PAPER
73
REQUEST LENS 1TO1 POS
N
Y
MOVE TO LENS 1 TO1 POS
ALLOW LENS MOVEMENT
N
MOVE LENS TO COPY MODE POS
74
INHIBIT OTHER KEY-IN
75
DURING OPT SYS REVERSAL
N

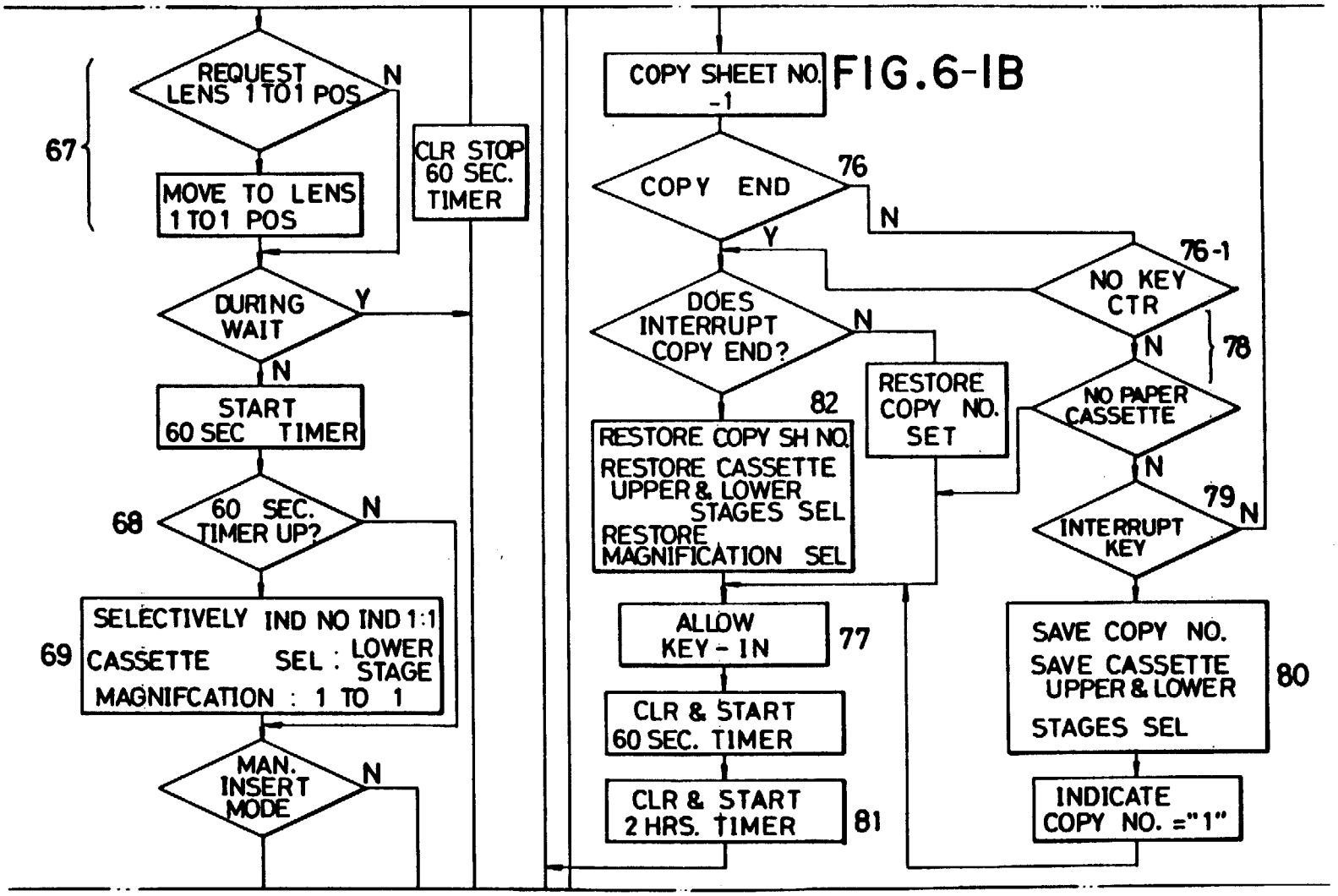
FIG. 6-IB

SUB PAPER

UPPER CASSETTE SEL ?
261
Y
N
MAN. INSERT MODE
Y
N
INPUT LOWER STAGE CASSETTE DATA
INPUT UPPER CASSETTE DATA
PRESENCE OF PAPER CASSETTE
N
Y
PRESENCE OF PAPER CASSETTE
262
N
Y
IND SET CASSETTE
263
A3 → B4 SELECT
N
Y
A3 → A4 SELECT
N
Y
HAS B4 CASSETTE SELECTED?
264
Y
N
HAS A4R CASSETTE SELECTED?
Y
N
FLASH B4 CASSETTE INDICATOR
265
FLASH A4R CASSETTE INDICATOR

TURN MAN. INSERT INDICATOR ON
A4 → B5 SEL
N
Y
B4 → B5 SEL
N
Y
HAS B5 CASSETTE SELECTED?
Y
N
HAS B5R CASSETTE SELECTED?
Y
N
FLASH A4R CASSETTE INDICATOR
FLASH B5R CASSETTE INDICATOR
(ENLARGE) N
1 TO 1 SEL
267
Y
N
B4 → A4 SEL
Y
HAS A4R CASSETTE SELECTED?
Y
N
HAS B5R CASSETTE SELECTED?
Y
N
HAS A4R CASSETTE SELECTED?
Y
N
FLASH A4R CASSETTE INDICATOR
FLASH A4, A3, B4, B5 U1, U2, INDICATORS
268

X
IS LENS STR SENSOR FALLING DOWN?
74-7
N
Y
LENS STR+1 (OCTAL)
74-10
CLE & START TIMER (tC)
74-8
LENS LOCK ALREADY PROCESSED
Y
N
TIMER tB=900m SEC
N
Y
MOVE TO ENLARGE POS
N
Y
STOP LENS MOVEMENT
74-9
LENS CTR + 1
RT
LENS CTR
74-13
N
Y

POWER ON
68
CLE RAM & I/O
69
HAS MANAGEMENT CONT RESET?
N
Y
A
70
MAIN SW ON
N
Y
70-3
CLEAR RAM & I/O
70-1
LOAD PWR SUPPLY(+24V) ON
70-2
FIXING UPPER HTR ON
FIXING LOWER HTR ON
71
3MINUTE TIMER TIMED OUT
N
Y
FIXING UNIT TEMP ≧ 150°C
N
Y
71-2
IS BACKSIDE PLATE DOOR OPEN?
Y
N
170°C UP
N
Y
WAIT LAMP OFF
L

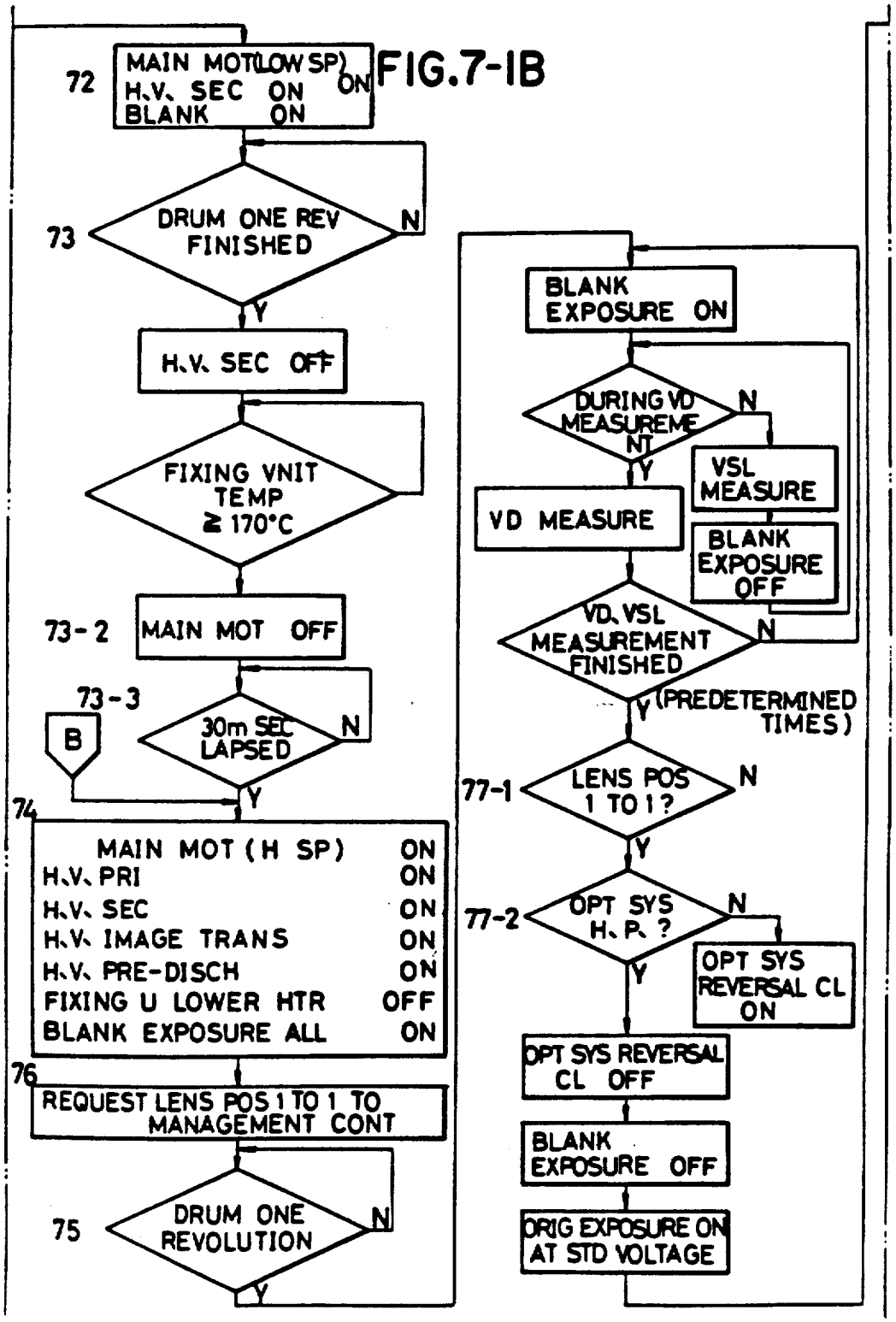
FIG.7-1B
72
MAIN MOT(LOW SP) ON
H.V. SEC ON
BLANK ON
73
DRUM ONE REV FINISHED
N
Y
H.V. SEC OFF
FIXING VNIT TEMP ≧ 170°C
73-2
MAIN MOT OFF
73-3
B
30m SEC LAPSED
N
Y
74
MAIN MOT (H SP) ON
H.V. PRI ON
H.V. SEC ON
H.V. IMAGE TRANS ON
H.V. PRE-DISCH ON
FIXING U LOWER HTR OFF
BLANK EXPOSURE ALL ON
76
REQUEST LENS POS 1 TO 1 TO MANAGEMENT CONT
75
DRUM ONE REVOLUTION
N
Y
BLANK EXPOSURE ON
DURING VD MEASUREMENT
N
Y
VSL MEASURE
BLANK EXPOSURE OFF
VD MEASURE
VD, VSL MEASUREMENT FINISHED
N
Y (PREDETERMINED TIMES)
77-1
LENS POS 1 TO 1 ?
N
Y
77-2
OPT SYS H.P. ?
N
Y
OPT SYS REVERSAL CL ON
OPT SYS REVERSAL CL OFF
BLANK EXPOSURE OFF
ORIG EXPOSURE ON AT STD VOLTAGE

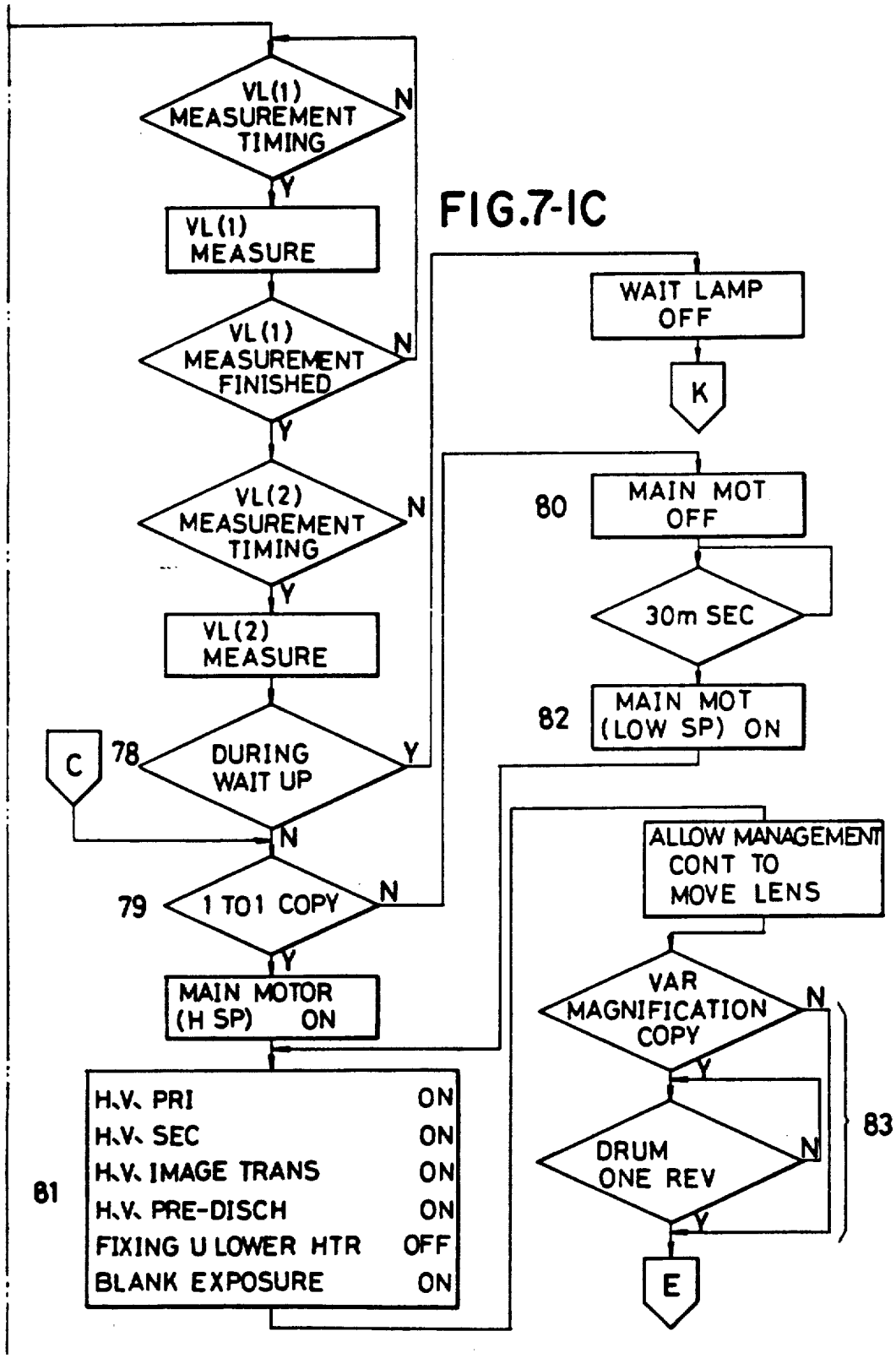
FIG.7-IC
VL(1) MEASUREMENT TIMING
N
Y
VL(1) MEASURE
VL(1) MEASUREMENT FINISHED
N
Y
VL(2) MEASUREMENT TIMING
N
Y
VL(2) MEASURE
C
78
DURING WAIT UP
Y
N
79
1 TO1 COPY
N
Y
MAIN MOTOR (H SP) ON
81
H.V. PRI ON
H.V. SEC ON
H.V. IMAGE TRANS ON
H.V. PRE-DISCH ON
FIXING U LOWER HTR OFF
BLANK EXPOSURE ON
WAIT LAMP OFF
K
80
MAIN MOT OFF
30m SEC
82
MAIN MOT (LOW SP) ON
ALLOW MANAGEMENT CONT TO MOVE LENS
VAR MAGNIFICATION COPY
N
Y
DRUM ONE REV
N
Y
83
E E
HAS LENS POSITION MATCHED
N
Y
F
VL2 MEASURE
171
CLEAR & START OPTICAL SYSTEM ABNORMAL TIMER A.C
171-1
172
ENLARGED COPY
N
Y
174
REDUCTION 1
N
Y
B5 CASSETTE
Y
N
A4R CASSETTE
Y
N
A4 CASSETTE
Y
N
B5R CASSETTE
Y
N
U2 CASSETTE
Y
N
173
SET MIDDLE SIZE REVERSAL POSITION
175
SET HALF SIZE REVERSAL POSITION
G

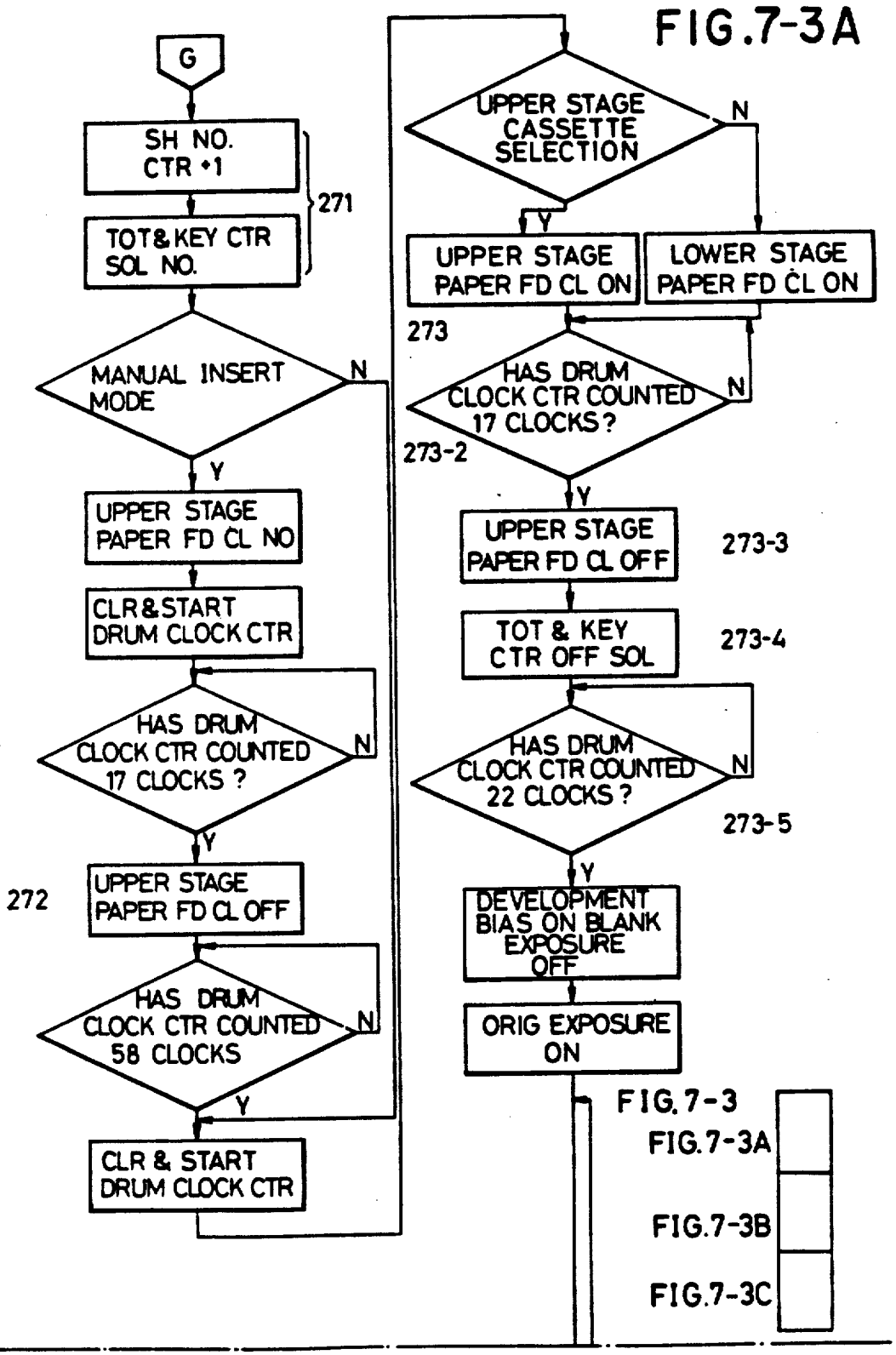
FIG.7-3A
G
SH NO. CTR +1
TOT&KEY CTR SOL NO.
271
MANUAL INSERT MODE
N
Y
UPPER STAGE PAPER FD CL NO
CLR&START DRUM CLOCK CTR
HAS DRUM CLOCK CTR COUNTED 17 CLOCKS ?
N
Y
272
UPPER STAGE PAPER FD CL OFF
HAS DRUM CLOCK CTR COUNTED 58 CLOCKS
N
Y
CLR & START DRUM CLOCK CTR
UPPER STAGE CASSETTE SELECTION
N
Y
UPPER STAGE PAPER FD CL ON
LOWER STAGE PAPER FD CL ON
273
HAS DRUM CLOCK CTR COUNTED 17 CLOCKS ?
N
273-2
Y
UPPER STAGE PAPER FD CL OFF
273-3
TOT & KEY CTR OFF SOL
273-4
HAS DRUM CLOCK CTR COUNTED 22 CLOCKS ?
N
273-5
Y
DEVELOPMENT BIAS ON BLANK EXPOSURE OFF
ORIG EXPOSURE ON
FIG.7-3
FIG.7-3A
FIG.7-3B
FIG.7-3C

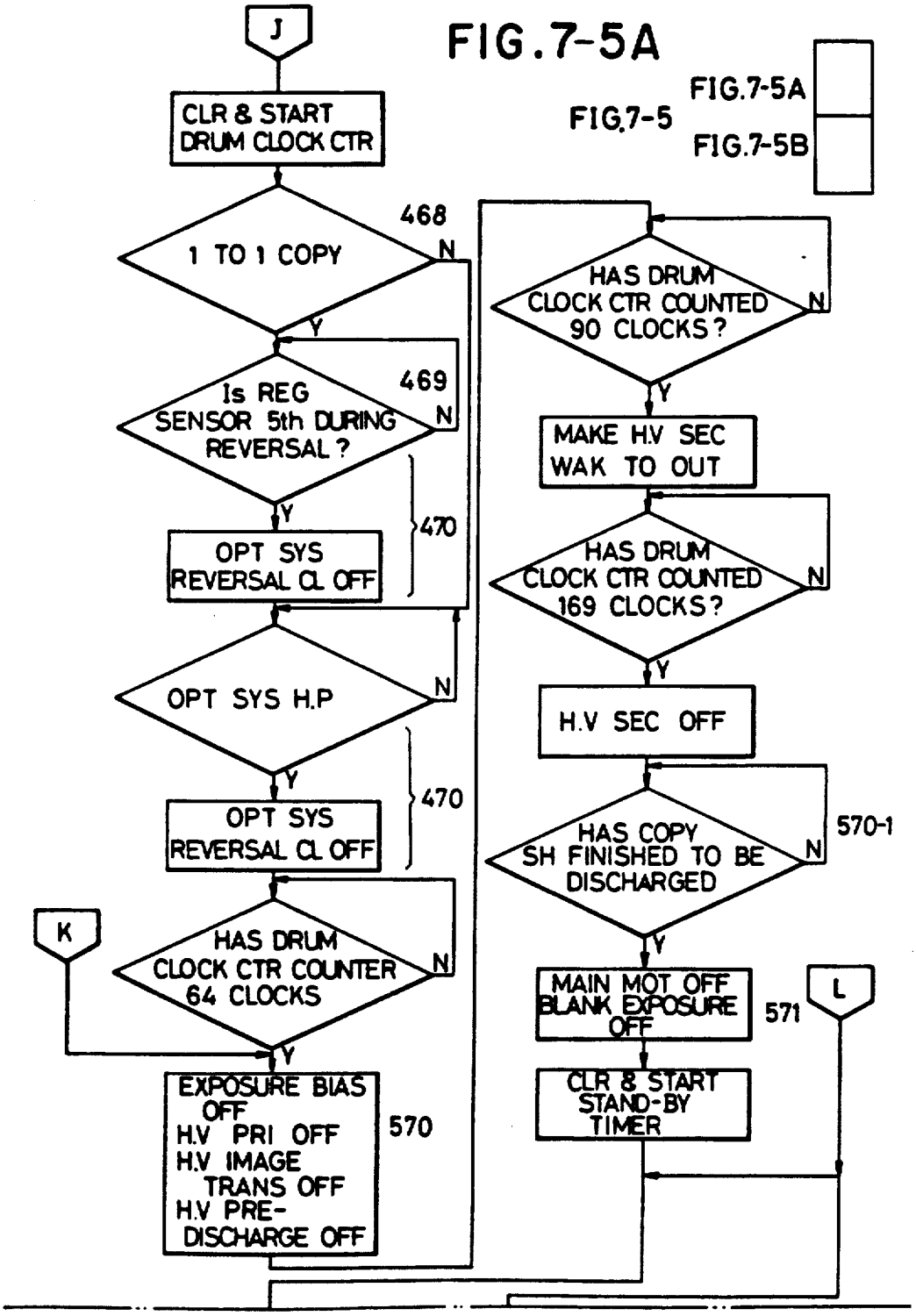
FIG.7-5A
FIG.7-5
FIG.7-5A
FIG.7-5B
J
CLR & START DRUM CLOCK CTR
1 TO 1 COPY
468
N
Y
Is REG SENSOR 5th DURING REVERSAL ?
469
N
Y
OPT SYS REVERSAL CL OFF
470
OPT SYS H.P
N
Y
OPT SYS REVERSAL CL OFF
470
K
HAS DRUM CLOCK CTR COUNTER 64 CLOCKS
N
Y
EXPOSURE BIAS OFF
H.V PRI OFF
H.V IMAGE TRANS OFF
H.V PRE-DISCHARGE OFF
570
HAS DRUM CLOCK CTR COUNTED 90 CLOCKS ?
N
Y
MAKE H.V SEC WAK TO OUT
HAS DRUM CLOCK CTR COUNTED 169 CLOCKS ?
N
Y
H.V SEC OFF
HAS COPY SH FINISHED TO BE DISCHARGED
N
570-1
Y
MAIN MOT OFF BLANK EXPOSURE OFF
571
L
CLR & START STAND-BY TIMER

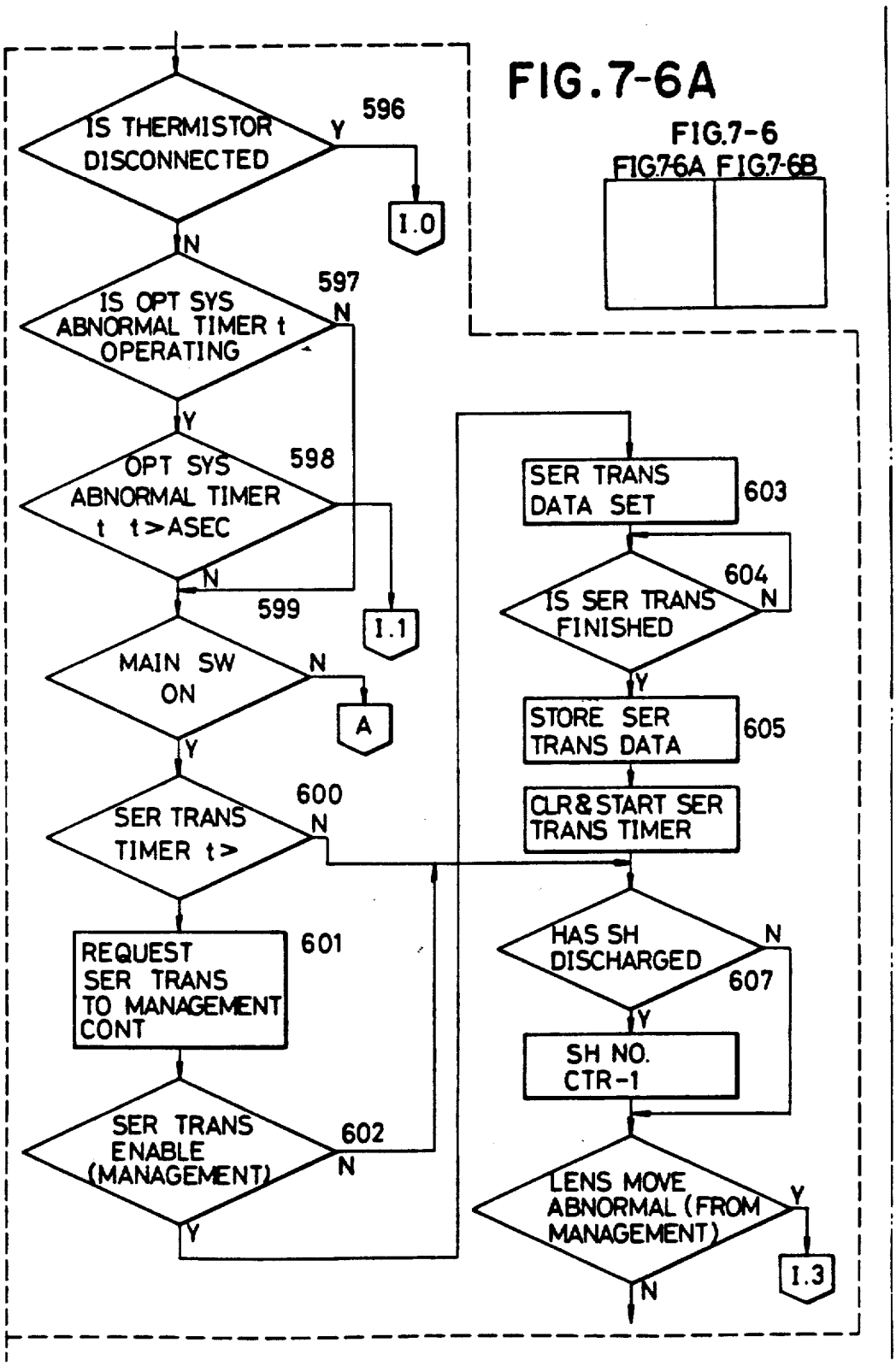
FIG.7-6A
FIG.7-6
FIG.7-6A FIG.7-6B
IS THERMISTOR DISCONNECTED
596
Y
I.0
N
IS OPT SYS ABNORMAL TIMER t OPERATING
597
N
Y
OPT SYS ABNORMAL TIMER t t>ASEC
598
N
I.1
599
MAIN SW ON
N
A
Y
SER TRANS TIMER t>
600
N
REQUEST SER TRANS TO MANAGEMENT CONT
601
SER TRANS ENABLE (MANAGEMENT)
602
N
Y
SER TRANS DATA SET
603
IS SER TRANS FINISHED
604
N
Y
STORE SER TRANS DATA
605
CLR & START SER TRANS TIMER
HAS SH DISCHARGED
607
N
Y
SH NO. CTR-1
LENS MOVE ABNORMAL (FROM MANAGEMENT)
Y
I.3
N

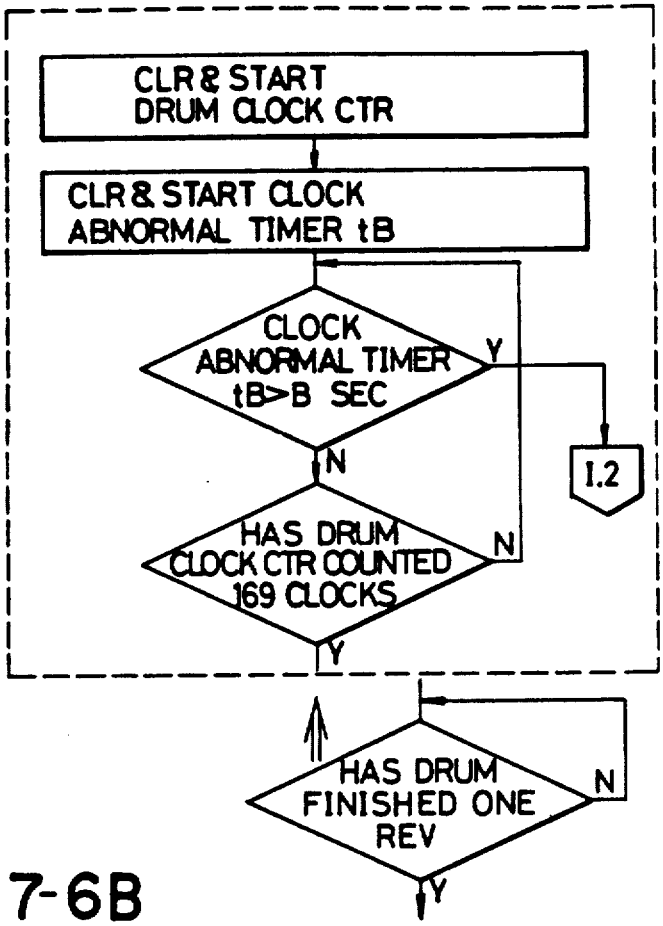
FIG. 7-6B
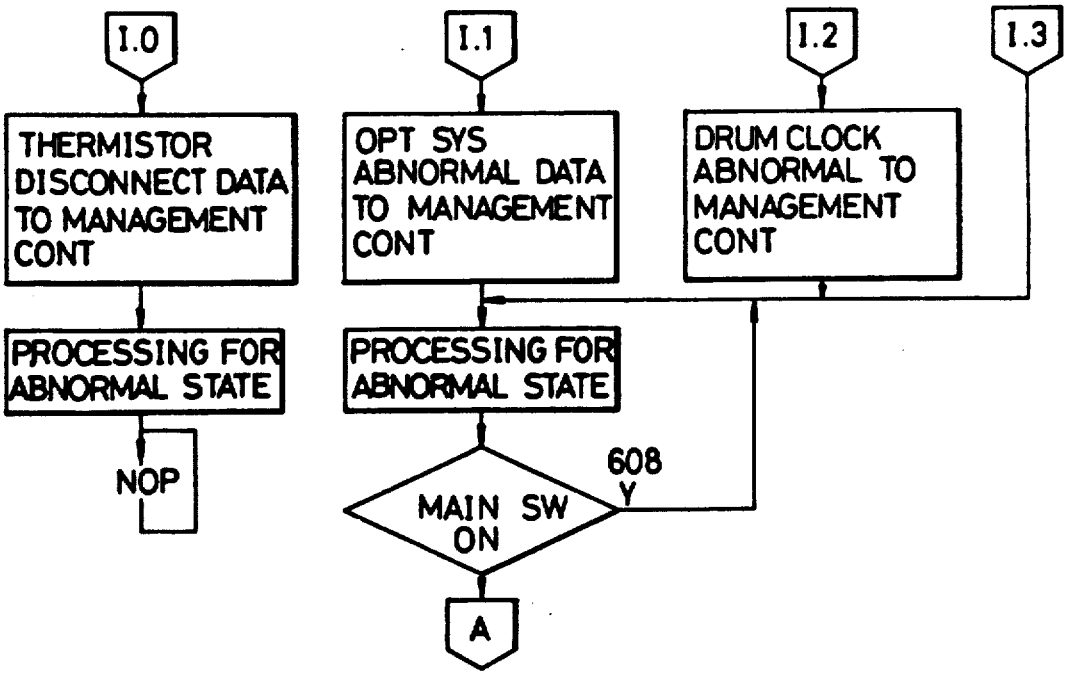

FIG.8

| | 1 TO 1 | ENLARGE | A3→B4 | A3→A4 | B4→A4 | B4→B5 | A4→B5 |
|---|---|---|---|---|---|---|---|
| A 3 | A3SIZE | B4SIZE | A3SIZE | A3SIZE | A3SIZE | A3SIZE | A3SIZE |
| B 4 | B4SIZE | B4SIZE | A3SIZE | A3SIZE | A3SIZE | A3SIZE | A3SIZE |
| A 4 | A4SIZE | B4SIZE | B4SIZE | B4SIZE | B4SIZE | B4SIZE | B4SIZE |
| B 5 | A4SIZE | B4SIZE | A4SIZE | B4SIZE | A4SIZE | B4SIZE | A4SIZE |
| A 4 R | B4SIZE | B4SIZE | B4SIZE | A3SIZE | B4SIZE | A3SIZE | B4SIZE |
| B 5 R | B4SIZE | B4SIZE | B4SIZE | B4SIZE | B4SIZE | B4SIZE | B4SIZE |

MARK: NORMAL CONDITION (NO WARNING)

FIG.10
FIG.10A FIG.10B

FIG.10 A

| | ST 3 | | | | ST 2 | | | | ST 1 | | |
|---|---|---|---|---|---|---|---|---|---|---|---|
| | 3 | 2 | 1 | 0 | 3 | 2 | 1 | 0 | 3 | 2 | 0 |
| MANAGEMENT → SER | 1 | MAN. INSERT MODE | ABNORMAL | AUTO SHUT OFF | LENS MOVE | COPY START | FWD ROTATION START | LENS 1:1 | LENS DESIRED POS | ENLARGE | REDUCTION2 |
| SER → MANAGEMENT | 0 | JAM | OTHERS | LENS 1:1 REQUEST | PAPER EXISTS IN | LENS MOVE ENABLE | DURING REVERSAL | DURING PAPER FEED | FWD ROTATION END | JAM | JAM |

FIG.10 B

| | ST0 | | | |
|---|---|---|---|---|
| 0 | 3 | 2 | 1 | 0 |
| REDUCTION1 | UPPER STAGE SEL | F/H | AB/U | A/B |
| | | | PAPER SIZE | |
| JAM COMPLEMENT1 | DURING WAIT | ABNORMAL | BACK DOOR ON | MAIN ON |

FIG.16 — 1
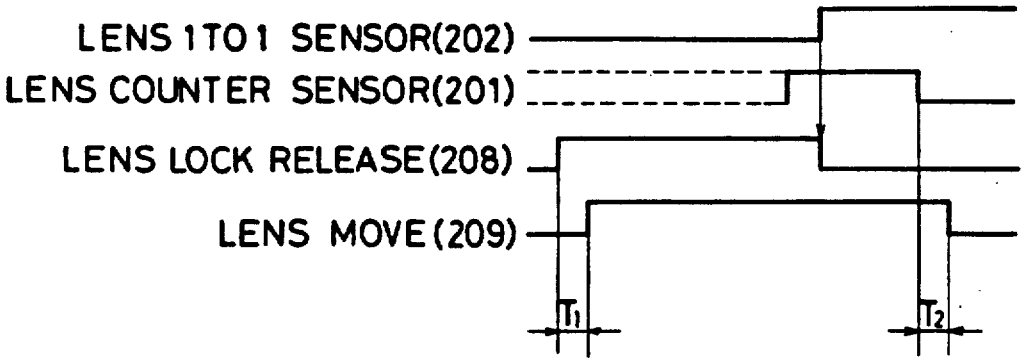
FIG.16 — 2
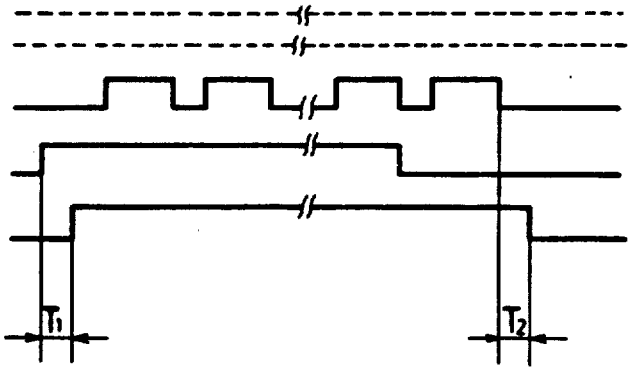

VARIABLE MAGNIFICATION COPYING APPARATUS AND AUTOMATIC SHUTDOWN THEREFOR

This application is a continuation of application Ser. No. 06/940,224 filed Dec. 8, 1986, now abandoned, which was a continuation of application Ser. No. 735,387 filed May 17, 1985, now Ser. No. 311,865 filed Oct. 15, 1981, now abandoned.

BACKGROUND OF THE INVENTION

1. Field of the Invention

The present invention relates to a copying apparatus.

2. Description of the Prior Art

In a copying apparatus with slit exposure method in which the original is scanned by relative movement thereof with respect to an optical system, the speed of the scanning exposure of the original has been a technical factor hindering the high-speed copying. In a same size copying with scanning exposure of the original in the forward movement of the optical system, the number of copies made per unit time can be approximately represented by the following equation:

$$N = V/(l_0 + l_p + l_r)\,(1 + \frac{1}{n}),$$

wherein

- N : number of copies
- $l_0$ : length of the original
- $l_p$ : distance of preliminary movement
- $l_r$ : distance to the reversing position, including exposure slit width
- $l_l$ : time loss for changing direction in movement, converting into distance
- V : peripheral speed of the photosensitive drum
- n : speed ratio of backward movement to forward movement.

Thus, for a copier capable of forming 40 copies of A4 size (210×279 mm) per minute, and for the parameters of $l_0$=210 mm, $l_p$=40 mm, $l_r$=10 mm, $l_l$=10 mm and n=2 (reversing at a double speed), the peripheral speed of the photosensitive drum is given by:

$$V = 270\text{ mm} \times 1.5 \times \frac{40\text{ copies}}{60\text{ sec}} = 270\text{ mm/sec}$$

so that the scanning speed has to be 270 mm/sec in the forward movement and 540 mm/sec in the backward movement.

In this manner an increased number N of copies calls for an increased speed V, which however will result in drawbacks such as an image blur caused by the shock at the reversing of the optical system or the wear thereof, or additional mechanisms and costs for preventing such drawback. Particularly in a copier having an image reduction capability, the scanning speed has to be increased by the reciprocal of the linear reduction rate. As the peripheral speed of the photosensitive drum in the presence of such image reduction capability is usually determined in consideration of the scanning speed at such image reducing operation, the drum peripheral speed for the same-size copying most frequently used is inevitably reduced by the presence of such image reduction capability.

Also there is already known a copier with variable magnification capability, performing the copying operation by selecting either one of plural sheet storage stations such as plural sheet cassettes. Such copier is designed to stop the copying operation in case of absence of a copying sheet matching the copy size of a varied magnification, and is therefore unable to form a reduced image on a part of a larger sheet.

However if the selection of the sheet storage stations is made independently of the selection of the magnification, the copied image may unexpectedly overflow the selected copy sheet particularly when multiple magnifications are selectable.

Also in case a copying of a determined image magnification is urgently needed during a multiple copying operation of another image magnification, such urgent copying can be achieved by the operator by suitable data input to interrupt said multiple copying and to displace the lens system to obtain said determined magnification, and in such case, after said urgent copying, the operator is required to enter data to return the lens system to the original magnification for continuing the interrupted copying, to select the original cassette and to set the number of remaining copies. These operations are as cumbersome as starting the copying operation from the beginning.

Also in the conventional copier with variable magnification, the change in image magnification is principally achieved by the change in lens position and in the length of optical path.

The lens displacement method requires precise mechanical positioning of the lens and the mirror in the optical path, and for this reason the lens and the mirror are mechanically linked and the lens position is precisely determined mechanically by a stopper. In order to detect the lens position for each image magnification there is proposed the use of a long sensor for activating the stopper and for detecting the lens position. However, due to insufficient accuracy of such sensor, it is often unable to identify if the lens is stopped at a correct position.

It is naturally possible to provide a sensor for activating the stopper and another sensor for position detection for each image magnification, but such method will require an increased number of sensors with complicated wirings.

There is also known a copier provided with sorter for collating copies, and further known is such copier capable of displaying a warning upon detection of sheet jamming in said sorter. However such warning is only given in the form of "sorter jamming" or "copier jamming" in response to respective detection, and is unsatisfactory for the operator in eliminating such jamming, despite of the increase in the number of displays.

Furthermore it is known to provide a sensor on the moving path of the reciprocating member of the optical system or the original carriage as registering means for synchronizing the original scanning with the copy sheet feeding thereby registering the image to be formed on the photosensitive drum with the position of the copy sheet.

Also in order to detect the position of the reciprocating member, there are provided plural reversing sensors for indicating the reversing positions of the optical system which are determined corresponding to the initial home positions of said system.

Also in a copier with variable magnification capability the magnification in the direction of original scanning is varied by changing the speed of the optical system, and for this reason the registering sensor has to be provided for each image magnification. However the presence of multiple sensors along the scanning path leads to undesirable effects such as a lowered reliability, complication in wirings and an elevated cost.

Also if the speed of the scanning system is high in the repetitive copying operation, said system tends to overrun the original home position and to collide against the stopper. Such drawback can be prevented by a brake, which however involves a complicated structure and an elevated cost. Also the apparatus becomes inevitably larger if the home position or the stopper is provided at a farther location Furthermore, the conventional p-type microcomputer is structured to release a low-level output signal upon resetting after the start of power supply, whereby an inverted-type driver circuit, for example a switching element composed of a Darlington transistor circuit, connected to said microcomputer for example for driving a paper feed plunger, is not turned on at said resetting, thus preventing the erroneous function of the process load connected thereto.

On the other hand the n-type microcomputer, though being preferred in permitting the same power supply and signal voltage as in the conventional TTL circuits, releases a high-level output at the resetting, thus erroneously turning on the driver circuit to cause undesirable operation of the process loads. Such erroneous operation may cause sudden large current in the circuit, thus activating the circuit breaker or eventually deteriorating or damaging the circuit components.

Also in case the microcomputer is activated for time measurement etc. before the main switch is turned on for power supply to various operation loads and the resetting of said microcomputer is conducted by the self-judgement of said microcomputer, the erroneous function of process load such as abnormal lighting of the halogen lamp may take place without being noticed by anyone, thus leading to a dangerous situation.

Also in case of a structure in which the microcomputer initiates the program execution even before the main switch is turned on and there are provided two systems of power supply, for example one for displaying copy number, absence of copy paper etc. and the other for paper-feed plunger, at least one of which is used as common power source for said microcomputer, some process loads cannot be turned off by the main switch and have to be cut off by the control signal from said microcomputer. Consequently the function of certain process loads, for example the display of copy number, may still be going on by an erroneous function of the microcomputer even after the main switch is cut off.

Furthermore, in case there are employed plural microcomputers, for example one for copying control and another for display control, either one may exert wild control in case of an erroneous function of the other, for example producing excessive copies.

Particularly of a microcomputer for controlling power supply switches such as the main switch or door switches and controlling power supply to the process loads is in normal state while the other microcomputer is in malfunction, there may result a dangerous situation because of the power supply to the process loads while the overall control of the apparatus is disabled.

Furthermore, in the use of a so-called one-chip microcomputer having program memories, data memories, input/output ports and a processing unit on a single chip of semiconductor, the data transfer between microcomputers have to be made through input-output ports due to the absence of the data bus line connected to the exterior. However the multiple functions in recent copier with many process loads and display devices require an elevated number of input/output ports for data transfer, with complicated program or sequence for the control of operations and displays.

Also the completion of resetting or the normal function of the microcomputer, which is identified by the level at an output port of said microcomputer, may become unidentifiable because of a malfunction of said port.

Furthermore in the use of multiple microcomputers, the identification of the turning on of the main switch, if executed individually, will require a port in each microcomputer exclusively for this purpose, thus wasting port in each microcomputer.

Also the key counter, designed for use in counting the copy number for example in each division, is made insertable into the apparatus, which is structured incapable of copying operation without said key counter. However after the copying operation is initiated with the inserted key counter, the operator can extract said key counter before it is step advanced, thus obtaining a copy without counting. Such possibility leads to inaccurate copy counting and affects the cost control in office or the fee calculation in the copying service business.

Also the halogen lamp heater is recently employed for heating the fixing roller in a temperature-controlled fixing station, and such lamp heater generates, at the start of power supply, a surge current more than ten times higher than the stationary current. Besides the copier is provided with a direct current power supply for control purpose, having large smoothing condensers. Consequently, upon turning on of the main switch, the surge current in the heater is overlapped with the charging current to said smoothing condensers to generate an overall current which is several ten times higher than the current in the stationary state. Such large current may trigger the circuit breaker for protection, or may reduce the power supply voltage, thus causing undesirable effects on other instruments.

Also the main switch usually have mechanical contacts which inevitably shows bouncing movement at the turning on. The aforementioned surge current during such bouncing movement results in sparking in said contacts, thus causing rapid oxidation of the contacts.

Also the copier is equipped with a lamp for original exposure and heaters for heating fixing rollers for fixing the image onto the transfer sheet. Said fixing rollers are normally composed of a heating roller coming into direct contact with the image on said sheet and a pressure roller for maintaining said sheet in contact with the heating roller. The heating roller is provided with a heater of a capacity generally in the range of 1 kW, while the pressure roller is not provided with heater or is provided with a heater of a smaller capacity for performing auxiliary functions such as for obtaining uniform temperature distribution in the fixing station or increasing the heat capacity. On the other hand, since the receptacles for ordinary use are mostly of a capacity of 15 A for 100 V, it is important to maintain the entire power consumption of the copier below 1.5 kW, as otherwise it cannot be powered from an ordinary receptacle.

SUMMARY OF THE INVENTION

In consideration of the foregoing, the object of the present invention is to provide a copying apparatus not associated with the aforementioned drawbacks.

Another object of the present invention is to provide an improved copying apparatus with variable magnification capability, wherein the reduce or enlarged copying operation is achieved by switching the peripheral speed of the rotary member contributing to the image transfer, in combination with the switching of the scanning speed, thus avoiding the loss in the copying speed in the real-size copying. More specifically the peripheral speed is selected largest at the real-size copying, and it is determined in the reduced or enlarged copying in consideration of the rate of reduction or enlargement and of the scanning speed, and in this manner it is rendered possible to increase the copying speed not only in the real-size copying but also in the reduced or enlarged copying.

Still another object of the present invention is to provide a copying apparatus capable of shortening the process preparation time by increasing the rotation speed of the rotary member when it is not in the process.

Still another object of the present invention is to provide a copying apparatus allowing appropriate preparation by executing or not executing said change of the rotation speed according to the rest time of the apparatus.

Also high-speed rotation of the rotary member results in increased abrasion of the blade for removing the remaining toner or of other contacting elements and in a shortened service life of said rotary member, and still another object of the present invention is to minimize such abrasion by reducing the rotating speed of the rotary member during the preparatory period at the start of the operation.

Also a change in the peripheral speed of the rotary member may cause a change in the potential thereof, thus forming a defective latent image, and still another object of the present invention is to provide a latent image of constantly stable gradation and density by regulating the output voltage of a high-voltage transformer to be supplied to the charger or the voltage supplied to the light source for illuminating the original according to the peripheral speed of the rotary member.

Also the induction motor conventionally used as the main motor for driving the photosensitive drum does not allow stable drive with fine speed adjustment, and still another object of the present invention is to provide stable and switchable low- and high-speed rotation, through forward and reverse drive of the main motor combined with a one-way clutch.

According to the present invention the peripheral speed of the rotary member is not changed in case an instruction for a magnification change or a color copying requiring a change in the peripheral speed is entered during the rotation of said rotary member but is only changed after the receipt of a copy start instruction, whereby it is rendered possible to avoid the change in rotation speed at each mode entry, thus minimizing noise resulting from such change.

Also the change in the peripheral speed is conducted with certain delay in time in order to realize smooth change without damage to component parts.

The advantage of switching voltage supplies in response to the change in the peripheral speed of the rotary drum is exhibited not only in the aforementioned variable magnification capability but is also effective in case the rotation speed of the drum motor is changed by the difference in power supply frequency or in case the rotation speed of the photosensitive drum is regulated for synchronization with the sorter or document feeder. Same is applicable to the advantage of switching the peripheral speed in the preparatory rotation of the drum.

Still another object of the present invention is to provide a copying apparatus with variable magnification capability not associated with the inconvenience resulting from the relation between the image magnification and the sheet size.

According to the present invention the copying operation is executed in response to a copy start instruction even when the detected size of the copy sheet is different from the copy size formed at a desired image magnification, and a warning signal is given during such copying operation, whereby it is rendered possible to produce a copy with an arbitrarily selected magnification on the copy sheet of an arbitrarily selected size, while avoiding image overflow from the sheet or undesired image position on the sheet.

Also according to the present invention the copy size formed at the desired image magnification and the matching sheet size are displayed together with said warning, in order to facilitate selection of a correct sheet cassette.

Still another object of the present invention is to provide a copying apparatus capable of enlarged copying in addition to reduced copying, with an additional capability of forming a part of enlarged image onto the copy sheet, thus increasing the application of enlarged copying.

Still another object of the present invention is to reduce the scanning stroke of the original document corresponding to a selected small size, thus avoiding useless scanning motion and maximizing the copying speed in repeated copying operation.

Still another object of the present invention is to shorten, after the entry of an instruction for image reduction or enlargement, the time allowance for alteration thereof compared to the time allowance for alteration after numeral entry, thereby preventing unnecessary movement of the lens and other movable parts.

More specifically the function of the magnification selecting key is forbidden after the copy start key is actuated while the selection of copy number or cassette is allowed until immediately before the start of sheet feeding, whereby the operator is allowed to change the copy number or size urgently after the copy start key is actuated, thus reducing mistaken copies. The forbidding of magnification selection after the actuation of the copy start key is to avoid the delay of the copying operation caused by a fact that the lens displacement required prior to the copying operation is hindered by the change in magnification.

Still another object of the present invention is to provide an improved copying apparatus capable of easily restarting the copying operation interrupted by another urgent copying operation, in case said two operations have different image magnifications. More specifically, in case the first copying operation and the urgent interrupting operation are to be respectively conducted at real-size and a reduced or enlarged size or vice versa, or at a reduced size and an enlarged size or vice versa, or at a first reduced size and a second reduced size, the remainder of the first copying operation is automatically conducted, after the completion of said urgent copying operation, with automatic shift of the lens system to the position of the first image magnification without requiring repeated data entry for the first copying mode.

Also according to the present invention the copy number display is returned to "1" while the previous content is diverted to a memory in response to an instruction for an urgent copying operation, and the displays for image magnification and for cassette selection retain the original data unless new data are entered, thereby avoiding useless motion of the lens system and other movable parts at the entry of instruction for urgent copying and minimizing the trouble for mode data entry for such urgent copying.

Also such movable parts are set to the selected magnification not after the entry of magnification for said urgent copying but after the entry of the copy start instruction, so that such movable parts, not performing unnecessary motions even when the magnification is altered, are protected from deterioration of precision or from noise generation.

Also even in case the urgent copying operation is conducted with a reduced or enlarged copying mode, the magnification, cassette process sequence and scanning mode are automatically returned to the original state after the termination of said urgent copying operation so that the interrupted copying operation can be restarted simply by a copy start instruction.

Also the warning signal indicating the difference between the sheet size and the copy size formed by selected image magnification in the first copying operation is interrupted at the urgent copying operation to enable another warning signal indicating a similar difference in said urgent copying operation, and the warning signal for the first copying operation is re-started upon completion of said urgent copying operation.

Also according to the present invention there is detected, in addition to the detection and display of the selected sheet size, the eventual difference between said sheet size and the copy size determined by the selected image magnification, and there is given an intermittently lighted display indicating such difference during the copying operation with such image magnification.

Still another object of the present invention is to prevent difficulties in setting the optical system at a desired position in a copying operation with an altered magnification and to allow exact setting of the lens and mirrors with sensors of a reduced number. According to the present invention there are provided means for generating a signal in response to a determined position of the lens and means for generating serial signals according to the lens displacement, which is controlled and terminated at the desired position by counting said serial signals starting from the first-mentioned signal indicating the presence of the lens at a home position. Said lens home position signal corresponds to a lens position at the real-size copying, and said means are composed of Hall devices or photointerrupters for detecting disk positions or disk marks linked with the lens displacement.

Still another object of the present invention is to allow rapid detection of a trouble relating to the position setting of the optical system and to display such trouble by means of segment display devices for indicating the copy number and/or to prohibit the copying operation.

Still another object of the present invention is to provide a structure in which the display unit for copy number can indicate the sheet jamming in the auxiliary devices such as sorter as well as in the copier itself, together with the number of sheets lost in such jamming. For example said display unit is switched, upon detection of a sheet jamming, to display "P1" for jamming in the copier with one sheet lost, "P2" for two sheets lost, or "P0" for jamming in the sorter, thereby facilitating the operator's action to such jamming without an increase in the cost.

Said display device also indicates other troubles such as failures in the scanning clutch, in timing signal source, in thermister for fixing heater or in sorter by signals "E1", "E2" etc. in classified manner or by "00" in collective manner, whereby the copying operation is interrupted, thus contributing to the safety of the apparatus. In such case the apparatus continues to be powered but the controlling microcomputer cuts off all the output signals except those for display, thus ensuring safety and ease of restart of operation.

The above-explained displays are executed also in case of an urgent copying operation which is conducted interrupting another repeated copying operation and in which the obtained copies are all collected in a determined bin in the sorter without collating, whereby the action for sheet jamming can be carried out conveniently and assuredly.

Also the indication of a jamming in the auxiliary device can be shifted to the original display of copy number by releasing operation prohibiting means such as a jam latch relay in the copier, so that it is not necessary to provide the auxiliary device with a particular reset switch.

Still another object of the present invention is to provide a copying apparatus provided with improved timing control.

Still another object of the present invention is to reduce the number of sensors for process control thereby to improve the reliability, to reduce the number of wirings and related costs and to facilitate the maintenance service and adjustment. According to the present invention the scanning means is provided thereon with plural flag members or the like which are so positioned to pass through a sensor at the displacement of said scanning means whereby the position thereof is determined from the number of said members having passed the sensor.

Still another object of the present invention is to provide a process control by the combination of serial pulses generated in the copying process such as by the rotation of photosensitive drum and another series of pulses generated for example by the displacement of the scanning system, whereby a plurality of process loads can be controlled with a limited number of sensors and without complicated circuitry.

Still another object of the present invention is to provide a stroke control process for the scanning system by plural sensors for detecting the displacing position of said system and plural flag members or the like to be used in combination, thereby enabling to control strokes of a number in excess of the number of said sensors or flag members and preventing the enlargement of the copier resulting from the awkwardly positioned stroke control member.

Still another object of the present invention is to allow a sensor to perform different functions in the forward and backward movements of the scanning system thereby realizing an efficient use of the sensor.

Still another object of the present invention is to provide independent sensors for each fundamental function thereby enabling fine adjustment against machine-to-machine fluctuation, without affecting the functions of other sensors.

Still another object of the present invention is to turn off the reversing drive for the scanning system at a determined timing prior to the arrival thereof at the home position, thereby abating the shock in the high-speed backward motion of the scanning system.

Also according to the present invention, the method or timing of said turning-off control in a varied magnification mode with a different process speed is made different from that in the real-size magnification mode, thereby preventing a loss in the copying speed or a deterioration in the precision.

Still another object of the present invention is to employ different methods or timings for checking troubles according to such different speeds, thereby improving the accuracy of checking.

Still another object of the present invention is to use the sensor controlling the scanning system also for controlling the sheet feed system within a certain time period.

Still another object of the present invention is to use, inversely, the sensor controlling the sheet feed system also for controlling the scanning system within a certain time period.

Still another object of the present invention is to provide a structure adapted for computer processing of the signals obtained from the above-mentioned sensor for controlling the scanning system.

Still another object of the present invention is to provide an improved copying apparatus with variable magnification capability.

Still another object of the present invention is to provide a copying apparatus capable of appropriate black area erasure.

Still another object of the present invention is to provide an image forming apparatus having improved computer control for image formation.

Still another object of the present invention is to provide a structure in which the power supply for process loads is initially turned off and only turned on after the microcomputer is reset and initiates the execution of control programs, thereby preventing unnecessary function of said process loads.

Still another object of the present invention is to provide a structure not allowing power supply before the main switch is turned on, thereby ensuring safety of the apparatus.

Still another object of the present invention is to provide a structure capable of prohibiting power supply upon detection that the main switch is turned off, thereby preventing troubles resulting from such power supply.

Still another object of the present invention is to provide a control system in which the program is executed by checking the abnormality in a subordinate microcomputer thereby improving the reliability of the copier.

Still another object of the present invention is to enable the power supply to process loads through the main switch only after the confirmation of resetting and normal function of one or both of microcomputers, thereby preventing power supply to the process loads in case of incomplete control and thus ensuring safety of the apparatus.

Still another object of the present invention is to provide a control process for a copier utilizing plural one-chip microcomputers in which a microcomputer performs copy control and serially transfers certain signals required for copy control to another microcomputer which performs additional copy control according to thus transferred signals, and in which said another microcomputer serially transfers certain other signals required for copy control to the first-mentioned microcomputer.

Still another object of the present invention is to achieve an extremely high accuracy in judging abnormality in the controller by conducting said judgement in a serial transfer process.

Still another object of the present invention is to judge the abnormality of the controller only in a principal microcomputer or a microcomputer necessitating such judgement, and to transfer the result of said judgement to the other microcomputer through a line between the microcomputers, thereby economizing the number of input/output ports.

The above-mentioned judging process is achievable both in the n-type and p-type microcomputers, and is applicable not only to the principal-subordinate microcomputers for sequence control, key signal entry and display control but also to the copying system with plural microcomputers involving additional microcomputers for document feed control and/or sorter control.

Still another object of the present invention is to provide a structure capable of prohibiting the sheet feed operation upon detection of the absence of the key counter, for example by power supply control to the sheet feed means through contacts provided in said key counter, thereby preventing the copying operation in case the key counter is extracted after the copy start key is actuated.

Still another object of the present invention is to provide a structure having a delay timer for delaying the power supply to the fixing timer at the turning on of the main switch, thereby reducing the surge current in the entire apparatus. The power supply to the fixing heater is initiated not at the turning on of the main switch but only when the initial surge current in the DC power source is settled and the bouncing action of the main switch contacts is terminated, thus preventing damage to said contacts, avoiding undesirable effects to other instruments and ensuring extended service life of the apparatus.

Still another object of the present invention is to provide an image forming apparatus not causing trouble in the simultaneous use with another high-power consuming load. The above-mentioned object is achieved by supplying power to the fixing heater when the original illuminating lamp, usually consuming several hundred watts, is not in use and forbidding power supply to said heater when said lamp is in use, thus avoiding temporary increase in the entire power consumption.

Also conventionally the lamps and heaters are turned on and off by respective relay switches which are often the cause of limited service life, unreliable switching and noise or surge current resulting from the switching action, and still another object of the present invention is to provide a simple lamp and heater control circuit of a low cost, in which a lamp regulator is utilized for the switching of lamp, heater, and further of other loads.

Besides said regulator can be turned off at the switching of the lamp or heater to avoid spark generation at said switching, and still another object of the present invention is to provide a highly reliable and still inexpensive control circuit utilizing the lamp regulator as an on-off element and the relay as a load switching element, wherein said lamp regulator, providing a stabilized AC current, functions to supply a stable current to the heater, thus contributing the stabilization of the heater temperature.

BRIEF DESCRIPTION OF THE DRAWINGS

FIG. 3-1, comprising FIGS. 3-1A, 3-1B and 3-1C, FIG. 3-2, and FIG. 3-3, comprising FIGS. 3-3A and 3-3B are diagrams of the control circuit in the copier shown in FIG. 1;

FIG. 4-1, comprising FIGS. 4-1A and 4-1B, and FIG. 4-2, comprising FIGS. 4-2A and 4-2B are timing charts showing input/output signals in the circuits shown in FIGS. 3-1 to 3-3;

FIGS. 5-1 and 5-2 are block diagrams for main motor drive;

FIG. 6-1, comprising FIGS. 6-1A, 6-1B and 6-1C, FIG. 6-2, FIG. 6-3, comprising FIGS. 6-3A and 6-3B, and FIG. 6-4, comprising FIGS. 6-4A, 6-4B and 6-4C are control flow charts of the control computer;

FIG. 7-1, comprising FIGS. 7-1A, 7-1B and 7-1C, FIG. 7-2, comprising FIGS. 7-2A and 7-2B, FIG. 7-3, comprising FIGS. 7-3A, 7-3B and 7-3C, FIG. 7-4, comprising FIGS. 7-4A, 7-4B and 7-4C, FIG. 7-5, comprising FIGS. 7-5A and 7-5B, and FIGS. 7-6, comprising FIGS. 7-6A and 7-6B are control flow charts of the sequency computer;

FIG. 8 is a chart showing the combinations of the image magnifications and the sheet size and the combination for which a warning is given;

FIG. 10, comprising FIGS. 10-A and 10-B is a chart showing the serially transferred data;

FIG. 16-1 and 16-2 are timing charts for lens control;

DESCRIPTION OF THE PREFERRED EMBODIMENTS

Figure 1:
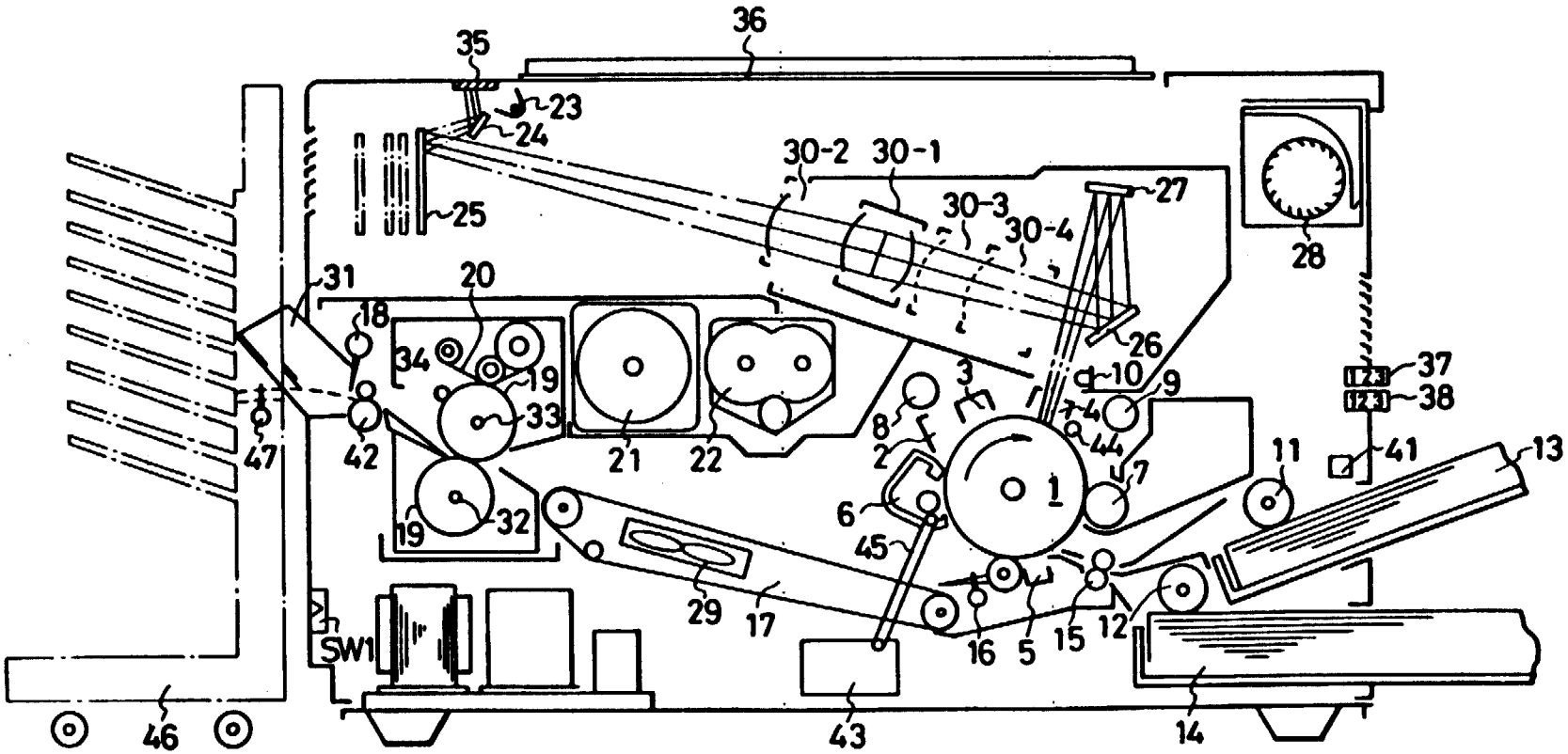
FIG. 1 is a cross-sectional view of a copier in which the present invention is applicable.

At first reference is made to FIG. 1 showing a copier in a cross-sectional view in which the present invention is applicable.

A drum 1 provided on the periphery thereof with a three-layered seamless photosensitive member is rotatably supported and is rotated in a direction of arrow by a main motor 21 to be activated upon actuation of a copy start key.

Upon completion of determined pre-rotation of said drum and pre-process for potential control therefor to be explained later, an original document placed on an original carriage plate 36 is illuminated by an illuminating lamp 23 structured integrally with a first scanning mirror 24, and the reflected light is scanned by said first scanning mirror 24 and a second scanning mirror 25 moved at a speed ratio of 1:½ to maintain a constant optical path length in front of a length 30.

The optical image thus reflected is transmitted through said lens 30, a third mirror 26, and a fourth mirror 27 and focused in an exposure station onto said drum 1.

Said drum 1 is at first subjected to charge elimination by a pre-exposure lamp 8 and a charge eliminator 2, then is charged, for example positively, by a primary charger 3 and is exposed in said exposure station to the slit image formed by said illuminating lamp 23.

Simultaneously with said image exposure the drum is subjected to AC charge elimination or charge elimination of a polarity opposite to that of the primary charging, for example by a negative corona discharge, by a secondary charger 4, and is successively subjected to an overall exposure by a flush exposure lamp 9 to form an electrostatic latent image of an elevated contrast on said drum 1. Said latent image is developed into a visible toner image by developing rollers in a developing station 7, and said toner image is transferred onto a copy sheet by means of a transfer charger 5.

The copy sheet stored in an upper cassette 13 or a lower cassette 14 is supplied into the apparatus by a feed roller 11 or 12, and further advanced toward the drum 1 with an exact timing with a registering roller 15 in such a manner that the leading end of said toner image coincides with that of said copy sheet in a transfer station.

The toner image on the drum 1 is transferred onto said copy sheet during the passage thereof between the drum 1 and the transfer charger 5.

After said image transfer, the copy sheet is separated from the drum 1 by a separating belt, then is guided through a sheet detection sensor 16 by a conveyor belt 17 to fixing rollers 19 where said transferred image is fixed by heat and pressure, and is ejected through a sheet detection sensor 18 to a tray 31 by an ejecting roller 42.

A transport fan 29 is provided for securing the transport of the copy sheet. Also after the image fixing, the fixing roller 19 is cleaned by a cleaning web 20.

The drum 1 after image transfer continues rotation for surface cleaning by a cleaning station composed of a cleaning roller and an elastic blade and proceeds to the succeeding imaging cycle, while the recovered toner is collected in a used toner container 43 through a pipe 45.

Figure 2:
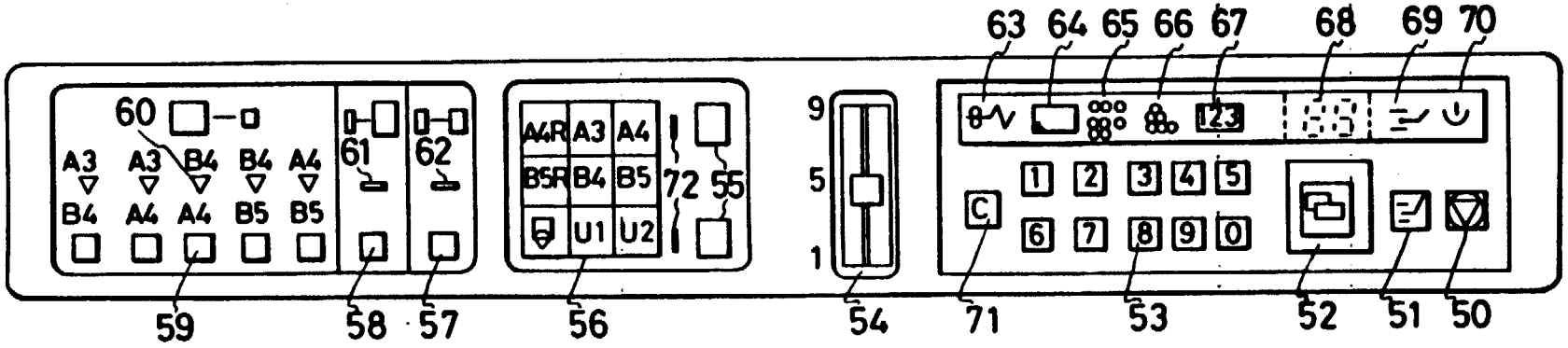
FIG. 2 is a plan view of the control panel of the copier shown in FIG. 1.

FIG. 2 is a plan view of the control panel of said copier, wherein shown are keys 55 for selecting the upper or lower cassette; a slide lever 54 for regulating the copy density in which a numeral "5" indicates a standard density; numeral keys 53 for entering the number of copies; a clear key 71 for cancelling thus entered copy number; an interruption key 51 for executing another copying operation before the completion of copying of a number set by said keys 53; a copy start key 52 for starting the copying operation; a stop key 50 for interrupting the continuous copying operation; keys 57, 58, 59 respectively for selecting read-size, enlarged or reduced copying; display devices 60–62 respectively for indicating the selected image magnification in reduced copying mode, the enlarged copying mode or the real-size copying mode wherein said enlarged copying mode is adapted to conver an A-series size into a corresponding B-series size while the reduced copying has five different modes by the combination of an image reduction rate of 0.67 or 0.79 and related sheet sizes; a display device 72 for indicating the upper or lower cassette case selected by the cassette selecting keys; and display devices 56 for indicating the species of the cassette mounted in the selected cassette case, which are intermittently lighted when a reduced copy key 59 is actuated not matching the sheet size of a cassette selected. There are further shown:

alarm display devices 63–67 for indicating suitable picture patterns in response to alarm signals from the copier, wherein a sheet jam alarm 63 is lighted in case of sheet jamming in the copier, a sheet/cassette alarm 64 is lighted in the absence of a cassette in the selected cassette case or in the absence of copy sheets in the cassette mounted in said selected cassette case, a recovered toner alarm 65 is lighted in case the recovered toner container 43 is full with the used and recovered toner, a developer alarm 66 is lighted when the developer in the developing station becomes less than a determined quantity, and a key counter alarm 67 is lighted in case a key counter 37, 38 is not inserted into the copier;

a wait indicator 70 which is lighted while the temperature of the fixing heater is lower than a determined value after the start of power supply and is extinguished when the waiting process is completed upon arrival of said temperature at said determined value;

a copy number indicator 68 capable of displaying numbers from 1 to 99 in 7-segment display, which indicates the copy number set by the numeral keys 53 or the copy count during the copying operation, and is automatically returned to a display "01" after the lapse of 60 seconds from the completion of a copying operation, or upon actuation of the clear key 71 or the interruption key 51; and an interruption copy indicator 69 which is lighted upon actuation of the interruption copy key 51 and is extinguished upon completion of the interruption copy mode.

Figures 1, 1A, 1B, 1C, 3:
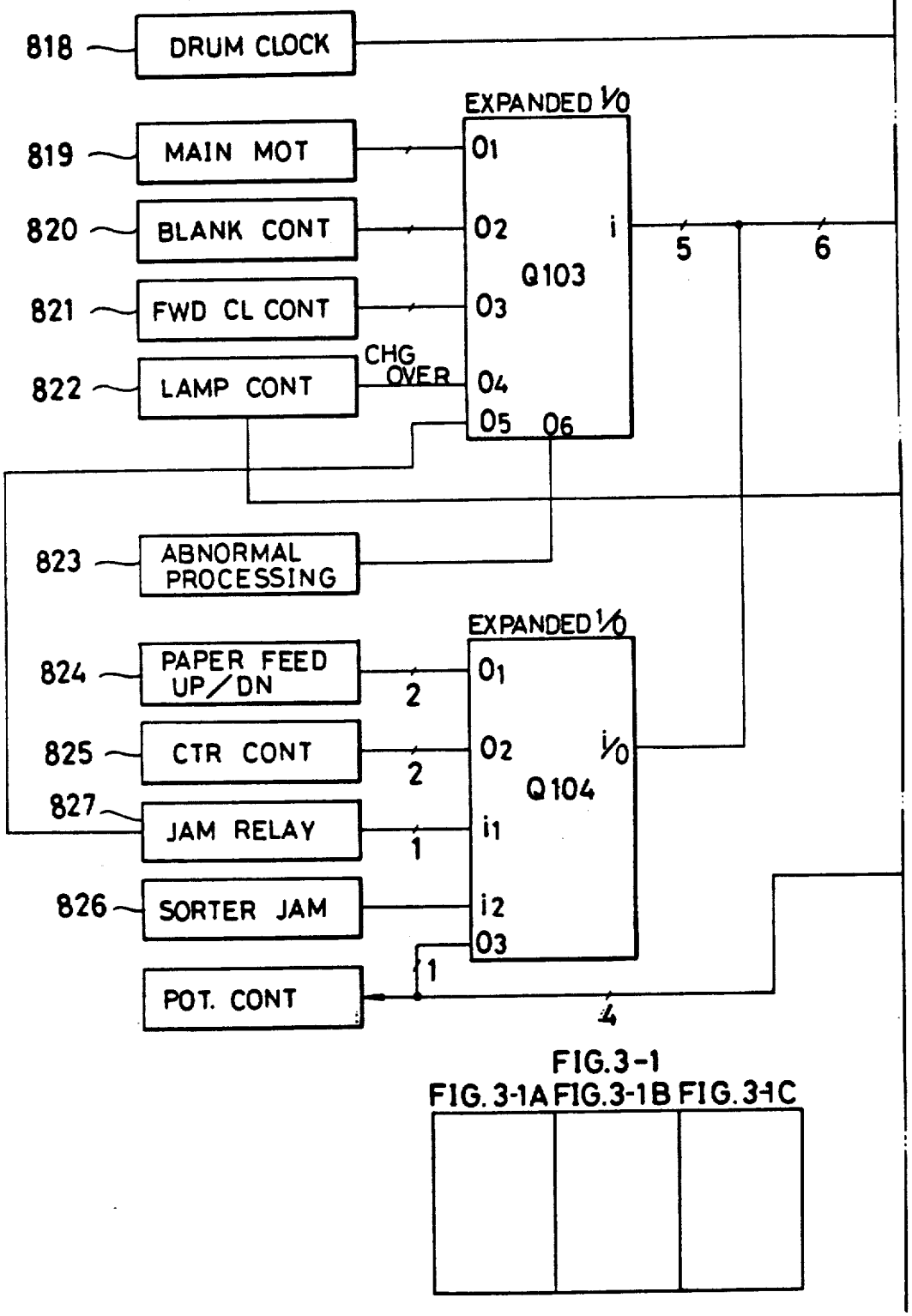
Figures 1B, 3:
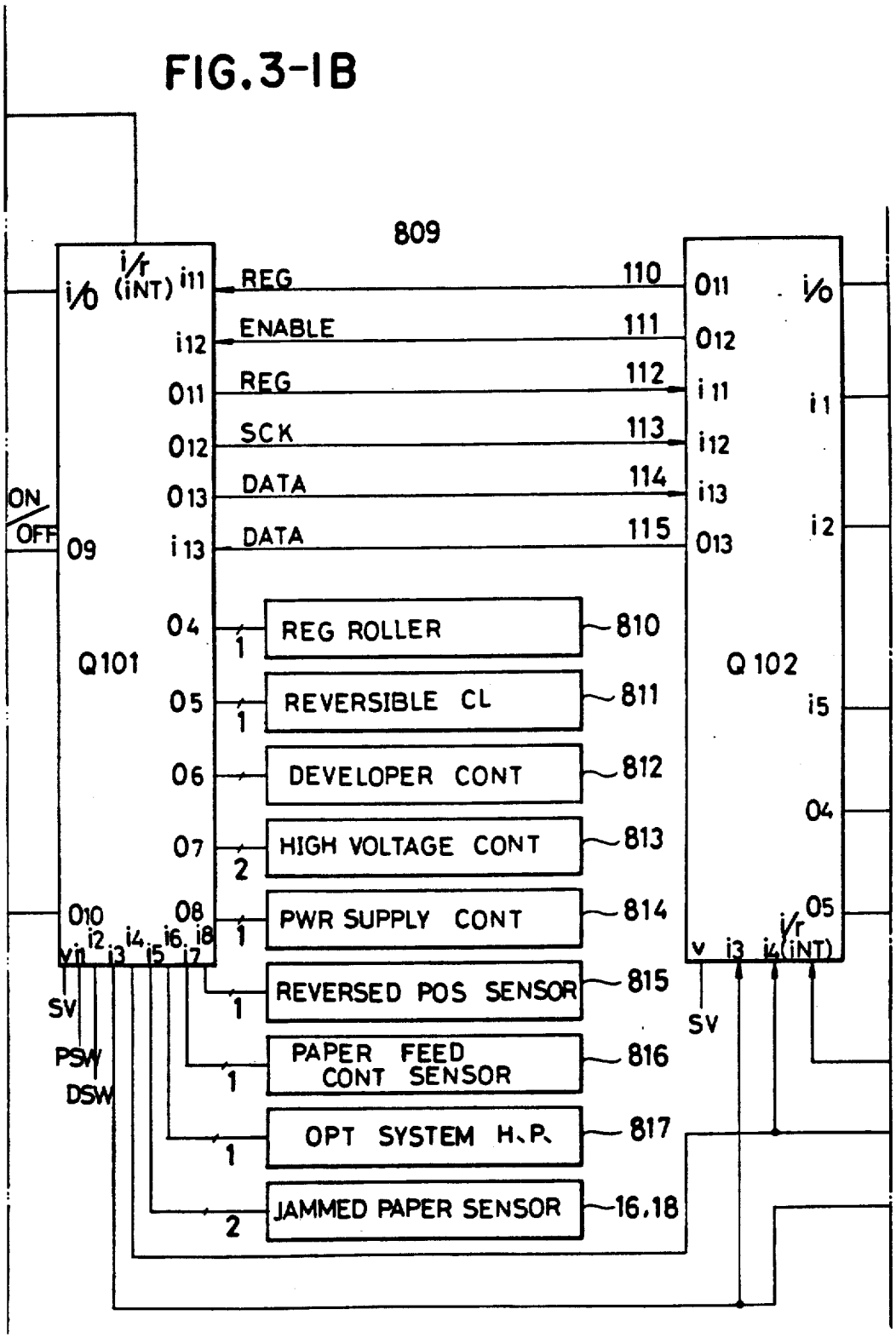
Figures 1C, 3:
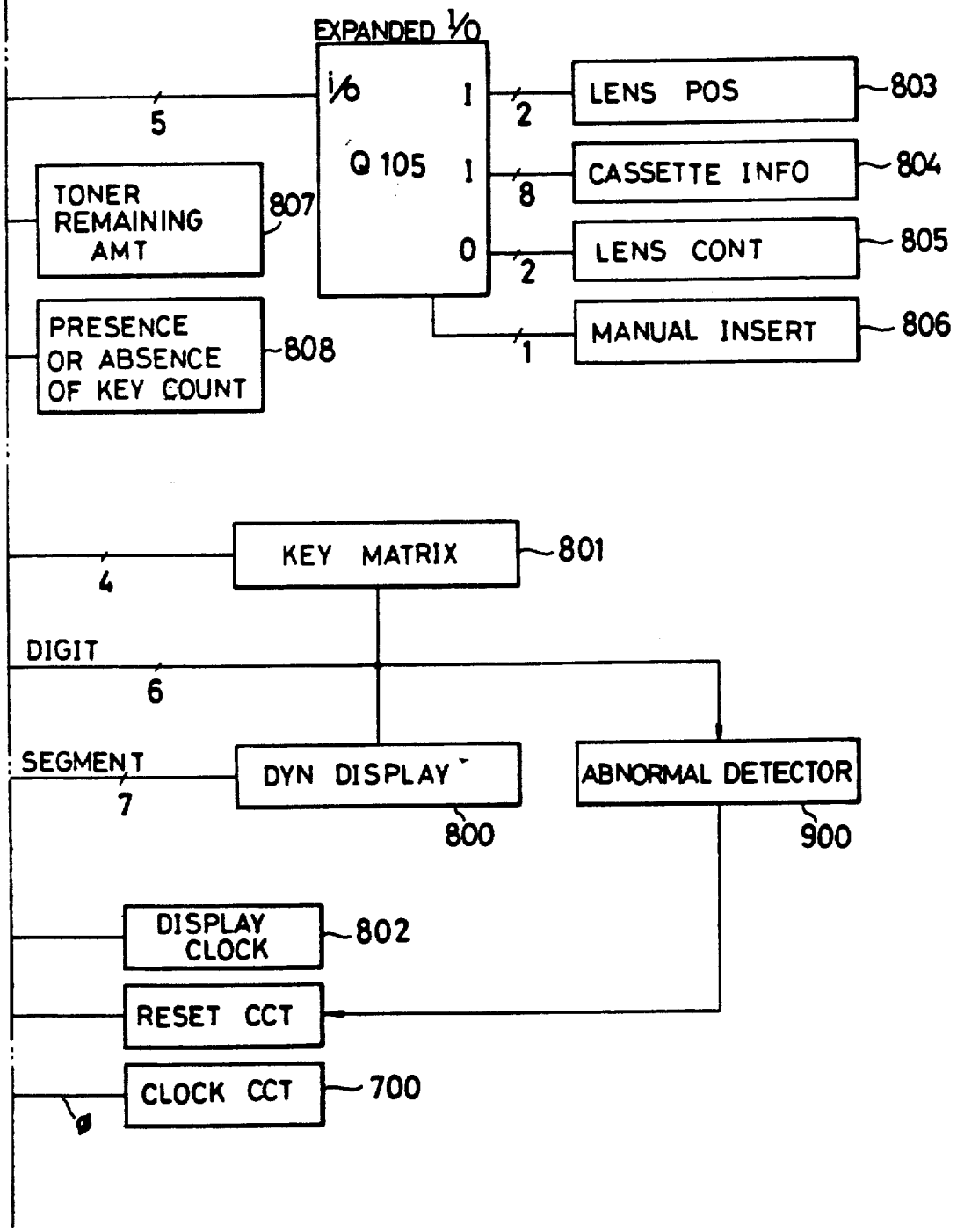
Figures 2, 3:
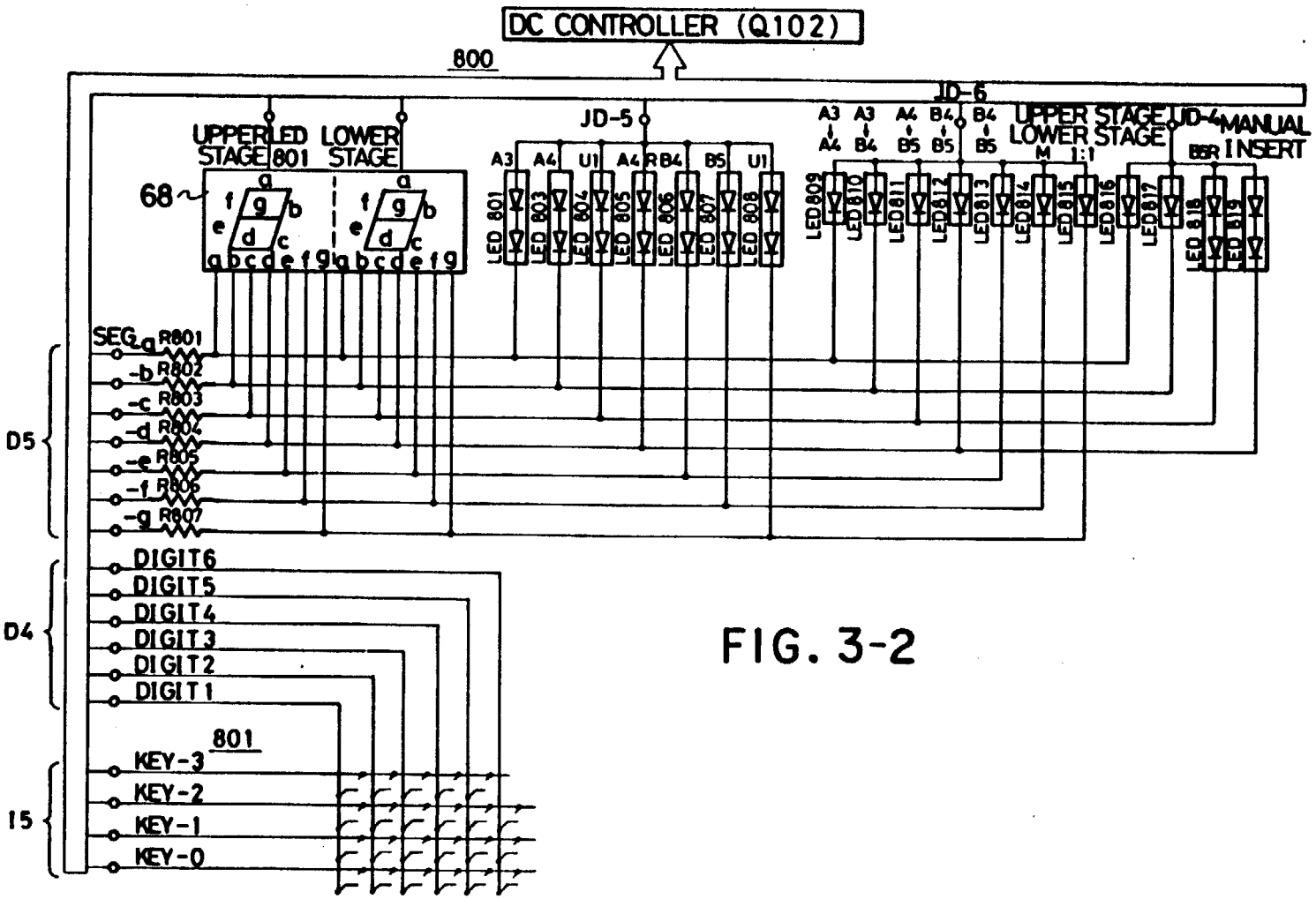
Figures 3, 3B:
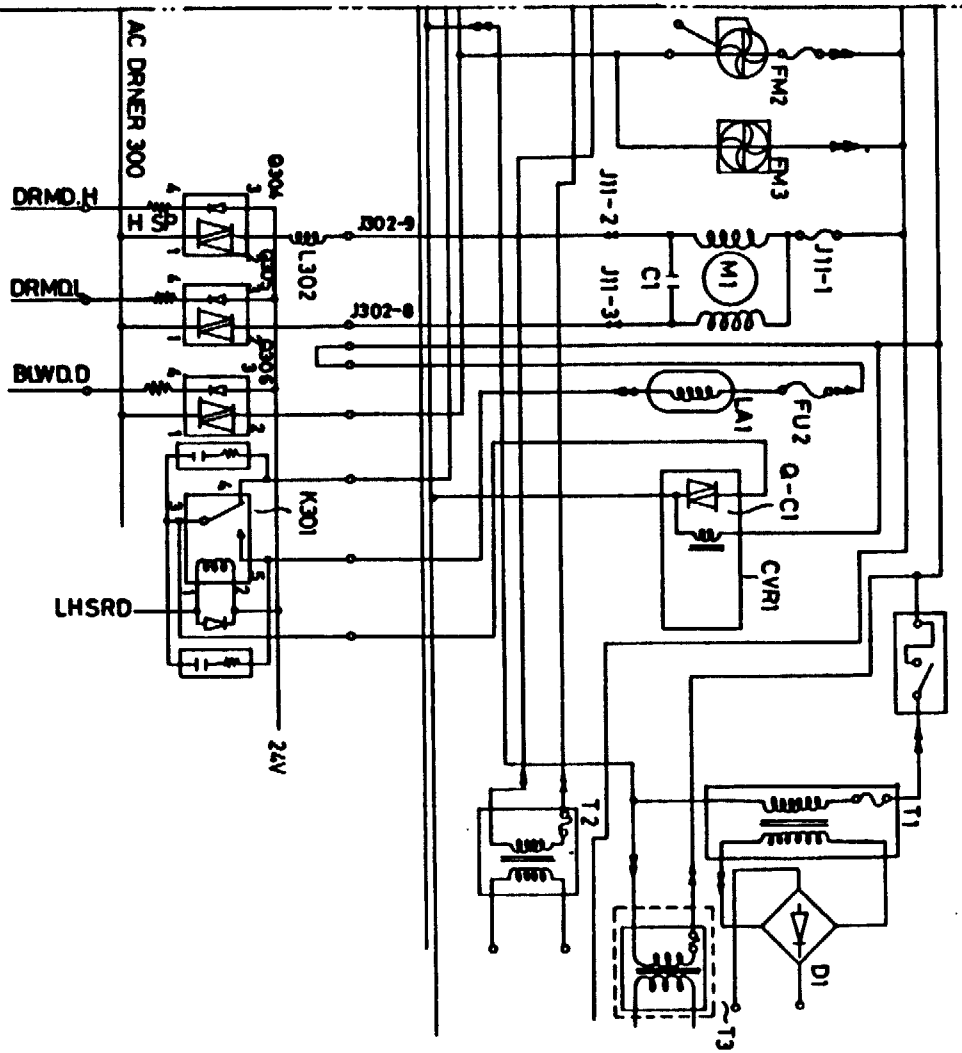

FIG. 3-1 is diagram showing the control circuit of the copier shown in FIG. 1, wherein provided are a microcomputer Q102 (hereinafter called the control microcomputer) for controlling the input signals from the various keys shown in FIG. 2, display functions of the display devices 56, 60–62, 68, 69 and 72, and for instructing the start of copying operation; and a microcomputer Q101 (hereinafter called the sequence microcomputer) for controlling the main motor, high-voltage transformer etc. for the execution of the copying operation. Said control microcomputer Q102 is a one-chip microcomputer provided with a read-only memory for storing the programs shown in the flow charts of FIGS. 6-1 to 6-4; a random access memory for storing the process timing data in the sequence control, copy number selected by the keys 53, copy count number, image magnification selected by the keys 57–59, copy count number in case of the interruption copy mode, data of the selected cassette diverted in case of the interruption copy etc.; input, output and input/output ports for signal input and output; and a central processing unit for executing the programs stored in said read-only memory according to the clock pulses 0 from a clock generator 700. Q101 is a one-chip microcomputer similar to Q102 and has a read-only memory storing the programs shown in the flow charts of FIGS. 7-1 to 7-6. Such microcomputers can be composed for example of the commercially available element μCOM43N manufactured by Nippon Electric Co. There are also shown port chips Q103–Q105 for expanding 5 input/output ports of said microcomputers into 13 ports and composed for example of μPD8243; display circuits 800 corresponding to those in the control panel and connected to ports 04 and 05 of the control microcomputer; a key matrix 81 corresponding to the input circuits of the aforementioned keys and connected to a port i5 of said computer; a clock pulse generator 802 connected to a program interruption port of the microcomputer Q102 for generating probe signals for scanning said key matrix 801 and said display circuits 800, wherein said clock pulses are repeatedly released from a port 04 after frequency division; and two switches 803 (corresponding to 201 and 202 in FIG. 13) for providing signals in combinations for the real-size copying corresponding to a lens position 30-1 in FIG. 1, for the enlarged copying corresponding to a lens position 30-2, for the reduced copying with a magnification 0.79 corresponding to a lens position 30–3, or for the reduced copying with a magnification 0.67 corresponding to a lens position 30-4. Eight switches 804 divided into a group of four for each cassette are actuated by the cams provided on said cassette to detect the size of the upper and lower cassette 13, 14, wherein three switches in each group of four indicate by on-off combinations eight sizes displayed by the display unit 56. A switch 806, corresponding to a switch 41 in FIG. 1, is actuated when a copy sheet is manually inserted along the cover of the upper cassette 13 to cause a roller 11 to engage with said sheet to conduct a single-sheet copying operation according to a manual-insert sequence shown in FIG. 4-2. A switch 807 detects the absence of toner in the developing station 7. A switch 807 detects the absence or defective contact of the key counter and drives the aforementioned display through a circuit shown in FIG. 17. A lens motor circuit 805 for setting the lens system at one of the aforementioned positions is controlled in response to the actuation of keys 59 and detecting switch 803.

Figures 1B, 4:
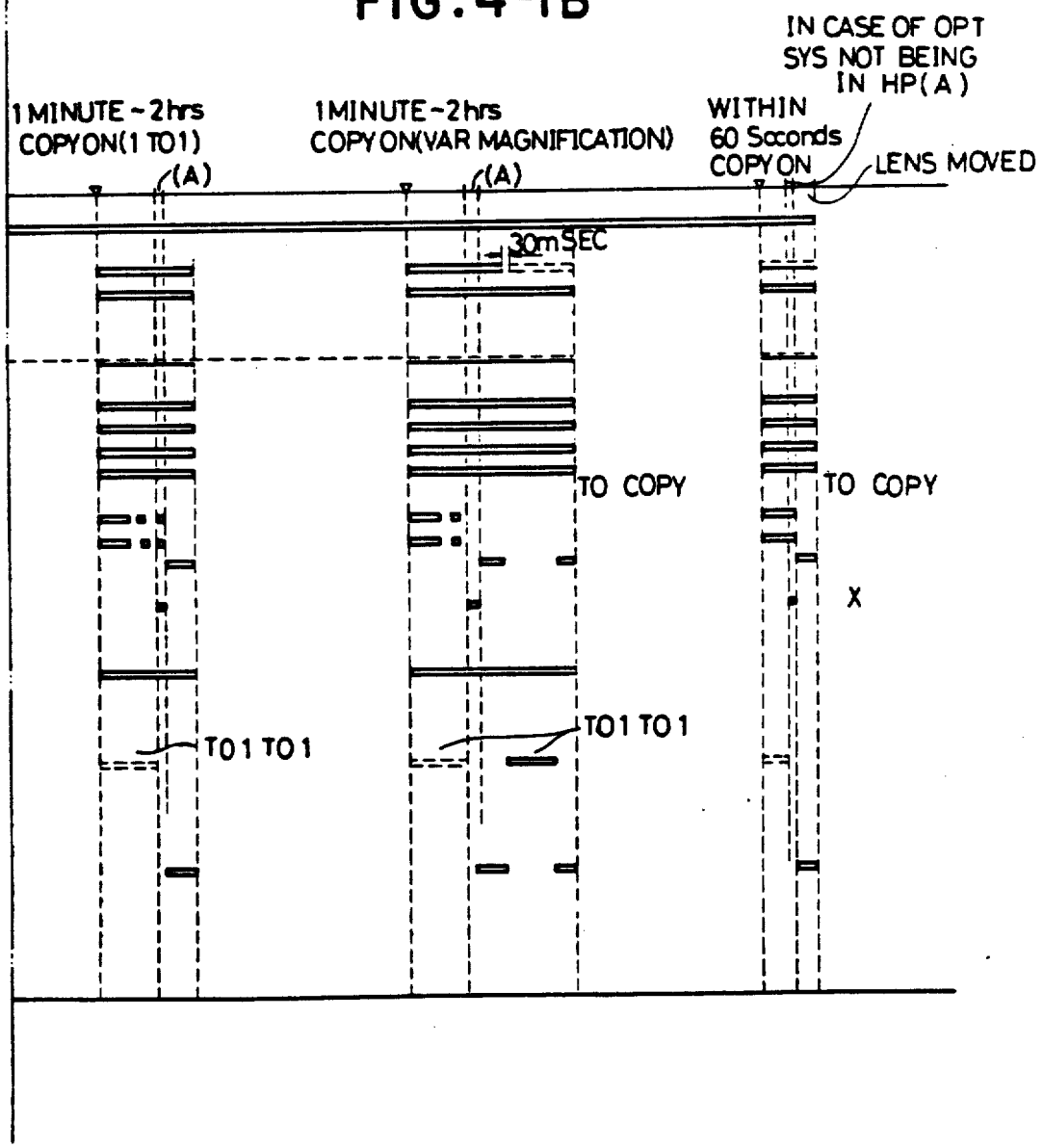
Figures 2B, 4:
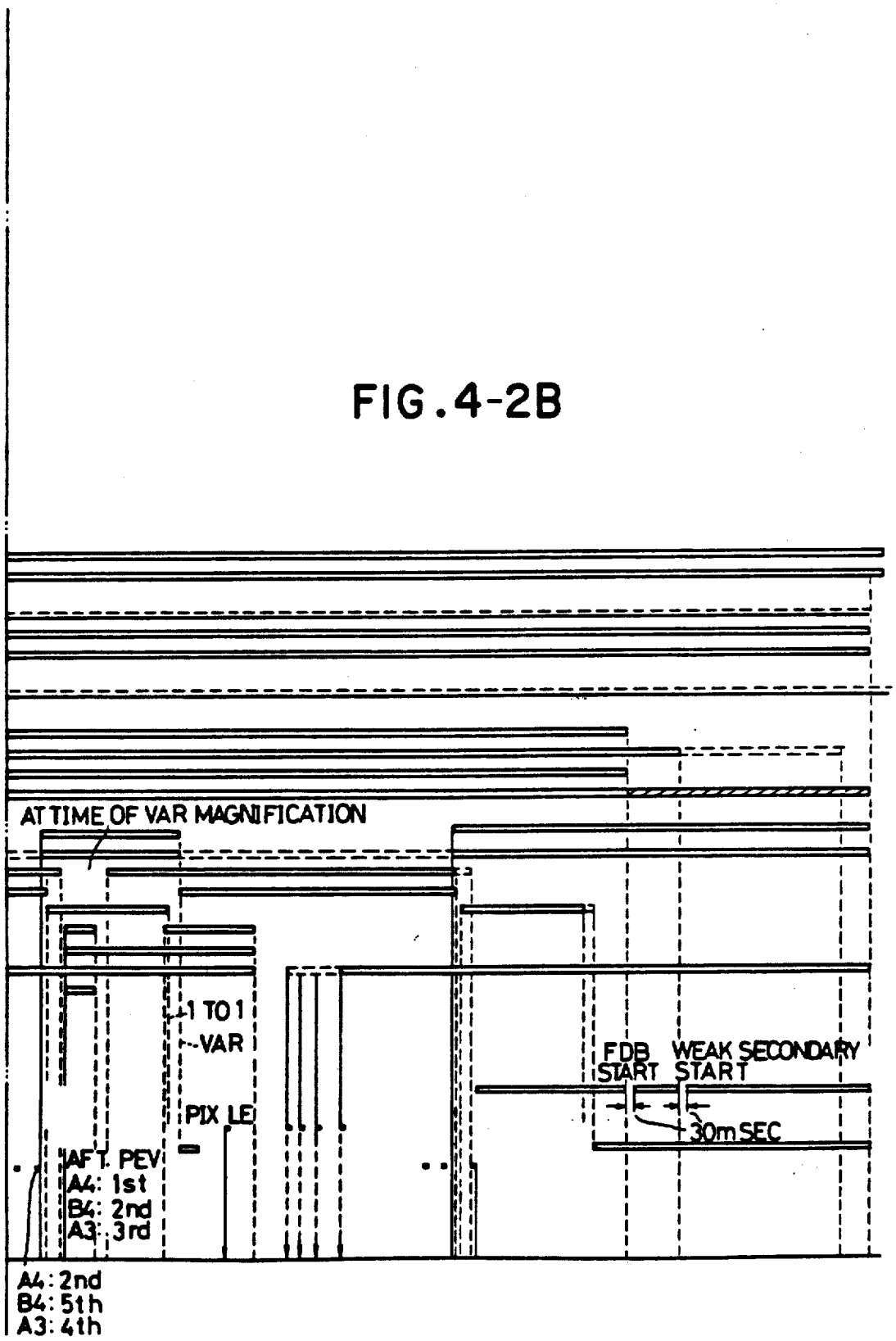

Furthermore there are shown signal lines 809 for data transfer between the microcomputers Q101 and Q102 wherein arrows indicate the direction of data demand signal or data transfer; a clutch circuit 810 for energizing the registering roller; a clutch circuit 811 for reversing the mirror system after the completion of exposure step; a drive circuit 812 for a developing motor; a control circuit 814 for controlling high-voltage transformers for primary charger etc.; a switch 815 provided in the mirror reversing position for causing said mirror reversing; a switch 816 for generating timing signals for registration; a home position switch 817 to be closed when the mirror system is in the home position; a drum clock pulse generator 818 composed of a photointerrupter for generating pulse signals in cooperation with a disk rotated coaxially with the main motor; a main motor circuit 819 for rotating the drum to which connected are the clutches mentioned above and below; a circuit 820 for the lamp 10 which is lighted in approximately opposite relationship with the exposure lamp 32 as shown in FIG. 4-2; a clutch 821 for displacing the mirror system for scanning exposure; a circuit 822 for the exposure lamp 23; a circuit 823 for turning off the fixing heater upon detection of an abnormality in the copier; a clutch 824 for activating the feed roller 11 or 12; a circuit 825 for the increment of the key counter; a jam detection circuit 826 for the sorter 46 capable of releasing a jam signal in case a switch 47 provided at the entract of said sorter is actuated by a sheet longer than a determined period, whereby the microcomputer Q101 gives a display on the display unit 68 in response to said signal; and a mechanical latch relay 827 to be set in case of a sheet jamming in the sorter. The sequence computer Q101 inspects the state of said relay through the port i4 of Q104. The prohibition of copying operation is terminated when said relay is deactivated, whereby the display unit 68 is reset from the display of sheet loss in the jamming and displays a number corresponding to the previous copy count number minus the sheet loss in the jamming.

Said display unit 68 displays a number "01" in the beginning, then a number entered by the numeral keys, then a number successively decreased upon each sheet feeding during the copying operation, and again displays the entered number at the reversing of the scanning system for faciliating to repeat a copying operation of the same copy number. Said number is however reset to "01" after the lapse of 60 seconds.

Upon detection by the microcomputer Q102 of an abnormality such as a failure in the forward-backward clutch represented by the absence of the mirrors at a determined position at a determined timing, a failure in the drum clock pulse generator 818 giving a longer pulse interval than the normal interval, a broken thermistor for temperature control of the fixing heater etc., said display unit 68 gives an error display such as "E1", ..., "E3" specifying the failure. The display returns to the previous number when the failed part is repaired.

Also an error display "E0" is given in case a standby signal is not obtained from the sorter 46, and is reset in a similar manner as explained above.

In case of a sheet jamming, the corresponding signal is transferred from sheet jam sensor 16 or 18 through the port i5 of Q101 and the data line 809 to the microcomputer Q102, which identifies the number of sheet loss as 1 and 2 respectively and displays "P1" or "P2" on the display unit 68. Similarly a display "P0" is given in case of sheet jamming in the sorter. Also a display "P3" is given in case of document jamming in an automatic document feeder if such device is provided.

In the present embodiment the reduced or enlarged copying can be conducted regardless of the selected cassette size, but such copying is not completely independent from the function of the size detector 804, and an appropriate size is displayed by intermittent lighting only in case a reduced or real-size copying is selected and only if an inappropriate size is selected. At the same time there is given a display indicating the sheet size in use, and these displays significantly facilitate the judgement of the operator. Such display of the appropriate size is not given in case of enlarged copying since the scanning stroke is always selected corresponding to the B4 size in consideration of the possibility of partial enlarged copying, but such display is still possible if desired.

It is to be noted that, in the present embodiment, the scanning stroke for the enlarged copying is selected not corresponding to the largest A3 cassette size but to the second largest B4 cassette size, but it is also possible, in case of a higher image magnification, to select a stroke corresponding to the third largest A4 cassette size, or, more generally, to the n-th largest cassette size. Furthermore, in case there are provided plural enlarged copying modes, it is possible to select the scanning strokes corresponding for example to the n-th and (n+1)th largest cassette sizes. In this manner the scanning stroke is so selected that the resulting image never overflows from the largest A3 size, whereby it is rendered possible to minimize the waste in the scanning stroke and thus to increase the speed of repetitive copying operation.

Now reference is made to FIG. 3-2 showing the display circuit 800 which is collectively connected to a DC controller board having the microcomputer Q102 shown in FIG. 3-1, so that the terminals for key scanning probe signals Digit 1-6, key scanning output signals KEY1-3, dynamic display digit signals JD-1, 2, 4, 5, 6 and dynamic display segment signals SEG-a-g are all connected to said microcomputer Q102.

Light-emitting diodes LED801 constituting 7-segment numeral display unit of 2 digits correspond to the display unit 68 shown in FIG. 2, and light-emitting diodes LED802-808, 818 and 819 correspond to the cassette size display unit 56 shown in FIG. 2. Also light-emitting diodes LED809-813, 814 and 815 respectively correspond to the displays 60, 61 and 62 for reduced, enlarged and real-size copying shown in FIG. 2 (M and 1:1 in FIG. 3-2 representing enlarged and real-size copying), and light-emitting diodes LED816 and 817 respectively correspond to the display 72 for the upper or lower cassette case selection. The above-mentioned diodes LED801-819 receive pulses of +24 V in turn as the digit signals JD-1 to JD-6 in the illustrated combinations and are selectively connected to 0 V line as the segment signals SEG-a to SEG-g also in the illustrated combinations to perform dynamic display.

Now there will be given an explanation on the function of the control circuit while making reference to the timing charts shown in FIGS. 4-1 and 4-2 and to the flow charts shown in FIGS. 7-1 to 7-6.

Figures 1, 1A, 1B, 1C, 7:
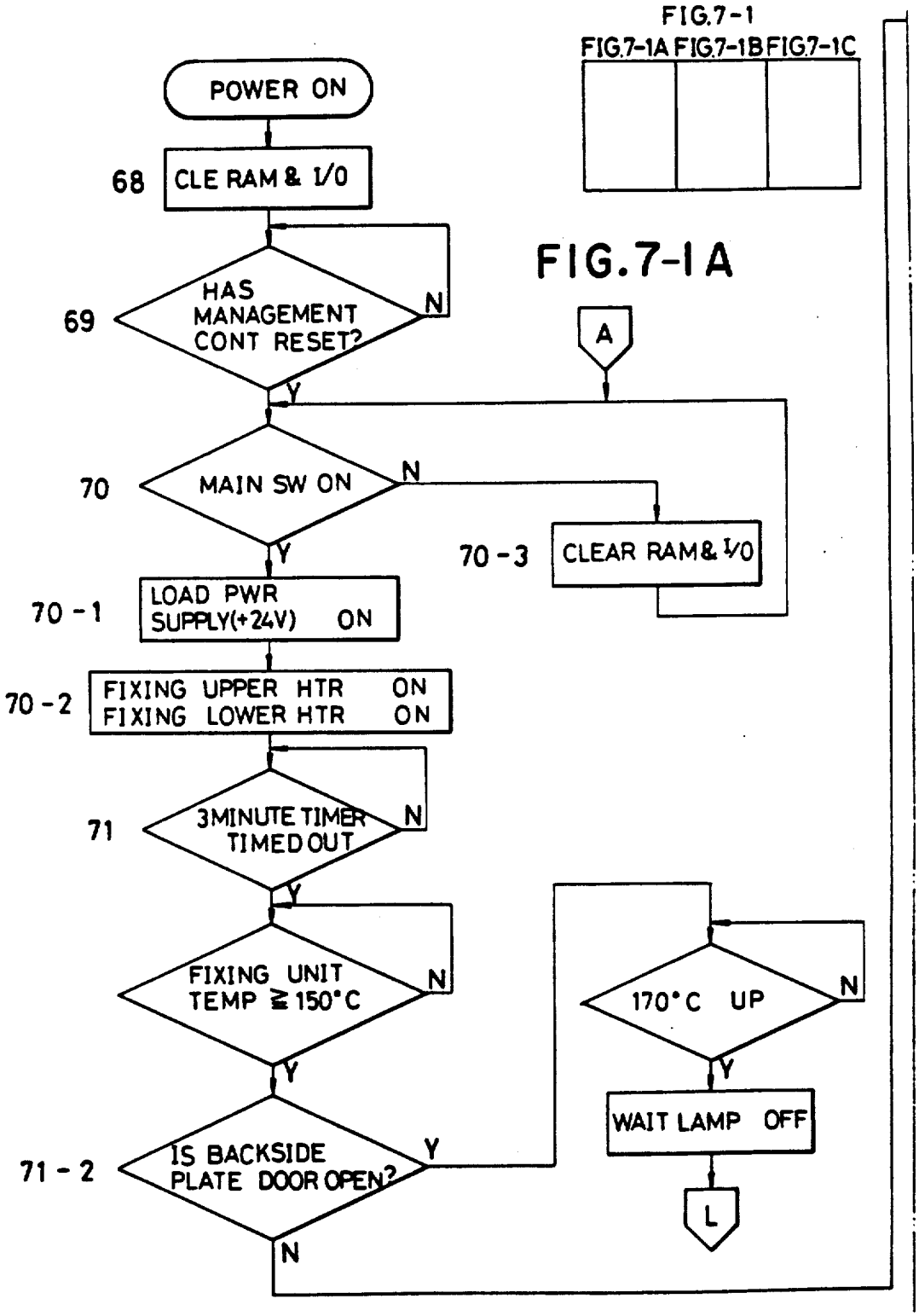
Figures 2, 2A, 2B, 7:
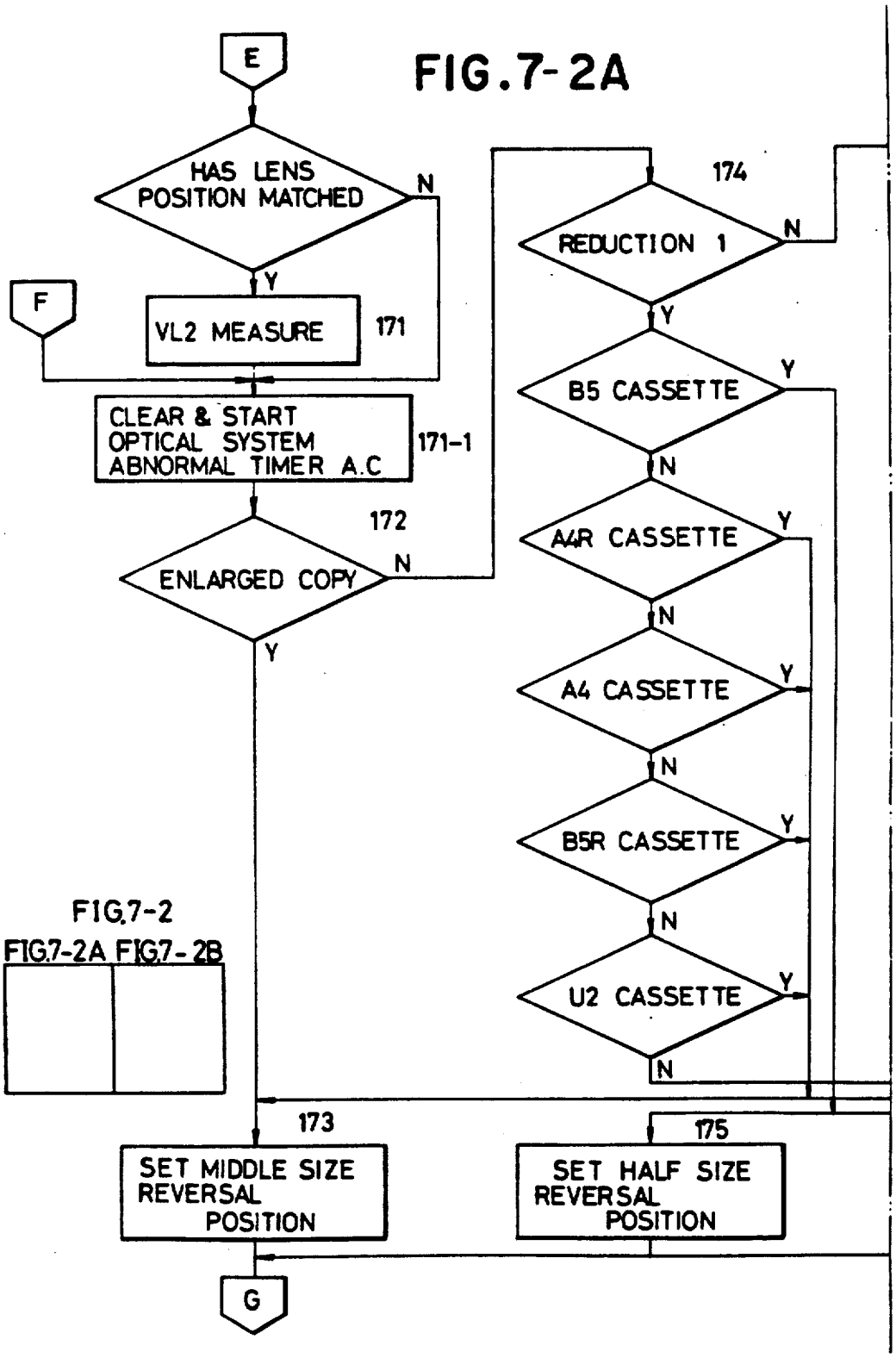
Figures 2B, 7:
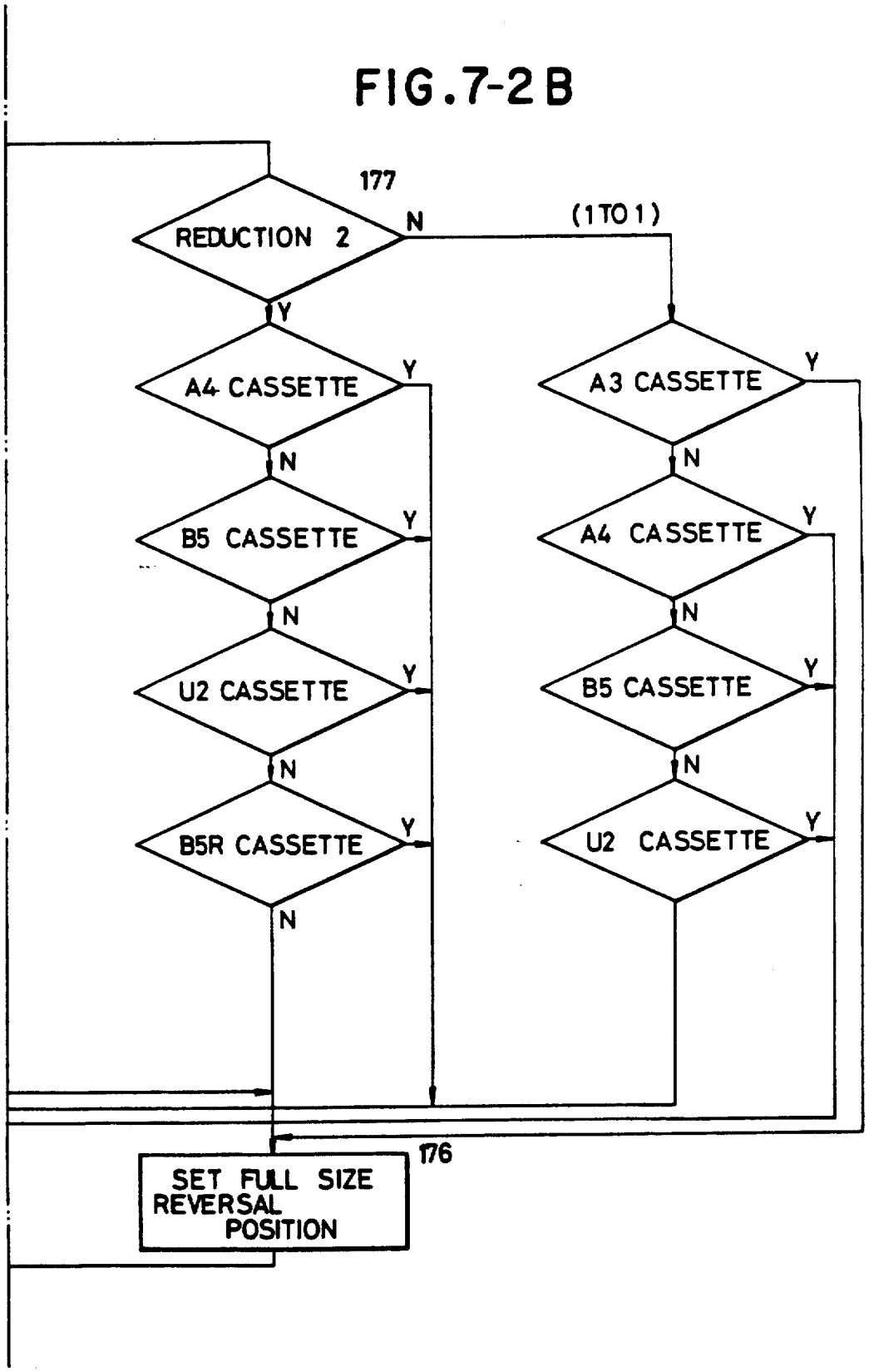
Figures 3B, 7:
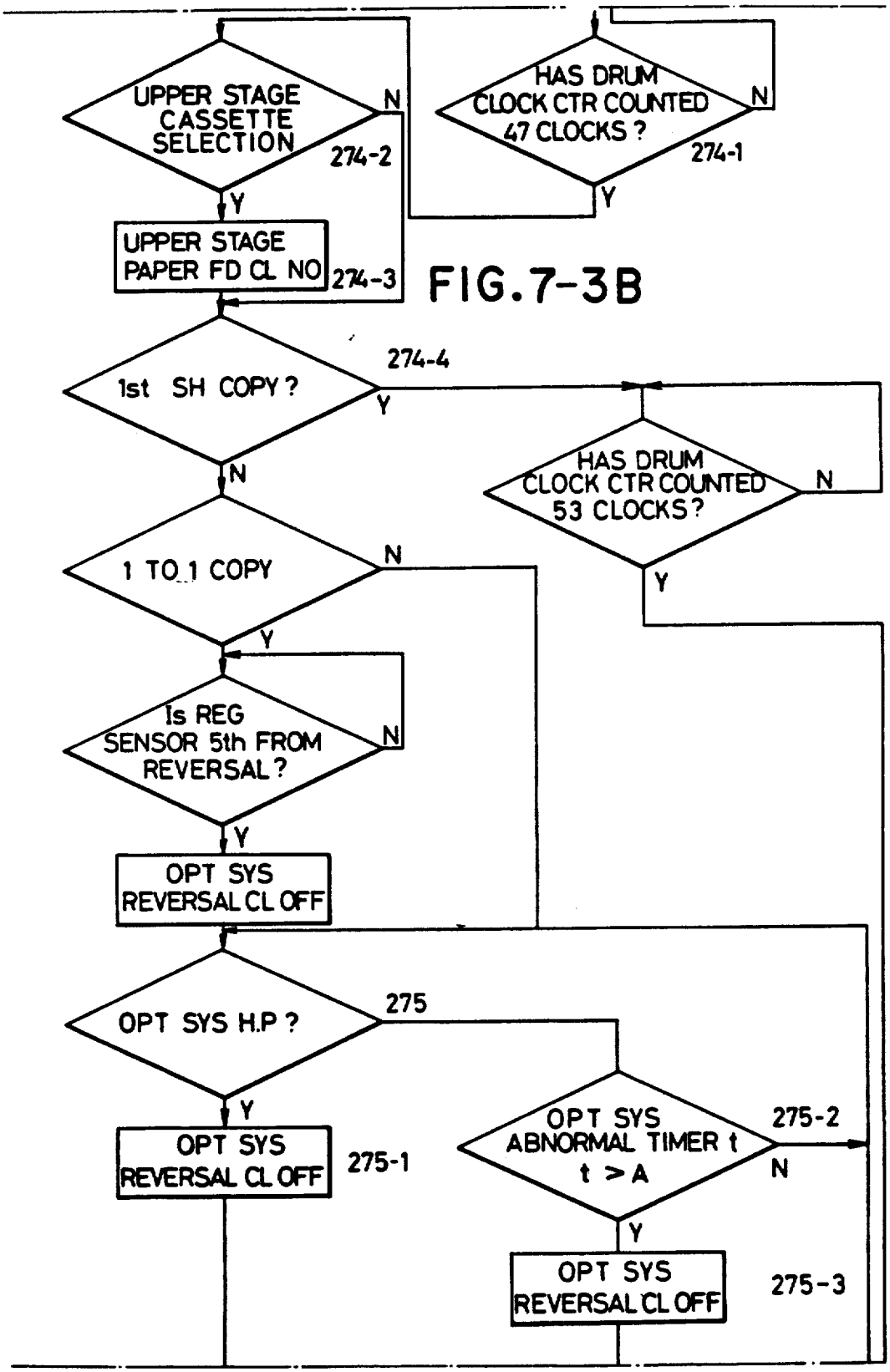
Figures 3C, 7:
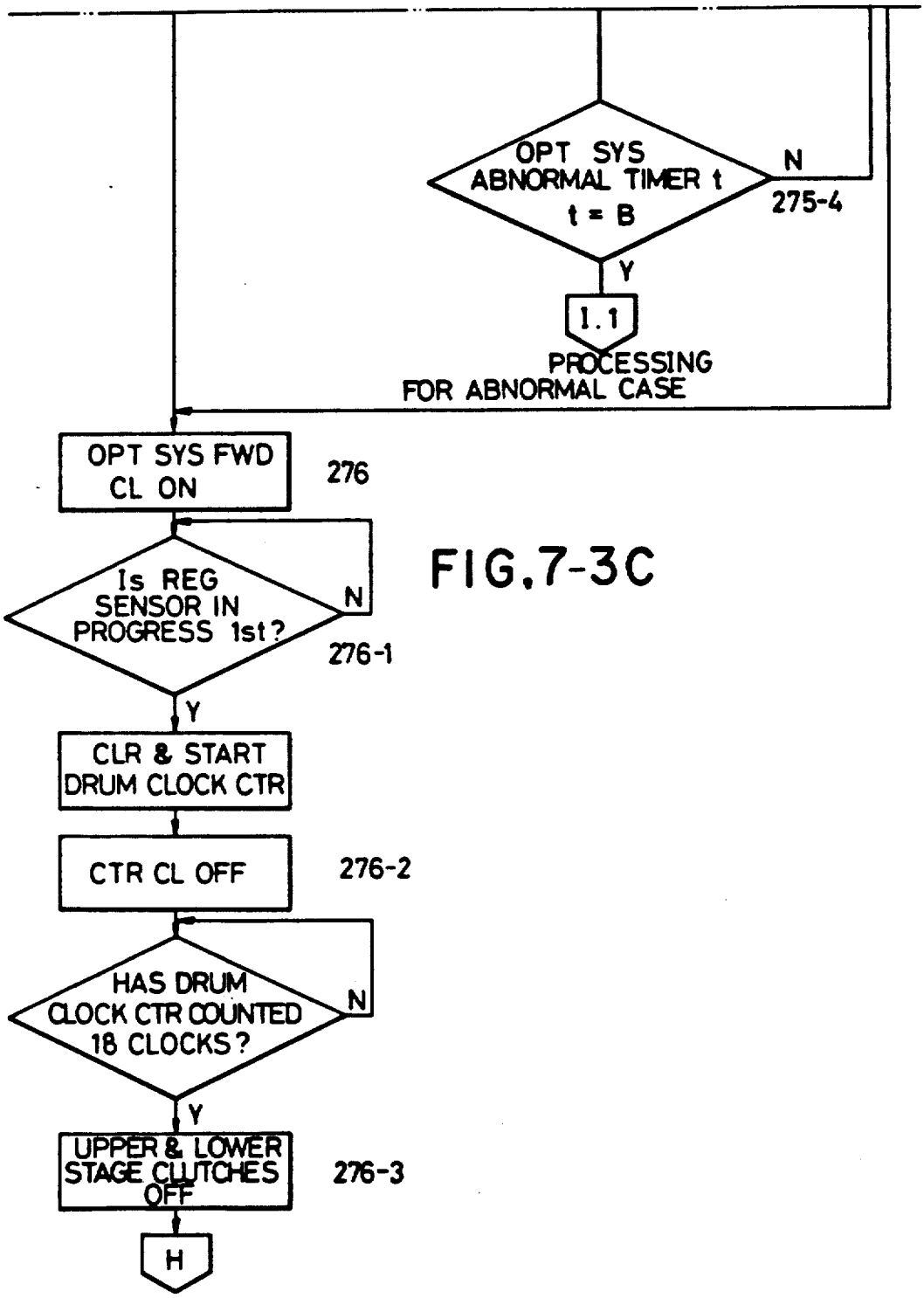
Figures 4A, 7:
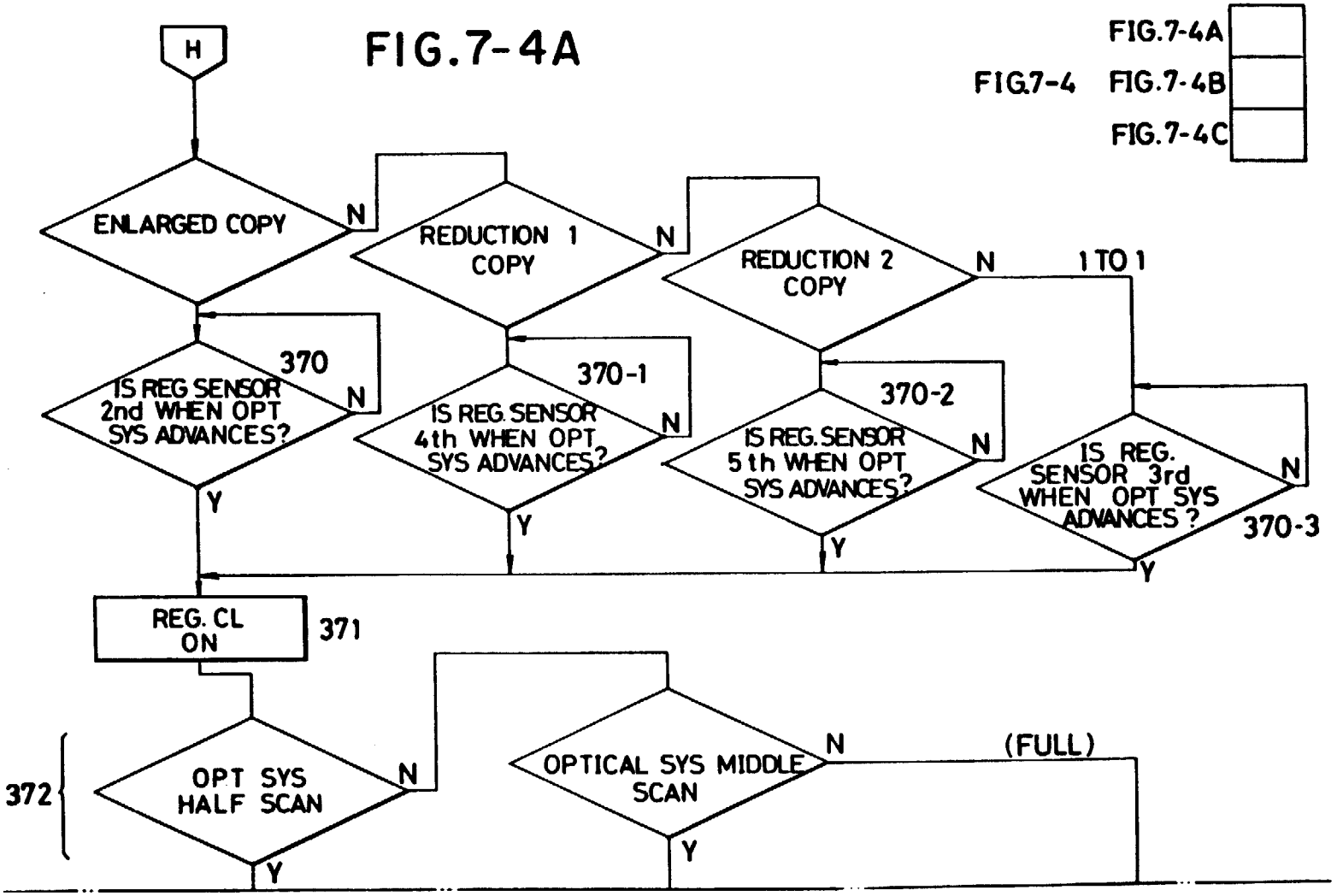
Figures 4B, 7:
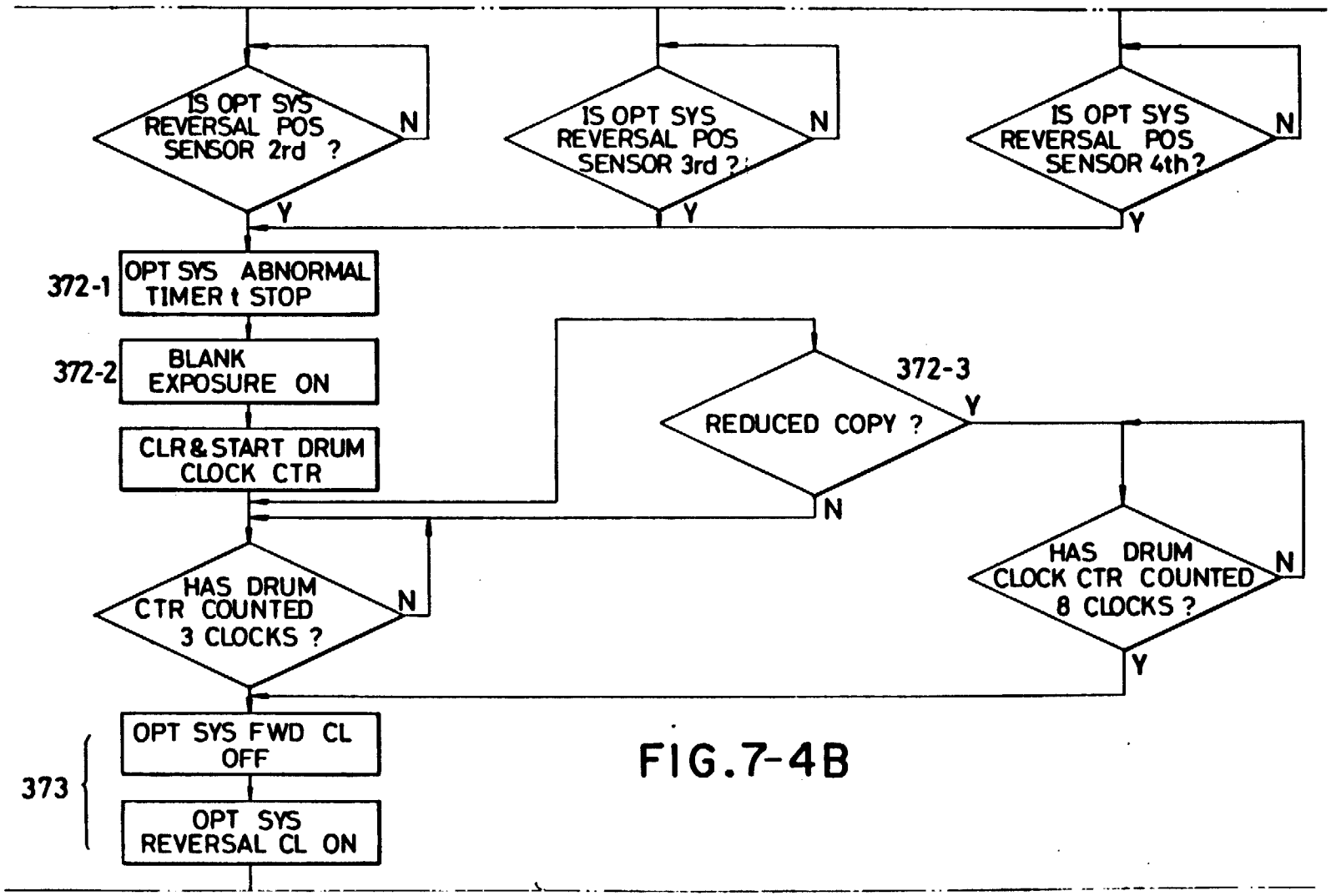
Figures 4, 7:
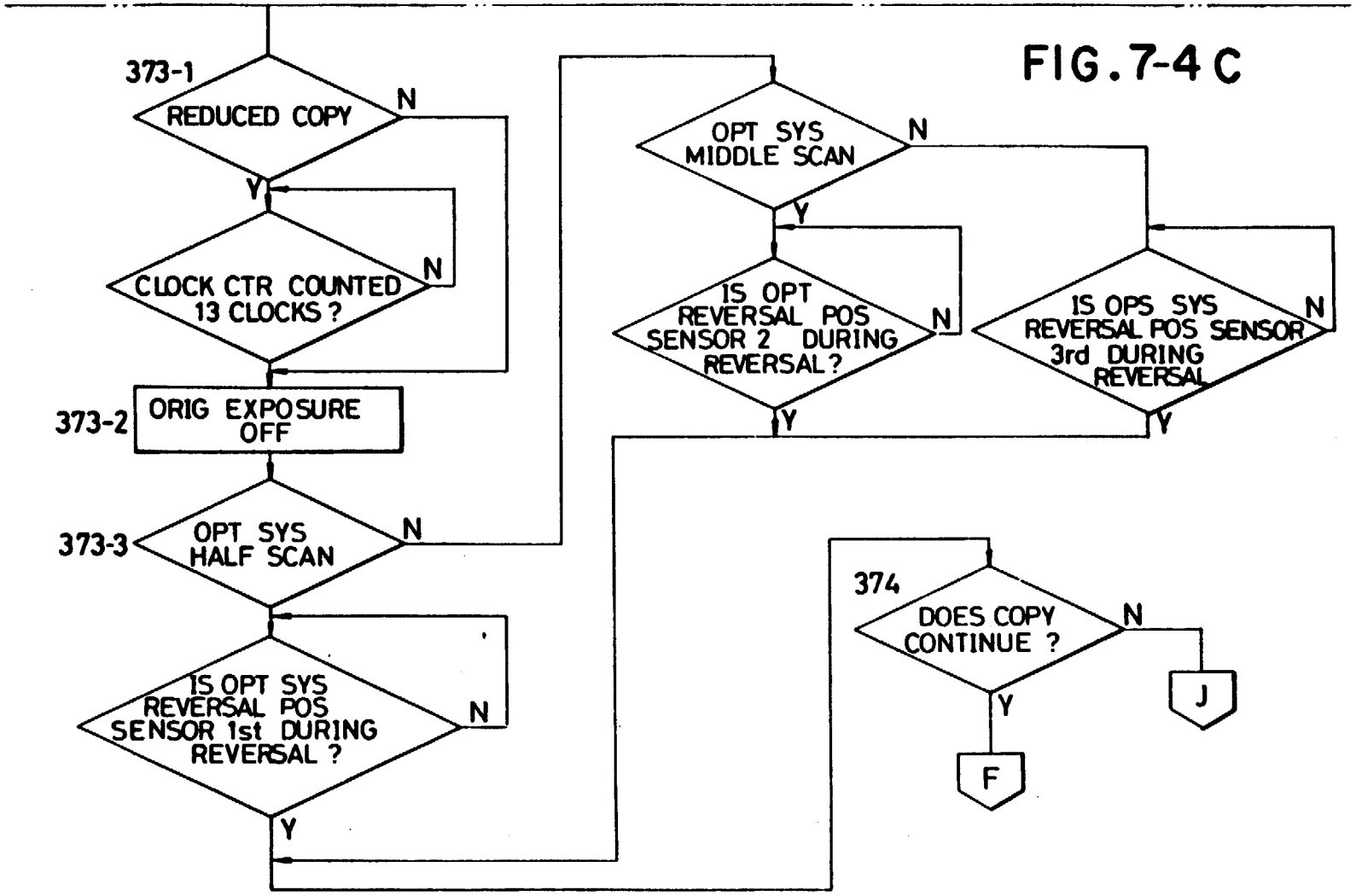

Upon turning on of the power switch 501 and a subswitch SW1 and prior to the copying cycle, there are executed steps of elevating the temperature of the fixing roller 19 while maintaining the main motor, i.e. the drum 1 and said fixing roller 19, inactive (steps 70 and 71 in the power-on flow shown in FIGS. 4-1 and 7-1). These steps are for effectively heating the fixing roller as the toner is firmly attached to said roller until a certain temperature and may damage said roller.

Then, when the fixing roller 19 exceeds a first determined temperature (150° C.), there are executed steps 72 and 73 in which the main motor is started at a low speed and the flush exposure lamp 9, pre-exposure lamp 8 and blank-exposure lamp 10 are lighted to illuminate the drum 1 until the fixing roller 19 reaches a second determined temperature (170° C.) while a high voltage is supplied to the secondary hanger 4 during one full rotation of the drum 1. These steps are conducted in order to obtain uniform temperature distribution on the fixing roller 19 as it is no longer damaged by the toner already melted at this stage, to eliminate the retentive charge on the drum 1 by said secondary charger 4, to reduce the optical hysteresis by the irradiation by said lamps and to clean the drum surface by the cleaner 6. In FIGS. 4-1 and 4-2, the high-speed state and low-speed state of the main motor are respectively represented by solid line and broken line. During this waiting flow a step 71-2 is executed to detect whether the rear door of the copier is open, and, if so, the waiting lamp is turned off at said second temperature 170° C. to await the entry of a copy start signal, thus enabling the copying operation without the additional drum rotation for the drum potential stabilization.

A heater 32 for the lower fixing roller is also powered to accelerate the heating until said second determined temperature is reached.

Upon arrival of the fixing roller at the second determined temperature, there are executed prerotation steps 74 and 75 in which the main motor 21 is rotated at the high speed for one full rotation and the pre-charge eliminator 2, primary charger 3, secondary charger 4 and transfer charger 5 are supplied with high voltages suitable for such high-speed rotation, thus applying high voltages on the entire surface of the drum 1. At the changeover of the drum speed, the high-speed drive signal is supplied from the microcomputer Q101 30 msec. after the low-speed drive signal is turned off in order to avoid the shock at the speed changeover.

At the same time there is executed a step 76 for initiating the movement of the lens 30 to the position 30-1 for real-size copying unless it is already in said position.

Upon completion of one full rotation of the drum 1, there is executed a step 77 in which the drum surface potential VSL with the blank exposure lamp on, and the drum surface potential VD with said lamp off, are measured in succession by a potential sensor 44. Said step 77 is repeated several times to regulate the current in the primary charger 3 and the secondary charger 4 according to the measured values of VSL and VD so as to approach to the predetermined values.

Then, in case it is identified in a step 77-1 that the lens 30 is in the position 30-1 in FIG. 1 for the real-size copying, the optical system 24, 25 is brought to the home position in a step 77-2 unless it is already in said position, and a standard white board 35 representing the white background of the original is illuminated by the original illuminating lamp 23 for measuring the potential VL on the drum 1 by the potential sensor 44. Said VL measurement is repeated several times to regulate the voltage supplied to the lamp 23 in such a manner that an optimum image density is obtained at a scale "5" of the slide-lever 54 for density control, and, after said regulation, the developing bias of the developing station 7 is adjusted according to the last measured value of VL.

The aforementioned potential control by the measurements of VSL, VD and VL is intended to achieve optimum image formation through the control of the charge on the drum 1, light intensity of the exposure lamp 23 and developing bias. Upon completion of the control mentioned above in a step 78, the waiting cycle is completed and the copying operation is made possible.

After the above-explained drum rotation for control or after the drum rotation for copying cycle there are executed post-rotation steps in which the drum 1 is rotated for removal of retentive charge and hysteresis by the secondary charger 4 and drum surface cleaning. Said steps 570 and 571, shown in FIG. 7-5, consist of ca. 1/5 turn of the drum with the secondary charger 4 on, then ca. ½ turn of the drum with said secondary charger 4 activated with a lower voltage, and drum rotation with light irradiation alone until the copy sheet is ejected.

Said post-rotation steps are conducted to electrostatically and physically clean the drum. After said steps the drum is stopped, and the heater 32 for the lower fixing roller is again powered under the control of the thermistor 34 to maintain the fixing rollers at a third determined temperature.

In case of the lapse of two hours without any operation, the main switch 2 is automatically turned off in a step 572 by an automatic shut-off circuit.

The data entered by keys prior to said automatic shut-off are set by the control microcomputer.

On the other hand, in case the copy start key is actuated in a step 573 and the related data are transferred from the microcomputer Q102 to the sequence microcomputer Q101, the pre-process in a step 574 before entering the copying cycle varies according to the rest time of the drum 1 and the selected image magnification in the following manner:

(1) In case of rest time shorter than 60 seconds:
In the reduced or enlarged copying mode, the developing bias is controlled by the VL measurement; In the real-size copying mode, no potential control is conducted:

(2) In case of rest time equal to or longer than 60 seconds:
The measurements of VSL, VD and VL are conducted for obtaining optical image forming conditions. Upon completion of the above-mentioned pre-process, the copying cycle is initiated according to the flows B and C shown in FIG. 7-1.

In this manner, in case of a drum rest time between 60 seconds and 2 hours, the drum is at first rotated at the high speed and then switched to the low speed even in the reduced or enlarged copying mode, thereby completing the aforementioned preparatory steps within a short time.

In response to the copy start instruction from the control microcomputer Q102, the sequence microcomputer Q101 sets the drum at the high speed in case of the real-size copying mode through steps 78 and 79 in case of mode B or through a step 79 in case of mode C, and sets the drum at the low speed with a delay of 30 msec. in a step 80 in case of the reduced or enlarged copying mode. Then in a step 81 it turns on the process loads and transfers a signal permitting lens displacement to the control microcomputer Q102, which thus sets the lens in a position corresponding to the desired image magnification according to a flow shown in FIG. 16-4. Since the lens setting is conducted after the start of copying cycle in this manner, it is rendered possible to avoid useless displacement of lens resulting from a change in the image magnification, thus reducing the noise and shock caused by the lens displacement. In the present embodiment this procedure is employed also in case a copying operation is interrupted by another urgent copying operation, and at the re-start of the first copying operation after the completion of said urgent copying operation.

In the reduced or enlarged copying operation the drum is further rotated for another turn in a step 83 in order to stabilize the drum rotation at low speed after switching from high speed, and for potential stabilization and cleaning.

The lens setting by the control microcomputer Q102 is conducted during said pre-rotation, and the potential measurement in a step 171 is conducted for obtaining a determined developing bias only when the lens is displaced.

Then the sequence microcomputer Q101 requests the data for image magnification to the control microcomputer Q102, and, upon identification of the enlarged copying mode in a step 172, sets data in the random access memory in a step 173 for reversing the scanning system at the middle of three reversing positions. Thus the scanning stroke in the enlarged copying mode is selected at the B4 size corresponding to the middle reversing position, regardless of the selected cassette size.

In case of the first reduced copying mode with a magnification of 0.79 (step 173), the sequence microcomputer Q101 requests the data for the selected cassette size to the control microcomputer Q102, then identifies in a step 174 if the selected cassette of the B5 size, and, if so, sets the data in the random access memory for reversing at the shorter half-size position corresponding to the A4 size (step 175). If not, the sequence microcomputer in succession identifies if the cassette is of the size A4R, A4, B5R or n2, and sets the data in the random access memory for reversing at the longest full-size position corresponding to the A3 size if said identifications all fail (step 176). On the other hand the above-mentioned middle reversing position is set if any of said identifications proves affirmative. The size "u2" indicates a small cassette capable of housing various small sized sheets such as post cards.

Also in case of the second reduced copying mode with a magnification of 0.67 (step 177), the middle reversing position is selected for either of the cassette sizes A4, B5, u2 and B5R, and the full-size reversing position is selected if the selected cassette does not corresponds to said sizes.

Also in case of the real-size copying mode, the full-size reversing position is selected for the cassette size A3, the half-size reversing position is selected for the cassette size A4, A5 or u2 and the middle reversing position is selected for other sizes.

In this manner an appropriate reversing position is determined according to the image magnification and the selected cassette, thereby avoiding unnecessary scanning movement. The copying operation is possible in any of these combinations, but it is also possible to prohibit the copying operation in certain combinations only in the second reduced copying mode.

Figure 9:
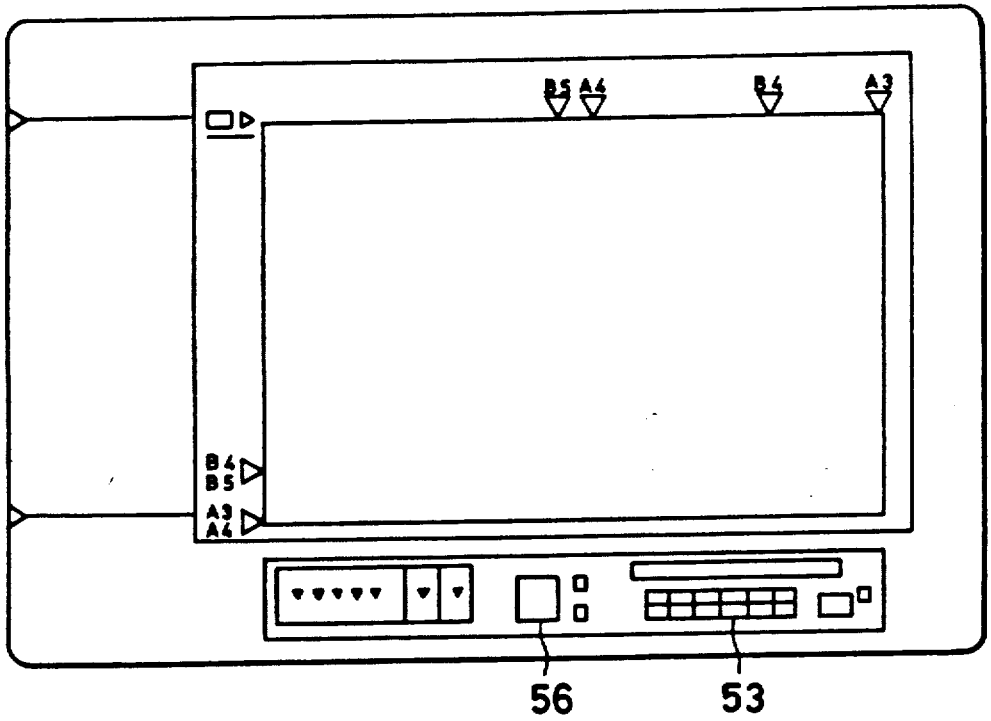
FIG. 9 is a plan view of the document carriage in the copier shown in FIG. 1.

FIG. 8 shows these combinations, wherein double frames indicate appropriate combinations of the image magnification and the selected cassette size. Also FIG. 9 shows the position and direction of the original document on the carriage glass plate, and the copy sheets in the cassettes are to be placed in the same direction as the original documents. The cassette A4R or B5R is designed to hold the copy sheets of size A4 or B5 in a perpendicular direction. In case an inappropriate cassette is selected, the appropriate cassettes are indicated according to a flow shown in FIG. 6-3.

Then referring to FIG. 7-3, a step 271 step advances the sheet counter indicating the sheet number in the copier, total counter and key counter, and a step 272 identifies controls the upper cassette roller, identifying if the manual-insert switch is actuated. Then a step 273 turns on the roller 11 or 12 according to the cassette case data from the control microcomputer Q102. The solenoid for advancing the total counter and key counter is deactivated thereafter. Then, after a certain delay measured by counting the drum clock pulses, a step 274 supplies the developing bias voltage to the developing station, turns of the blank exposure lamp and turns on the original illuminating lamp. Then a step 275 confirms that the scanning system is at the home position, and a step 276 releases a forward start signal therefor.

In this state one of four forward clutches is selected according to the image magnification to advance the lens and mirrors with a scanning speed to be determined according to said magnification and drum peripheral speed, said scanning speed being 270 mm/sec for the real size copying, 240 mm/sec for the reduced copying with a magnification 0.79, 284 mm/sec for the reduced copying with a magnification 0.67 and 145 mm/sec for the enlarged copying. A step 371, shown in FIG. 7-4, releases a signal to start the registering roller 15 during said forward displacement, and a step 372 identifies the arrival of the scanning system at the reversing position stored in the random access memory through a signal from the switch 815 shown in FIG. 3-1. Then a step 373 is executed to turn on the blank exposure lamp, turn off the forward displacement of the scanning system and turn on the reversing clutch. The original exposure lamp is turned off at this point, except in the reduced copying mode it is turned off with a delay. The scanning system is stopped at the home position in a step 470.

Subsequently a step 570 turns of the process loads and initiates the post-rotation routine, and a step 571 stops the drum upon ejection of the copy sheet detected by the switch 18. Thereafter the aforementioned routine process is executed according to whether the rest time until the subsequent copy start signal is shorter than 60 seconds. Also in case the copier is let to stand for 2 hours the power supply other than to the microcomputers is cut off.

Figures 1, 1A, 1B, 1C, 6:
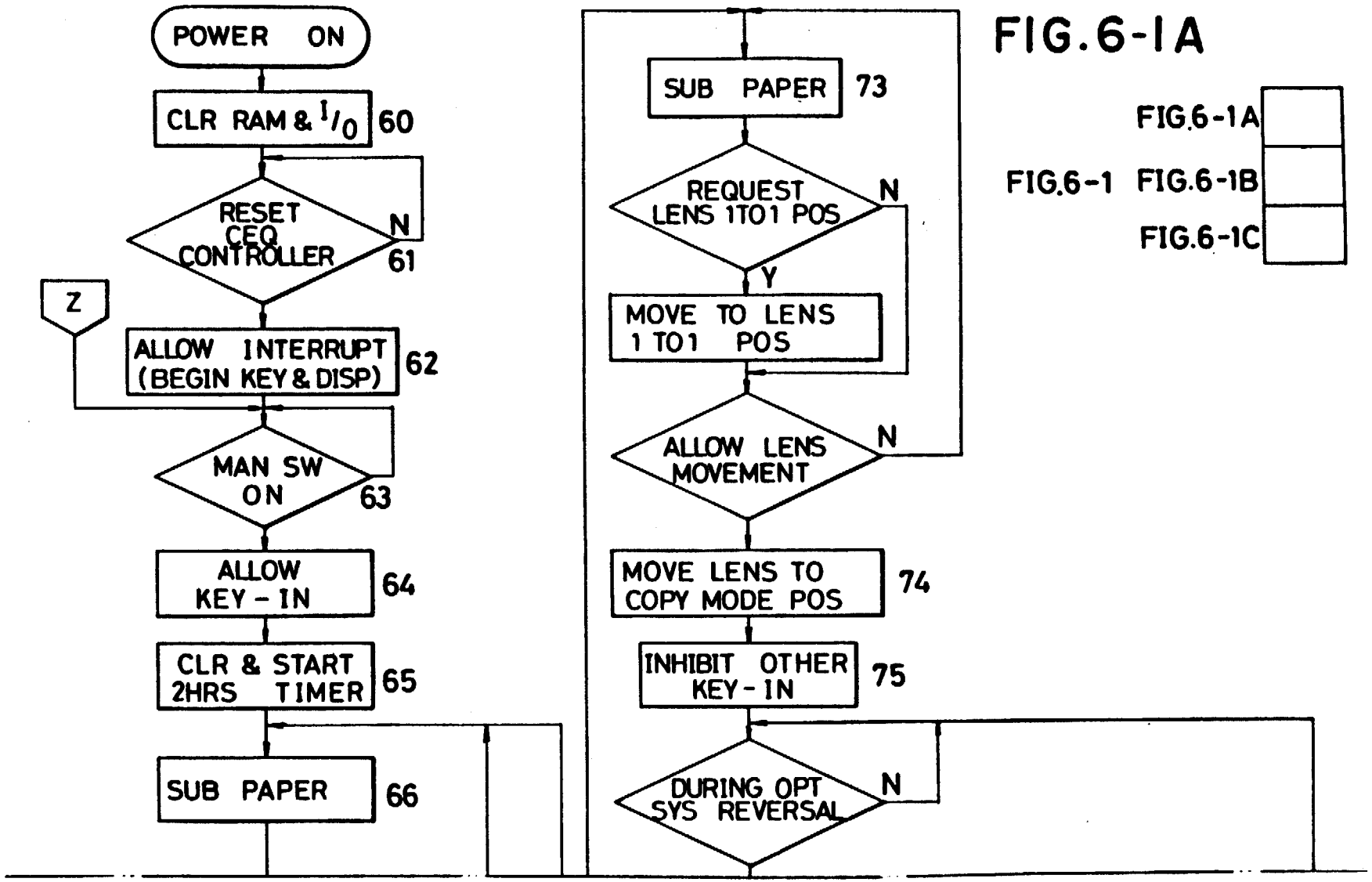
Figures 1, 6:
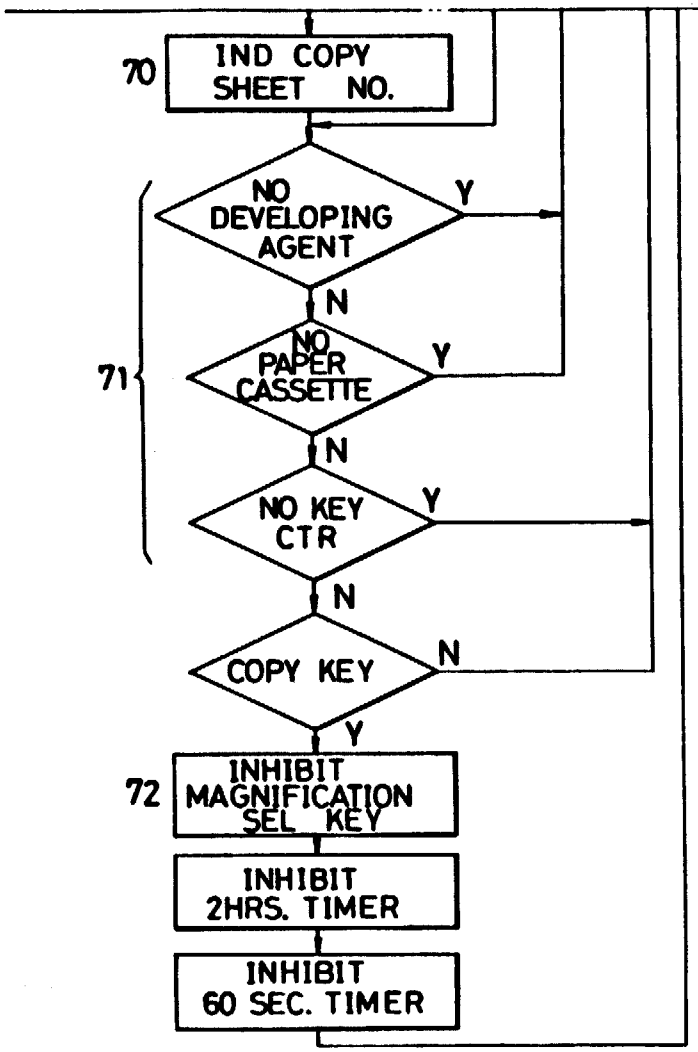
Figures 2, 6:
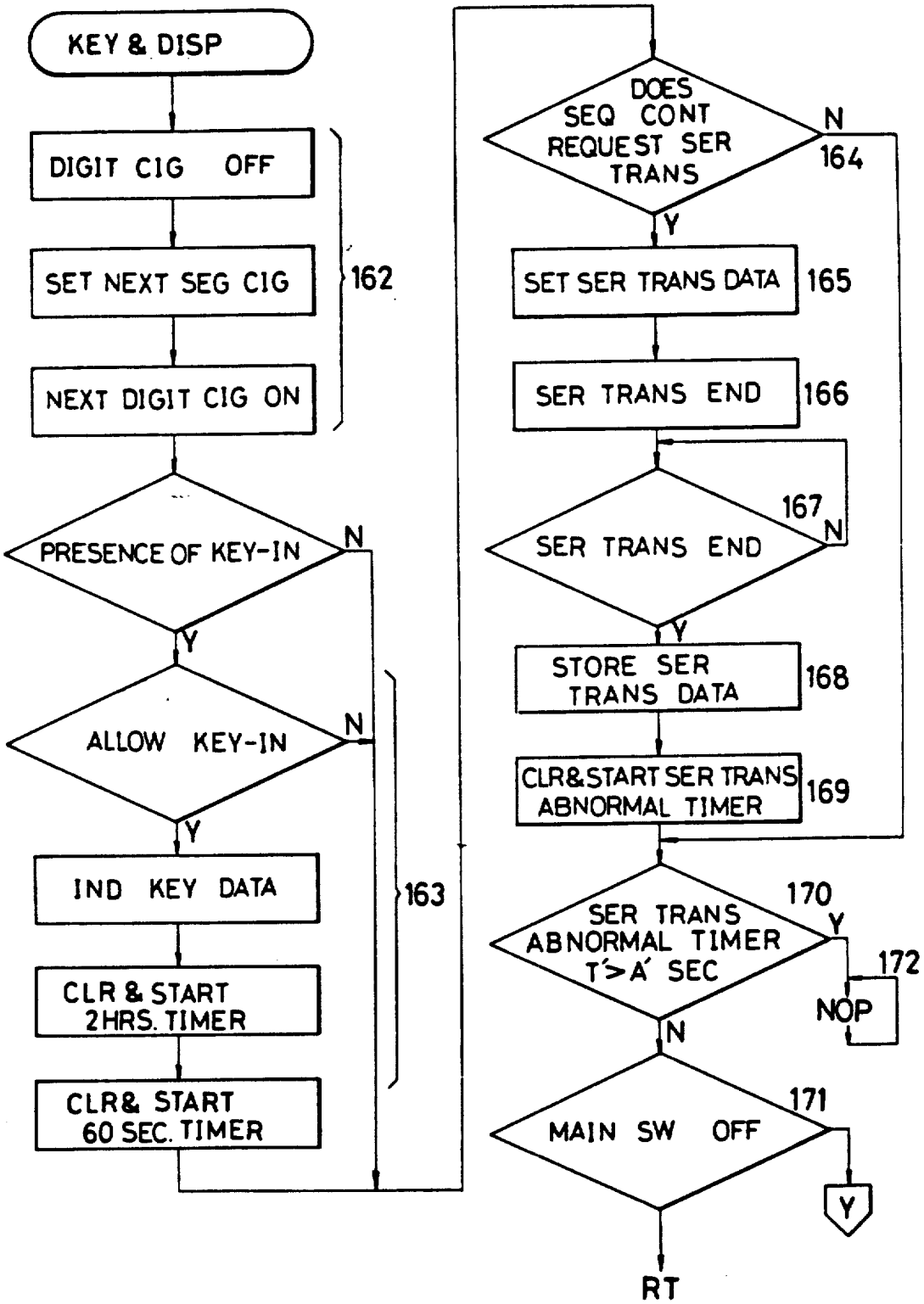
Figures 3, 3A, 3B, 6:
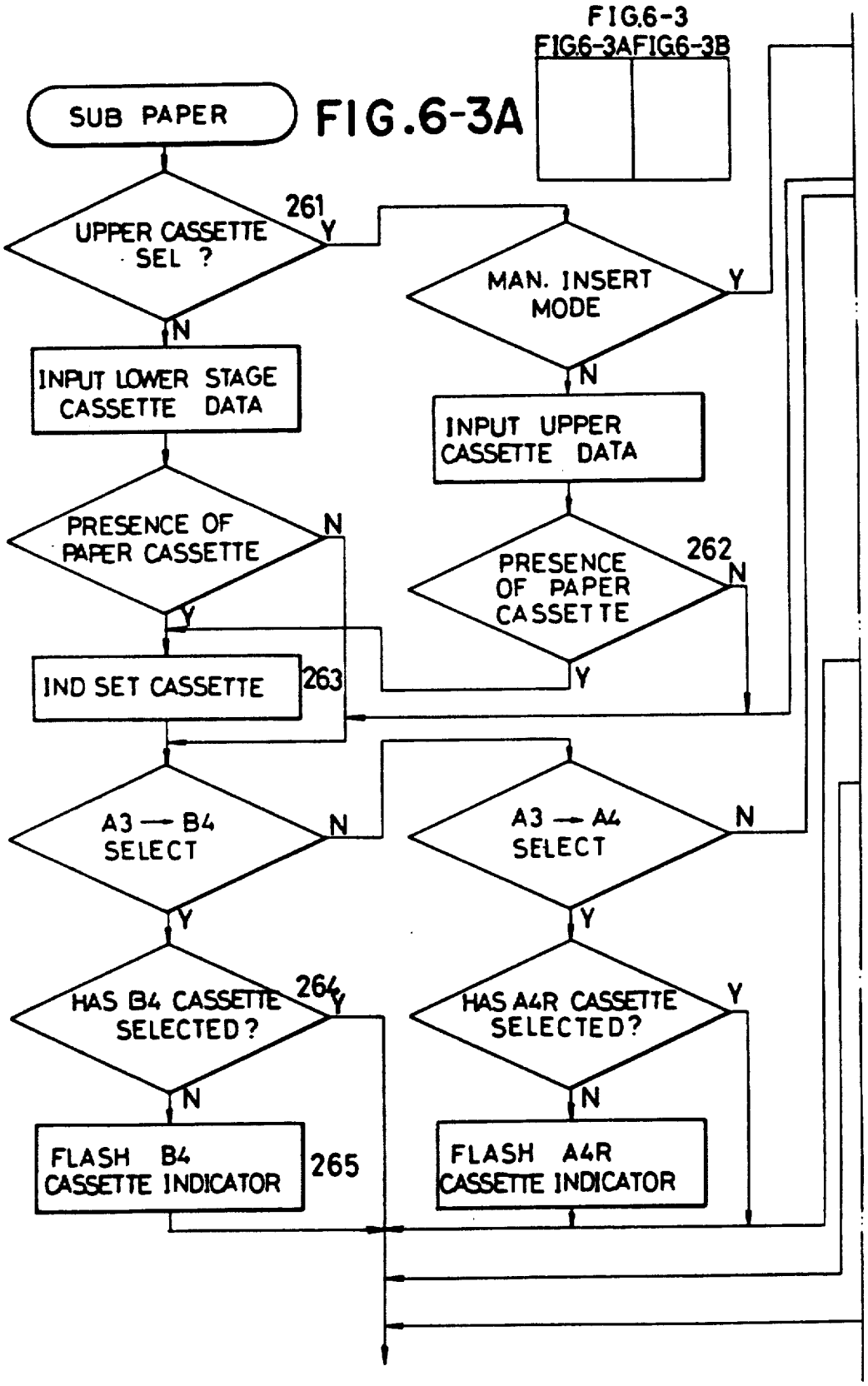
Figures 3B, 6:
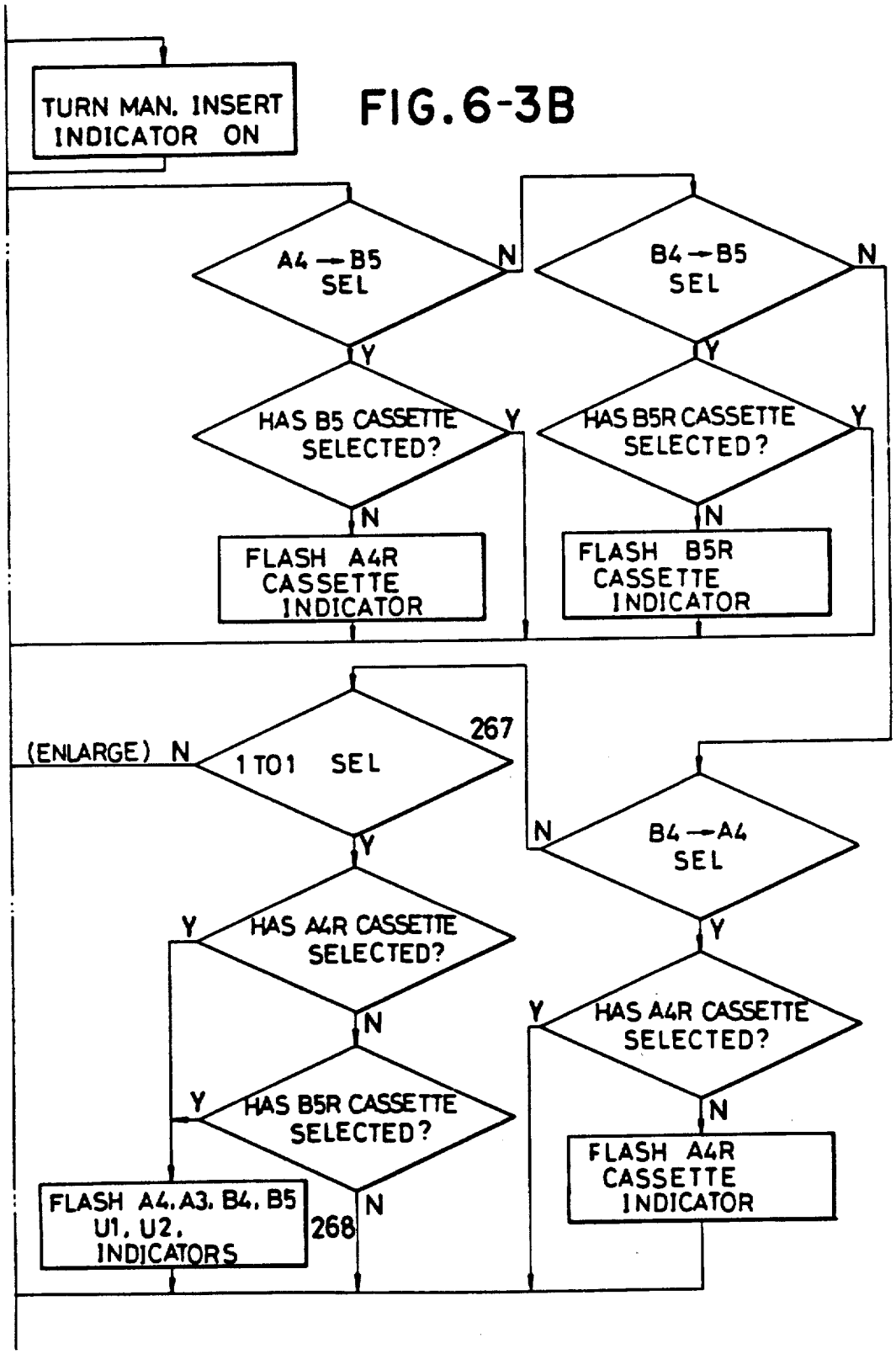
Figures 4, 4A, 4B, 4C, 6:
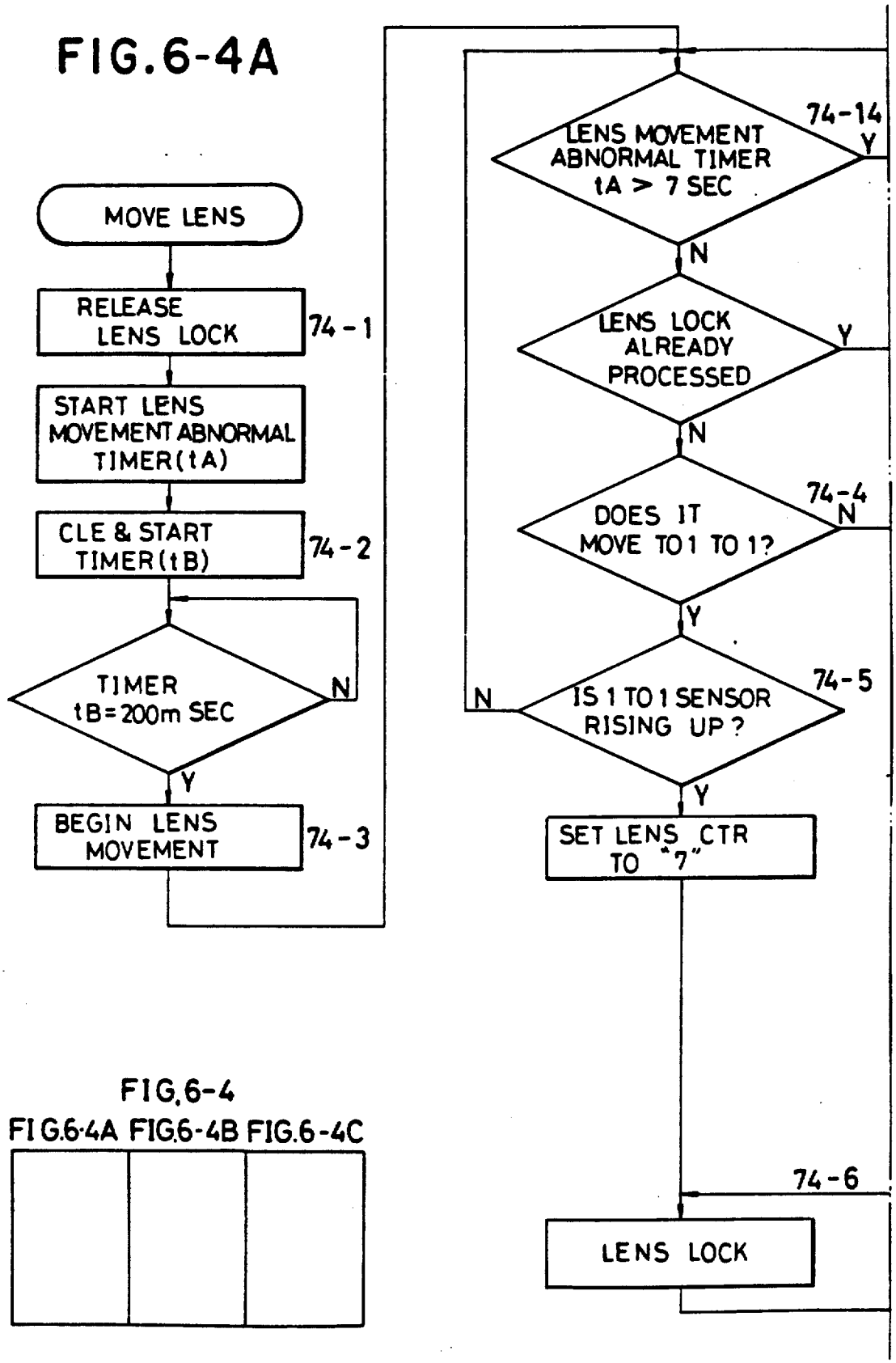
Figures 4B, 6:
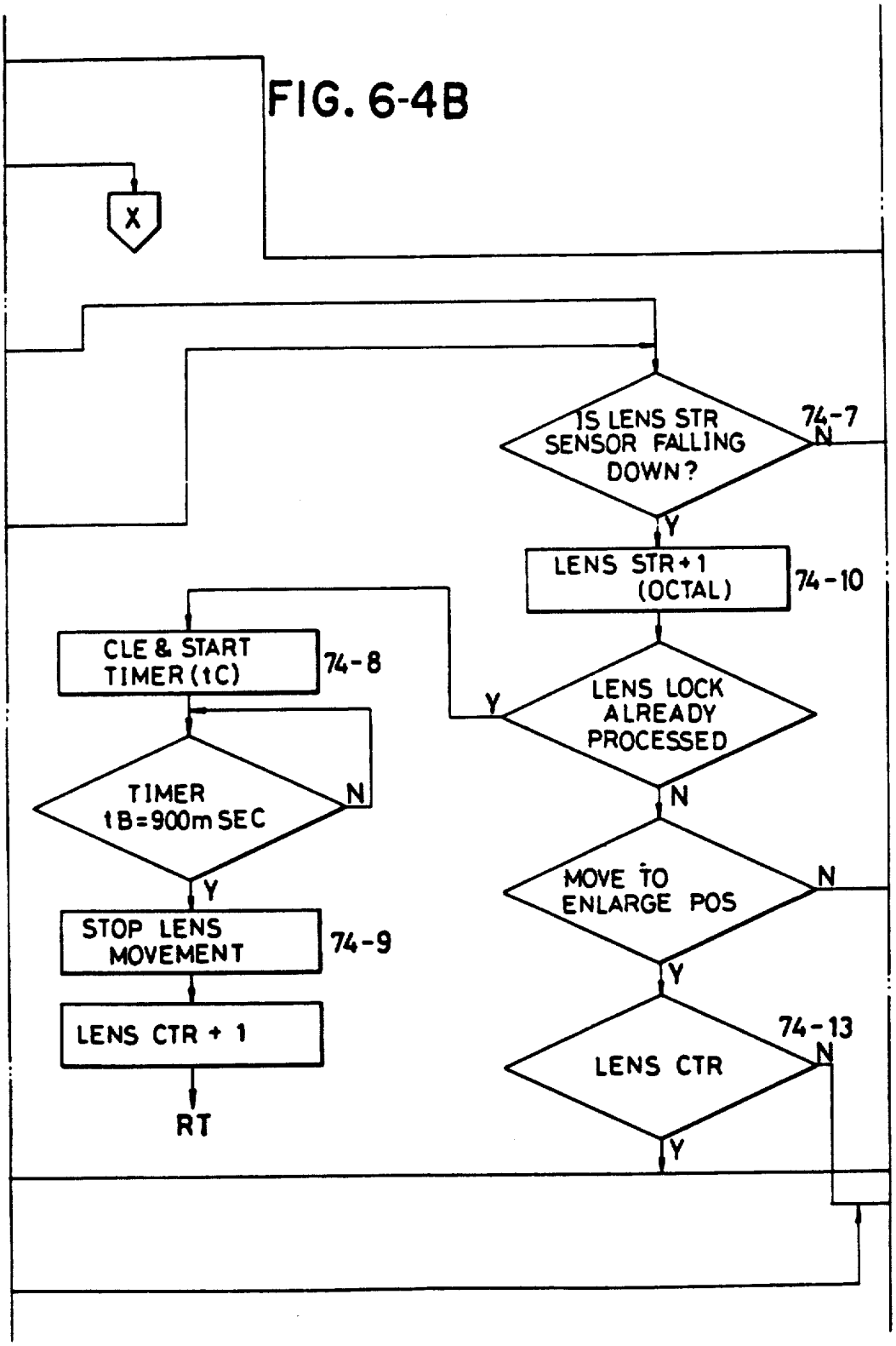
Figures 4C, 6:
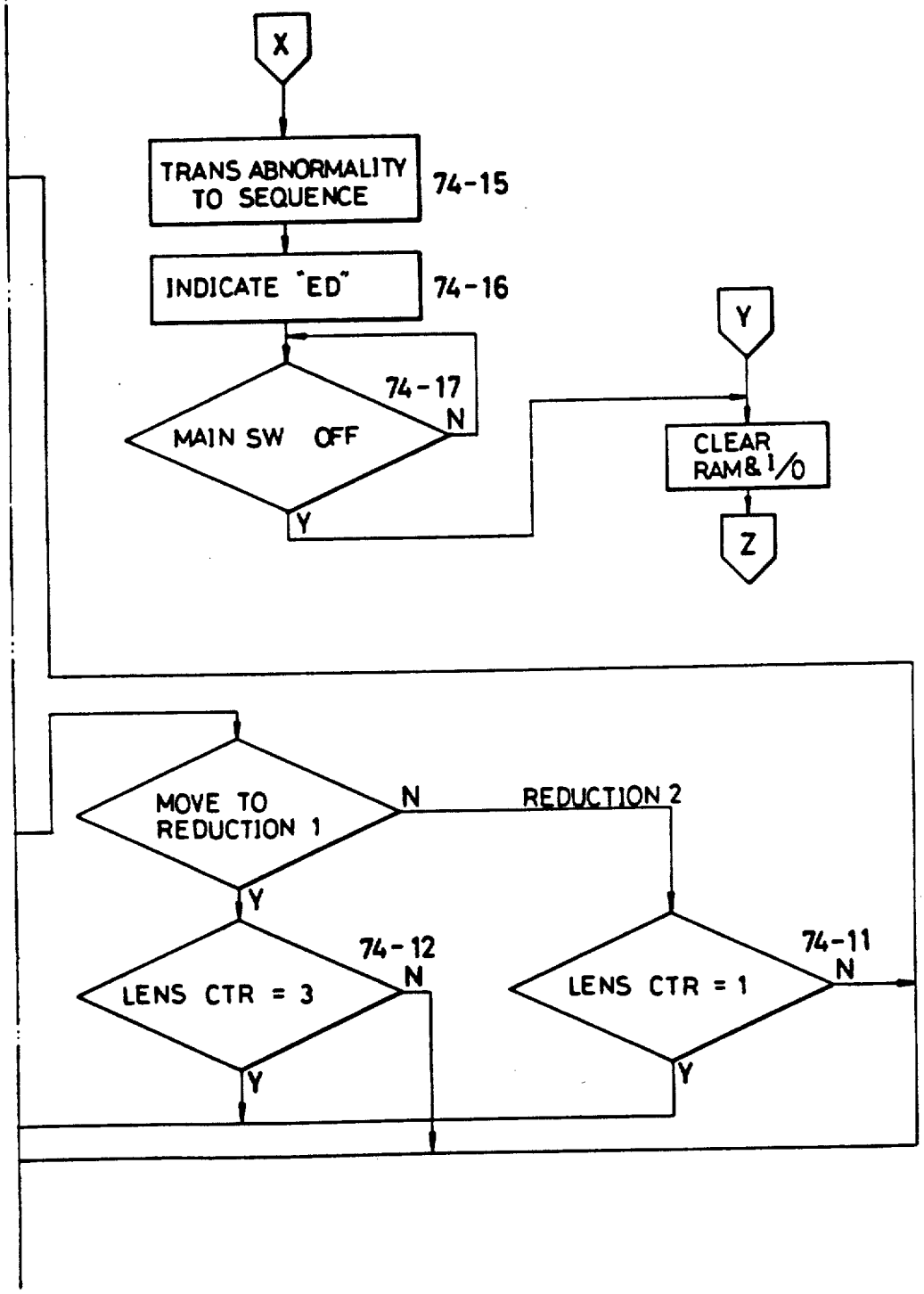
Figures 5B, 7:
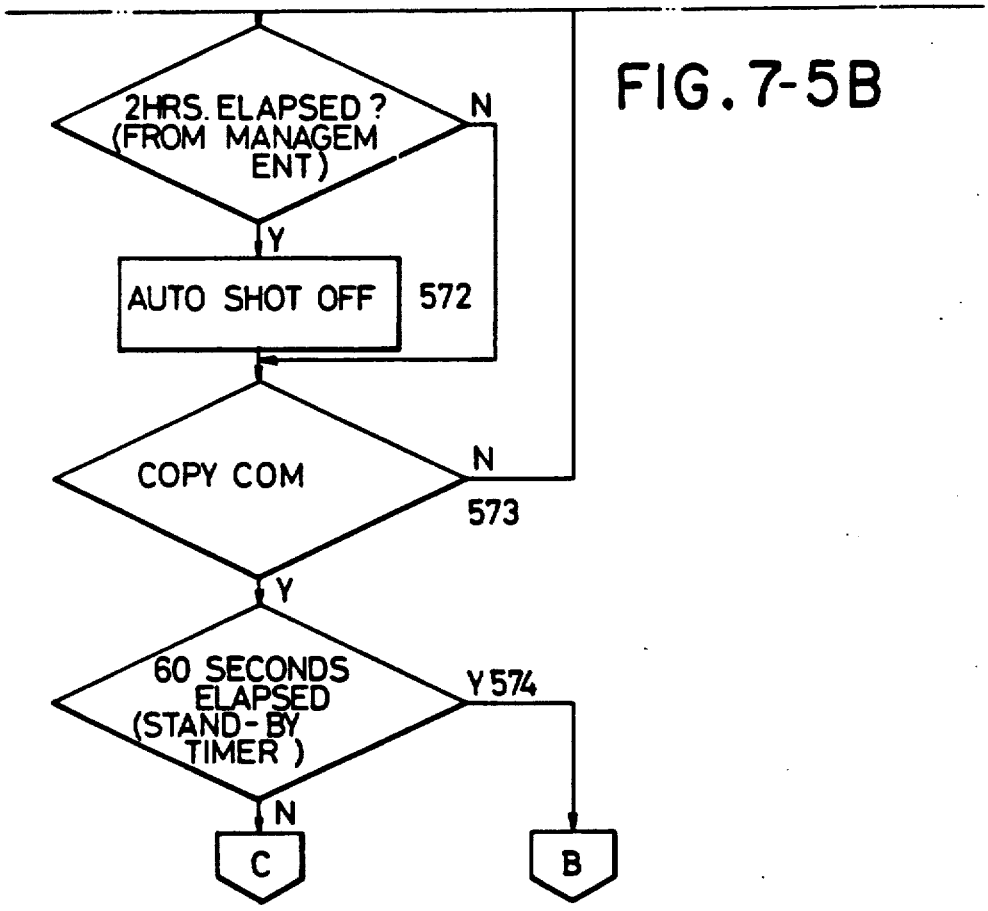

The sub-routine flows shown in FIG. 7-6 are inserted in each closed loop in FIGS. 7-1 to 7-5 and are designed for controls of data transfer between computers Q101 and Q102, of decrement of a counter provided for display correction in the copier in response to the detection of sheet ejection by the sensor 18 (step 607), of transferring data indicating a failure to the control microcomputer Q102 upon detection of a failure in the thermistor (step 596), and of similar data transfer upon detection, by a timer, of a failure in the forward-reverse clutches (step 598) or of a failure in the drum clock pulse generator. In case of such failure the program turns off the main motor etc. and returns to the routine for identifying the state of power switch shown in FIG. 7-1.

In response to said data, the control microcomputer Q102 performs a display such as "E1", "E2" etc. on the display unit 68.

The main motor M1, principally for driving the photosensitive drum, fixing rollers etc., is driven in both directions in the present embodiment to control the drum rotation speed in two steps. More specifically, as shown in FIG. 5-1 indicating the power transmission system in a block diagram, the motor M1 is provided on the output shaft thereof with a one-way clutch CL1 and another one-way clutch CL2 with reducing gears, whereby the normal clockwise rotation of the motor is transmitted through said clutch CL1 as the clockwise driving force along the transmission route LT1, while the anticlockwise rotation of the motor is transmitted not through the clutch CL1 but through the clutch CL2 and is reduced and inverted in direction by the gears G1 as the driving force of also clockwise direction, along the transmission route LT2.

In the present embodiment, as explained in the foregoing, the switching of rotating speed of the motor is converted into the change in the drum rotation speed, thus providing a simple, inexpensive and still accurate method of speed control.

FIG. 5-2 shows another embodiment of the speed change in which a motor 1-1 has two output shafts of a same rotating direction but of different speeds, of which power is respectively transmitted by a solenoid clutch CL3 or CL4. The above-mentioned two methods are most inexpensive and reliable for securing two different speeds, although there are many other methods for speed conversion.

Now referring to FIG. 3-3, in order to achieve speed conversion for regulating the copying process speed, a common terminal J11-1 of the main motor M1 is connected to a terminal of the power supply, while a terminal J11-2 of the main coil and a terminal J11-3 of the auxiliary coil, with a phase-advancing condenser C1 therebetween, are connected to the other terminal of the power supply respectively through solid-state relays Q304 and Q305 which are turned on to rotate the motor M1 in the forward or reverse direction.

In synchronization with said change of drum speed, the outputs of the transformers for the primary and secondary chargers, transfer charger and preliminary charge eliminater, if activated, are changed with a ratio of 1 : 0.7, which is equal to the ratio of the drum speed change since such output voltage ratio approximately equal to the drum speed ratio is experimentally found sufficient for the purpose. Such reduced output of said process means corresponding to the low drum speed allows the image processing with appropriate potentials, thus providing a stable image regardless of the image magnification. Also the intensity of the exposure lamp 23 is so regulated as to obtain a constant exposure on the drum according to the lens position, or indirectly corresponding to the peripheral speed of the drum. It is also possible to control the voltage supplied to the lamp in response to the switching of the drum peripheral speed.

In the present embodiment the post-rotation steps after a reduced or enlarged copying operation is conducted at the low drum speed, and, in case a real-size copying is instructed to Q102 and a copy start instruction is entered, the drum is not immediately changed to the high speed but the main motor is turned off from the reverse rotation and is switched to the forward rotation with a delay of 30 msec. only after said post-rotation is completed. Consequently there will result no unevenness in the potential caused by the change in the drum speed during the post-rotation.

Also the rotation speed changing method of the present embodiment is capable of manually or automatically compensating the change in rotation resulting from a change in frequency.

Now there will be given an explanation on the function of the control microcomputer Q102 while making reference to FIGS. 6-1 to 6-4. In FIG. 6-1, upon turning on of the power supply, the microcomputer Q102 clears and initializes the input/output ports and random access memory in a step 60, then confirms the completion of resetting in the sequence controller Q101 in a step 61 and initiates the control function. A succeeding step 62 permits the program interruption process. A signal of 1.2 kHz from an oscillator is supplied to the interruption port to conduct an interruption, whereby an interruption routine shown in FIG. 6-2 is executed to perform the scanning for key entries, dynamic display by various display units (step 162) and inspection for the requests for serial data transfer with the sequence microcomputer Q101.

The probe signals for said dynamic are supplied regardless of the state of the main switch 502 since said signals are also used for identifying the abnormality in the control microcomputer Q102, but the display units are not lighted when said main switch 501 is turned off since the power supply for display is turned off by the sequence microcomputer Q101.

Upon serial transfer of signals indicating the turning on of the main switch 501 from the sequence microcomputer Q101, the control microcomputer Q102 permits the key entries, and resets and restarts the 2-hour time in the steps 63 to 65.

During the waiting time, the lens should be at the real-size copying position in order that the sequence microcomputer Q101 can regulate the charge currents and the exposure lamp through potential control. Thus, in response to a signal requesting the real-size copying lens position from the sequence computer Q101, the control microcomputer Q102 executes a sub-routine shown in FIG. 6-4, corresponding to a step 67, to move the lens to the aforementioned position.

In a step 68, upon receipt of the wait completion signal from the sequence microcomputer, a 60-second timer is reset and restarted.

The aforementioned 2-hour timer and 60-second timer are reset by each manipulation of the copier by the operator. The former turns off the power switch to save energy in case the operator does not operate the copier or forgets to turn off the switch for 2 hours, and the latter initializes the displays in case the operator does not operate the copier for 60 seconds. Thus in a step 69, said 60-second timer returns the displays to the "standard" mode composed of the real-size copying, lower cassette selection and the copy number "1" shown on the display unit 68. In this case the lens is returned to the real-size copying position after the copy start key is actuated but it may returned also after the lapse of 60 seconds. Said 60-second time is not operated in case of deficient toner or absence of copy sheet or cassette, in consideration of a fact that the operator should be trying to re-start the interrupted copying operation. Also said timer is operated during the waiting cycle.

In case data for manual-insert mode are sent from the sequence microcomputer Q101 (step 70), the display unit 68 is changed to "1". During the entry of detection signals for the deficient toner or absence of cassette or key counter (step 71), the start data are not sent to the sequence microcomputer Q101 even if the copy start key is actuated. However the changes in the copy number, magnification or cassette selection can be entered and the corresponding changes in the display are made by the programs shown in FIGS. 6-2 and 6-3.

After the actuation of the copy start key, however, the change in the magnification mode by the magnification keys is forbidden (step 72), and the operation of the 2-hour and 60-second timers is also forbidden. Then in response to a request from the sequence microcomputer Q101 for the real size copying mode for potential control, the program shown in FIG. 6-4 is executed in a step 74 to set the lens in the determined position shown in FIG.1. Changes in the selected cassette or in the copy number by the cassette keys 55 or numeral keys 53 are allowed until this stage but forbidden thereafter (step 75). In this manner, the changes in the copying mode are accepted even after the copy start signal is given except those requiring the displacement of movable parts, thus minimizing the useless copying operations.

The display on the display unit 68 is step decreased upon each receipt of the data indicating the reversing of the optical system from the sequence microcomputer Q101, and a step 76 identifies if said display is equal to zero, and, if so, a step 77 returns the display unit 68 to the original set number, enables the key entry and start an auto-clear timer. Also after said reversing there are executed a step 78 for identifying the actuation of the stop key 50, absence of key counter or absence of copy sheet or cassette, and a step 79 for identifying the actuation of the interruption key 51, and in the presence of any of these situations the program is shifted to the mode same as for the completed copying operation. However the displays are retained when the copying operation is interrupted except in the case of the actuation of the stop key or of the absence of key counter.

Upon completion of a copying operation the corresponding data are supplied to the sequence microcomputer Q101 which identifies said data by the step 374 in FIG. 7-4 and proceeds to the repeated copying cycle or to the aforementioned post-rotation cycle.

In the event a situation of the absence of copy sheet or key counter or the actuation of the stop key or interruption key occurs during a copying operation, such situation is stored in the circuit and identified after the abovementioned reversing position is detected. The display on the display unit 68 is changed accordingly. Consequently in case of the actuation of the stop key or the interruption key, the original document can be changed when said change in the display takes place. Also the display returns to the initial set number in case the key counter is absent or the stop key is actuated.

Now reference is made to FIG. 6-3 for explaining the relationship between the selection of image magnification and the display for cassettes. The program SUB-PAPER shown in FIG. 6-3 is executed in a step 66 after the key entry is permitted or in a step 73 after the start of copying operation. At first there are displayed a cassette size (56) mounted on a cassette case selected by the cassette selection keys 55 and a selected cassette case (72). A step 261 identifies if the upper cassette case is selected, and, if so, the signal from the switch 804 for identifying the upper cassette size is entered to identify the presence of the copy sheet and of the cassette. In the absence of the cassette, the cassette size is not displayed, and the image magnification is identified to conduct a display as will be explained later. In the presence of a cassette, a step 263 displays the selected cassette case and the cassette size therein. In the absence of a cassette the selected cassette case is displayed and a warning lamp is lighted by an unrepresented circuit. A similar procedure is executed also in case the lower cassette case selection is identified. In case of the manual-insert mode, the cassette case is not displayed but the magnification is displayed according to the corresponding data from the sequence microcomputer Q101.

In case the real-size copying is selected (step 267), inappropriate cassettes are the A4R cassette (a cassette for reduction copying having A4 size sheets in a position perpendicular to that in the A4 cassette) and the B5R cassette (a reduction copy cassette having a similar relation to the B5 cassette). In case such cassette is mounted in the cassette case selected by the selection key 55, the mounted cassette is indicated by static light while a cassette size other than A4R and B5R is indicated by intermittent light (step 268). In case an appropriate cassette, other than A4R and B5R, is mounted, the mounted cassette alone is displayed by static light and no intermittent light is given. Also the copying operation is not prohibited even when an intermittent light is given, so that the copy can be obtained on a copy of an arbitrary direction.

Then in case a reduced copying from A3 size to B4 size is selected by the reduction key 59 (step 164), the appropriate cassette is B4 cassette. As in the real-size copying, if an inappropriate cassette is mounted, the mounted cassette is displayed by static light and an appropriate cassette is simultaneously indicated by intermittent light (step 265). Also if the appropriate cassette B4 is mounted, said cassette alone is indicated in the same manner as in the real-size copying mode. Similarly the A4R cassette is appropriate for the reduction from the size A3 to A4, the B5 cassette is appropriate for the reduction from the size A4 to B5, the B5R for the reduction from the size B4 to A4, and all the cassettes are appropriate for the enlarged copying mode.

As explained in the foregoing, in case an inappropriate cassette is mounted the appropriate cassette size is indicated by intermittent display while the mounted cassette size is indicated by static display, and in case an appropriate cassette is mounted said cassette size alone is indicated. These relations will be understood from FIG. 8.

In the manual-insert mode, upon insertion of a manual-insert guide plate along the upper lid of the mounted cassette, the corresponding cassette size display is extinguished and a manual-insert display in the cassette size display unit 56 is lighted, whereupon the copy number is set to "1" as repetitive copying is not permitted in the manual-insert copying mode. In said mode the optical scanning is selected in consideration of the largest A3 size. Also in case a reduced or enlarged copying mode is selected, no intermittent display is given for the cassette size, and the size of the sheet to be inserted manually is arbitrarily determined by the operator.

The foregoing display functions are executed even before or after the entry of copy start signal. Since the data prohibiting the copying operation are not supplied even when an appropriate cassette is not mounted, the sequence microcomputer Q101 performs the copying operation in response to the copy start instruction entered to the control microcomputer Q102.

In this manner it is rendered possible to form an image reduced from the size A3 to A4 on an A3 sheet, leaving a marginal area thereon, or to form an enlarged partial image trimmed in a suitable manner on an A4 sheet.

The entry by the copy start key 52 is enabled unless there is given a warning display such as for deficient developer 66, full recovered toner container 65, absence of paper 64, sheet jamming 63 or absence of key counter 67, and said entry is also possible in case of an inappropriate cassette size indicated by the intermittent light in the cassette size display unit 56.

In the following explained is the interruption copying operation. An interruption copying operation interrupting another copying operation is rendered possible by the actuation of the interruption key 51 during said another copying operation or during the stand-by state. Upon identification of the actuation of the interruption key 51 in a step 79 (FIG. 6-1), the copy count at this point, the selected cassette case and the selected image magnification are diverted into a determined area in the random access memory, and the interruption indicator 69 is lighted in a step 80. Upon completion of the original scanning for the sheet already fed, the copy number display 68 is changed to "1" and the copying operation is interrupted. At this stage the display functions of the cassette selection display 72, cassette size display (including intermittent lighting), reduced copying display 60, enlarged copying display 61 and real-size copying display 62 remain unchanged in order to minimize the number of key settings required in the interruption copying operation, since such operation usually required several key settings.

However, in case the operation mode of the interruption copying is different from that of the interrupted copying, it is possible to modify the copy number, cassette and image magnification by respective keys for example from a reduced copying to an enlarged copying, form a first reduced magnification to a second, from A3 cassette to A4 cassette, or from 10 copies to 5 copies. In case of no operation, the 60-second and 2- hour timers perform automatic clearing and automatic resetting in a step 81.

In case the operation mode is modified, the displays automatically return to the state before the interruption upon reversing of the optical system after the last scanning for the interruption copy. Thus, upon completion of the copying cycles of a set number for the interruption copying, the original data of the copy count, selected cassette and selected image magnification are returned from the random access memory to the display units.

Consequently the operator can re-start the copying operation simply by the copy start key after the completion of the interruption copying operation even if the copy number, selected cassette and selected image magnification are modified in said interruption copying.

It is also possible to achieve the interruption copying by interrupting the copying operation with the stop key 50 while holding the relevant data, executing the step 80 and thereafter by the interruption key 51, and, upon completion of the interruption copying operation, executing the step 81 and thereafter again by the key 51.

At the start of the interruption copying and at the re-start of the original copying, the lens displacement for meeting the selected magnification is conducted after the copy start instruction is given. Also in case the interruption key 51 is actuated succeeding to the setting of copy number etc. for the first copying operation, the data already entered are diverted in the random access memory to allow the entry of new data, according to which the copying operation is executed at first, and, after the completion of said copying operation, the copying operation according to the diverted data can be started by the copy start key alone.

The actuation of the stop key 51 after the entry of the interruption copying or during the interruption copying operation cancels said interruption and restores the interrupted copying, whereby the diverted data are again displayed.

Now there will be given an explanation on the procedure in case a sheet jamming.

The sequence microcomputer Q101 detects whether the sheet completes the steps of image transfer and separation within a determined from the sheet feeding by means of the sensor 16, and, by the sensor 18 whether the sheet reaches the position of said sensor 18 within a determined time from the sheet feeding. In case a sheet jamming, the sequence microcomputer Q101 transfers, by serial data, the number of sheets remaining in the copier obtained by a sheet counter provided therein to the control microcomputer Q102, which displays said data on the copy number display unit 68. For example two sheets are left in the copier, a display "P2" is given to instruct the operator to take the corresponding action.

Also in case of a jamming after the sheets are all ejected from the copier, for example a jamming in the sorter, a display "P0" is given to indicate that no sheets are left in the copier, thus representing the jamming in the sorter. After the jammed sheets are removed, the copy count to this point is corrected by the number of sheets lost in the jamming, and thus corrected number is displayed on the display device 68.

In any jamming the jam relay 827 is energized to mechanically hold the jammed state, and the above-mentioned corrected number is displayed upon manual resetting of said relay.

Now there will be given a detailed explanation on the function of the microcomputers Q101 and Q102 shown in FIG. 3-1.

Serial data transfer

In the present embodiment the data exchange between said microcomputers is conducted by simultaneous bidirectional serial data transfer, as will be explained detailedly in the following, while making reference to FIGS. 6-2 and 7-6.

At first the sequence microcomputer Q101 transfer, through the port Q11 thereof and the request line 112 to the input port i11 of the control microcomputer Q102, an L-level serial transfer request signal (RQ) (step 601 in FIG. 7-6), upon detection of which (step 164 in FIG. 6-2) the microcomputer Q102 prepares the serial data for transfer (step 165) and transfers to the microcomputer Q101 through the line 111 a signal ENABLE indicating that the serial transfer is possible (step 166). Upon detection of said enable signal (step 602) the microcomputer Q101 prepares the serial data for transfer from Q101 (step 603), and the microcomputers Q101 and Q102 mutually transfer the data simultaneously through the lines 114 and 115 (step 167 in FIG. 6-2 and step 604 in FIG. 7-6). In these steps the microcomputers identify if respective shift registers have received 16-bit data and store said data in random access memories for data reading. Said data transfers are conducted by successive shift storage in respective shift registers by means of the shift clock pulses sent through the line 113. As shown in FIG. 10, said data represents an allotted meaning in each of 16 bits, and the upper case and lower case respectively represent the data transferred from Q102 to Q101 and from Q101 to Q102. For example in the data received by Q101, a signal "1" at the address 1 in ST3 indicates a trouble for example in the lens displacement for changing the magnification, whereby the sequence microcomputer Q101 prohibits the copying operation. Also a signal "1" at the address 2 in ST1 indicates the entry for enlarged copying operation, whereby the microcomputer Q101 executes corresponding control such as changing the speed of the main motor and the optical system. Also in the data received by Q102, a signal "1" at the address 2 in ST0 indicates a trouble for example in the displacement of the optical system, whereby the control microcomputer performs an error display, for example "E0", on the display unit 68 and prohibits the key entry. Also signal "1" at the addresses 1 or 0 in ST0 indicates that the rear door switch or main switch is open, whereby the microcomputer Q102 performs a "waiting" display or terminates the numeral displays. Similarly the data shown in FIG. 10 respectively correspond to different bits.

In case of jamming, the data in ST1 are used to change the display in display unit 68 to "P0", "P1" or "P2" and to make correction on the copy number. Said display change is conducted by storing the data in the random access memory in a step 168.

A similar data transfer procedure is executed in case a request signal is transferred from the control microcomputer Q102 to the sequence microcomputer Q101.

Said microcomputer Q101 is designed to perform serial data transfer at an interval of ca. 370 msec. controlled by an internal transfer timer as explained in the foregoing (steps 600 and 606).

Also said microcomputer Q101 inspects the serial transfer request signal from the microcomputer Q102 by sending a port in a sub-routine provided in the closed loops in the main flow sequence, said sub-routine being also utilized for constantly inspecting the state of the main switch (step 599 in FIG. 7-6).

Also said microcomputer Q102 inspects the serial transfer request signal from the microcomputer Q101 almost constantly in the routine for dynamic control for key entries, copy number display etc.

The control microcomputer Q102 is provided with a timer t' initialized upon each serial data transfer in order to identify the stoppage in the serial transfer for example by an abnormality in the sequence microcomputer Q101. The timer is started in a step 169 shown in FIG. 6-2, and, in case the next serial transfer is not conducted within the set time of said timer (step 170), the program enters a closed loop (step 172) identifying an abnormality in the sequence microcomputer, thereby terminating the probe signal for the key entry scanning and segment scanning, whereupon an abnormality detecting circuit 900 connected to Q102 is activated.

Figure 12:
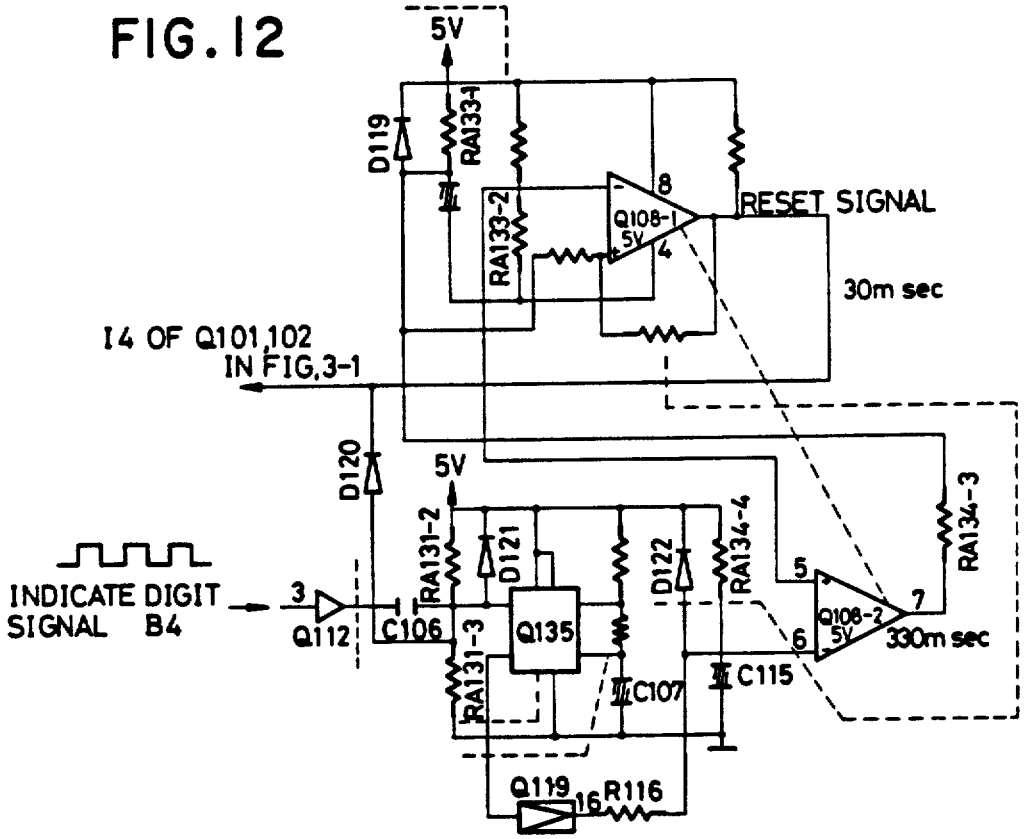
FIG. 12 is a circuit diagram of the resetting circuit.

Said abnormality detecting circuit 900, shown in FIG. 12, inspects the periodic digit signals released by the control microcomputer Q102 for dynamic display and activates a resetting circuit for the microcomputers Q101 and Q102 if the digit signal does not change over a determined period. Consequently in case the microcomputer Q101 or Q102 shows an abnormality, said microcomputers are reset to run from the beginning of the program.

Computer reset control

In the sequence control of a copier with plural microcomputers, there is a possibility of erroneous operation caused by the chip-to-chip fluctuation of the time from the power on to the resetting and running of the microcomputers. In the present embodiment, however, at the resetting of a microcomputer (or at a certain time thereafter) the resetting of the other microcomputer is confirmed in order to avoid erroneous copying operation caused by the running of the microcomputer not initialized properly.

In this manner the operation of the microcomputers is rendered possible only after both are reset and properly initialized.

Also if either microcomputer shows an abnormality, the program execution of both microcomputers is interrupted at that point, thus avoiding unnecessary function of the process loads in the copier.

These functions will be explained in the following, with particular reference to the flow charts in FIGS. 6-1 and 7-1, and circuit diagrams in FIGS. 11 and 12.

Upon connection of the copier to the AC power supply line, a power source of +5 V is activated to energize microcomputers and other control units, whereby the resetting circuit shown in FIG. 12 is activated to reset the microcomputers Q101 and Q102. During the setting signal all the output ports of said microcomputers Q101 and Q102 are shifted to H-level. Upon termination of said resetting signal the microcomputers Q101 and Q102 start to execute the programs from the address 0 in the respective read-only memories. Thus Q101 and Q102 respectively clear the random access memories and set the output ports to the initial state (step 60 in FIG. 6-1 and step 68 in FIG. 7-1). Then, in order to avoid initial errors in the mutual data exchange, the microcomputers Q101 and Q102 consum a time of ca. 30 msec. by counting the clock pulses in internal timers. Subsequently the microcomputer Q102 transfers to Q101 a serial transfer request signal RQ through an output port 110, which is designed to be at the H-level during the resetting signal and at the initial state and to shift to the L-level at said request. In response to said request the microcomputer Q101 initiates the serial data transfer to Q102. Upon completion of said transfer, the microcomputers Q101 and Q102 check if the transferred data coincide with the predetermined data after resetting (step 61 in FIG. 6-1 and step 69 in FIG. 7-1), and, repeats the serial data transfer if there is an error. The microcomputers Q101 and Q102 proceed to the succeeding functions only after the transferred data coincide with the predetermined data (at address 3 in ST3 shown in FIG. 10).

power on-off control

The microcomputer Q101 inspects the state of the main switch (step 70 in FIG. 7-1), and, upon turning on thereof, transfers the corresponding data serially to Q102 and turns on a power supply of 24 V for the process loads such as registering clutch and a power supply of 5 V for display (step 70-1). While the main switch is not turned on, the microcomputer Q101 is in a waiting state, resetting the random access memory and input/output ports and thus minimizing the erroneous operations.

Figure 11:
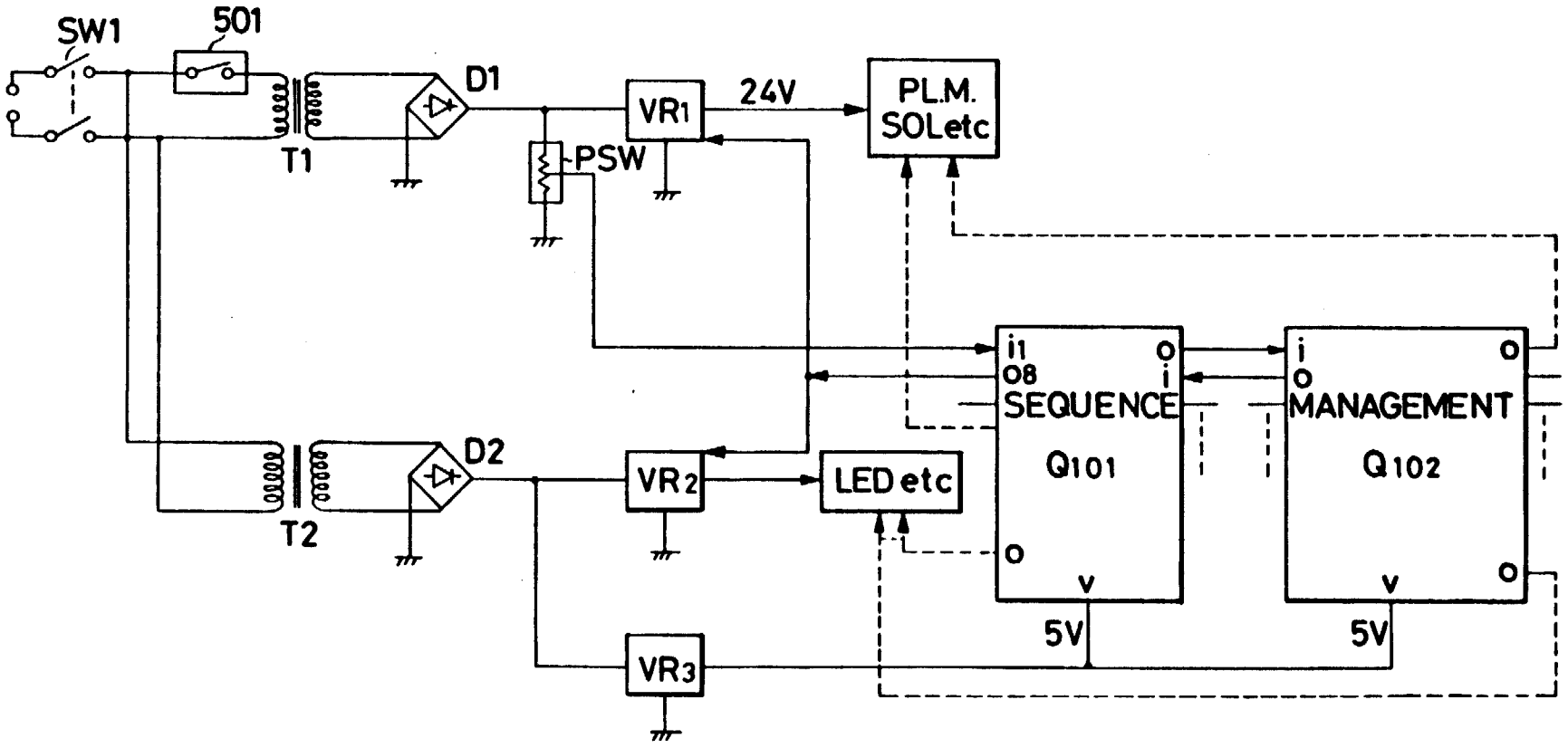
FIG. 11 is a block diagram showing the power supply circuit.

As shown in FIG. 11, the signal for said power turning on is supplied from the port 08 of the microcomputer Q101 and turns on a regulator VR1 of the 24 V power source and a regulator VR2 of the 5 V power source in the ordinary manner. Thus, although said regulator VR2 for display and another regulator VR3 for the microcomputers are connected commonly to a rectifier D2 and a transformer T2 not controlled by the main switch 501, it is rendered possible to securely control the display.

Conventionaly the microcomputer has a disadvantage, at the resetting thereof, of undesirably turning on the driving elements such as a hammer driver or supplying a voltage to a process load to activate the same.

In the present embodiment, however, such inconvenience does not take place since the 24 V power source for process loads is turned on after the states of all the output ports are determined by the microcomputer. Also in the use of plural microcomputers, the associated danger is minimized as the program execution is initiated after the resetting is confirmed in the aforementioned manner.

The above-mentioned confirmation of resetting can also be executed only in one microcomputer. For example the confirmation of the sequence microcomputer can be executed by the control microcomputer.

Computer diagnosis circuit

Now there will be explained the microcomputer resetting circuit shown in FIG. 12, wherein a comparator Q108 is provided with two circuits Q108-1 and Q108-2. At the start of power supply of +5 V (Vcc) for the microcomputers in response to the connection to the power line or to the turning on of a service switch SW shown in FIG. 3-3, a voltage divided into approximately a half of Vcc by means of resistors RA133-2 and RA131-4 is applied as the threshold value to the negative input port of the comparator 108-1 and the positive input port of the comparator 108-2. Also the voltage Vcc is applied to the positive input port of the comparator Q108-1 through a resistor RA133-3 with a delay determined by a time-constant circuit composed of a resistor RA133-1 and a condenser C110, whereby the comparator Q108-1 receives a higher voltage at the negative input port than at the positive input port for a period of ca. 30 msec. to release a signal of 0 V from the output port thereof, which is utilized as the reset signal for the microcomputers at the turning on the power supply. A diode D119 is provided for discharge at the turning off of the power supply, and a resistor RA134-2 is connected to said comparator Q108-1 for forming a hysteresis in order to avoid erroneous operation or chattering. In this state the output of the comparator Q108-2 is turned off.

Now there will be explained the circuit for detecting the fault in the microcomputers. During normal functions of the microcomputers Q101 and Q102, the microcomputer Q102 supplies digit signals for dynamic display, and said signals are supplied as repetitive pulse signals to the trigger port of a timer integrated circuit Q135 through a buffer driver Q112 and a differentiating condenser C106. Said port also receives a bias voltage of ca. 2.5 V by resistors RA131-2 and RA131-3 and is connected to a positive clamping diode D121 as illustrated.

Said timer integrated circuit Q135 is set to a time longer than the interval of the negative trigger pulses supplied to said port, by means of resistors RA-131-1 and RA134-1 and a condenser C107 connected to the timing setting ports of said integrated circuit in the illustrated manner. Thus, in response to the trigger pulses periodically entered to the first-mentioned port, the timer Q135 supplies a voltage of ca. 5 V from an output port thereof to an input port of a hammer driver Q119 to maintain the output port at the turned-on (0 V) state.

The negative input port of the comparator Q108-2 is connected to a time-constant circuit composed of a resistor R134-4 and a condenser C115 and also is connected to the output port of said hammer driver Q119 through a resistor R116. At the start of power supply the digit signals for dynamic display are not released until the microcomputers are reset, so that the timer Q135 releases a signal of 0 V to turn off the output of the hammer driver Q119. The potential of said negative input port of Q108-2 is gradually elevated and exceeds that of the positive input port after ca. 330 msec from the start of power supply, and during this period the output port of said comparator Q108-2 is turned off. On the other hand the microcomputers are reset and start generating the aforementioned digit signals within the duration of said 330 msec. to shift the output of Q119 to ca. 0 V, whereby the negative input port of the comparator Q108-2 becomes unable to exceed a voltage obtained by dividing Vcc with resistors R134-4 and R116. Said divided voltage is selected lower than the voltage at the positive input port of said comparator 108-2 so that the output port thereof remains off as the stationary state. Now, in case the digit signals for display are terminated by a failure in the microcomputers, the output of Q119 is turned off to elevate the voltage at the negative input port of the comparator Q108-2, whereby the output thereof is turned on to ca. 0 V after ca. 200 msec. Thus the condenser C110 is immediately discharged to reduce the voltage at the input port of the comparator Q108-1, whereby the output thereof is shifted to ca. 0 V, thus generating the reset signal for microcomputers.

Said reset signal is also supplied through the diode D120 to the trigger port of the timer Q135, whereby the output thereof is shifted to 5 V to turn off the output the comparator Q108-2 with a delay determined by the discharge time constant of C115 and R116. Thus, when the resetting of the microcomputers is terminated after ca. 30 msec., the microcomputers can return to the normal function unless they have been destructed. In this manner the foregoing procedure is useful for automatic restoration of the computer functions in case of the erroneous functions of the microcomputers induced for example by extremely high external noises.

Sequence timing

Referring to FIG. 7-1, after the aforementioned resetting of the microcomputers Q101 and Q102 and the identification of the turning on of the main switch, the program execution is started to activate the fixing heater and the main motor, then to conduct the measurement and control of the surface potential, to complete the waiting cycle (step 78), to identify the entry of a copy start signal (step 79) and to set the reversing position of the optical system as shown in the steps 172–177 in FIG. 7-2 according to the entry of image magnification and of cassette size. The image magnification may be selected by the keys 59 shown in FIG. 2 designating also the cassette size, or by appropriate keys only selecting the magnifications.

Subsequently the sequence microcomputer Q101 initiates the sheet feed control according to the flow chart shown in FIG. 7-3, after initializing an internal timer for inspecting the abnormal function of the optical system.

Referring to FIG. 7-3, the sequence microcomputer Q101 step advances the sheet counter in the copier for correcting the copy count in case of a sheet jamming, then turns on the total counter 37 and the key counter 38 (step 271) and activates the sheet feed roller 11 or 12 of the selected cassette case (step 273) if the manual insert mode is not selected, whereby the total counter is actuated simultaneously with the sheet feeding. Since the upper and lower cassettes have different sheet feed paths, the sheet feeding from the upper case is achieved by two rotations of the roller while that from the lower case is achieved by one rotation of the roller. Steps 273-2 and 273-3 are related to the clutch control for the sheet feeding from the upper case.

Said sheet feed roller or pick-up roller is so constructed that it is mechanically stopped after a half turn upon switching on of the clutch and it is mechanically brought to the original position when the clutch is switched off.

Thus, in case of sheet feeding from the upper cassette, the clutch is switched on, then switched off before the roller makes a half turn, and again switched on again when the roller is in a position between a half turn and a full turn (step 274-3), whereby the roller is stopped after one and half turns. In case of sheet feeding from the lower cassette, the clutch is switched on to stop the feed roller 12 at a half turned position.

After the start of sheet feeding, the total counter 37 and key counter 38 are turned off when the upper clutch is switched off (step 273-4), and the forward clutch 22 is switched on (step 276).

The original exposure lamp is activated before the forward clutch 22 is turned on, since otherwise said lamp does not reach a sufficient light intensity by the time it enters the image area (step 274). Simultaneously the blank exposure lamp 10 for erasing black area is extinguished according to the sheet size. Then a developing sleeve 7 is rotated and an appropriate developing bias is applied thereto (step 274-0). Then a forward clutch corresponding to the selected image magnification is switched on to advance the optical system with a speed corresponding to said magnification, with a delay of 53 clock pulses determined for the first copy (step 276-0).

Figure 13:
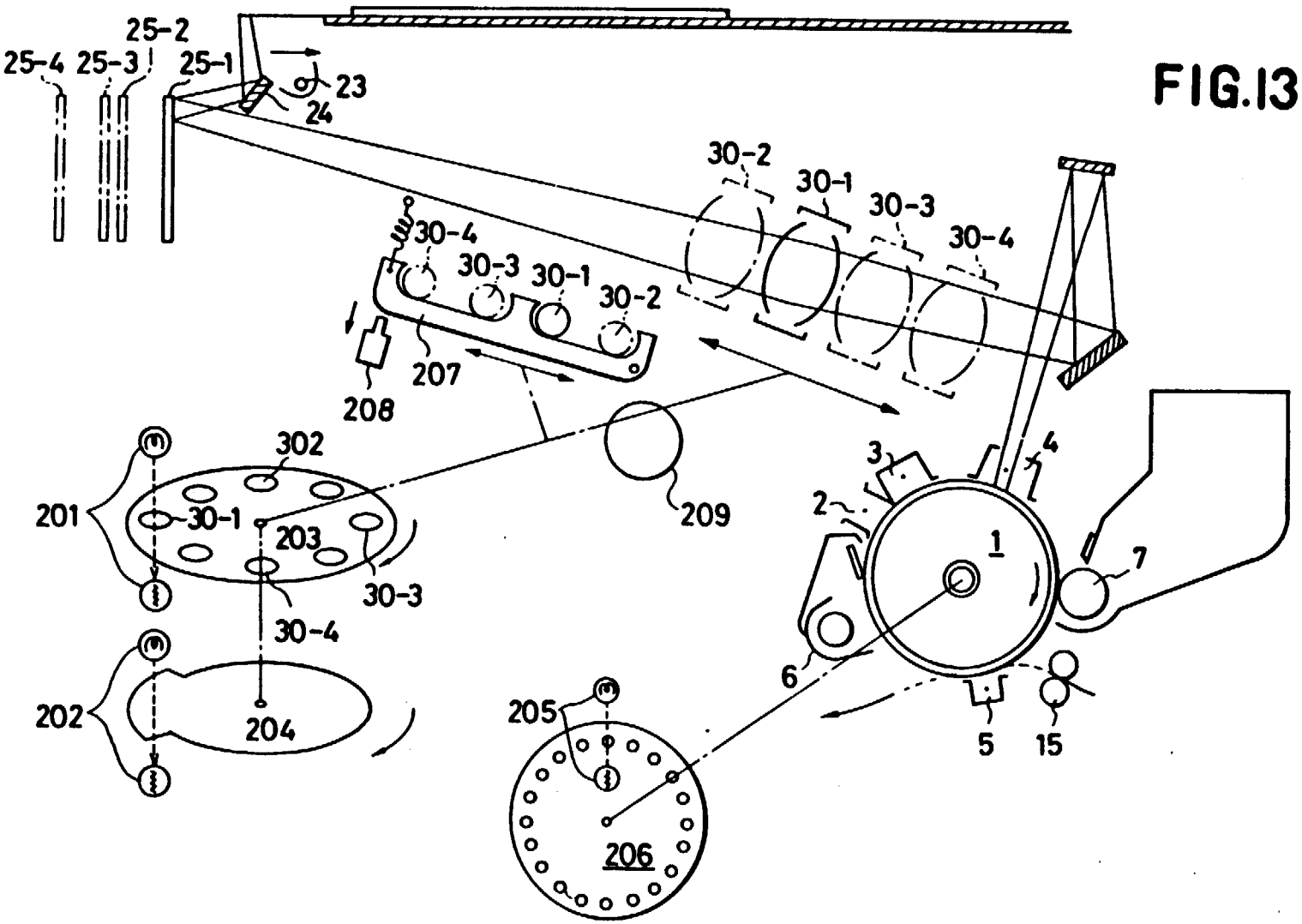
FIG. 13 is a schematic view of the scanning system and the vicinity.
Figure 14:
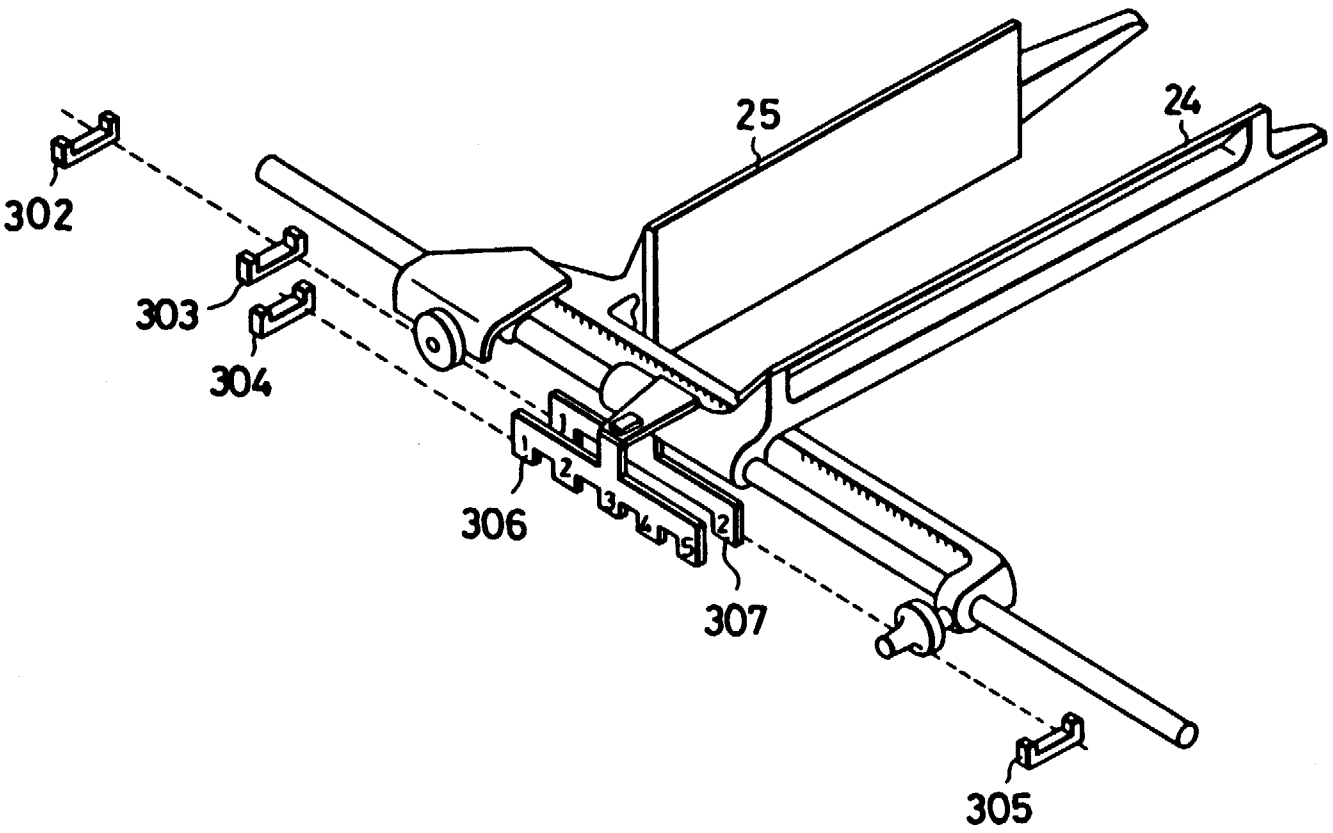
FIG. 14 is a perspective view of the scanning mechanism.

Now there will be given a detailed explanation on the novel controls on the scanning system, registration, blank and sheet feed employed in the present embodiment, while making reference to FIG. 13 showing the optical scanning system and the lens of FIG. 1 in a schematic cross-sectional view and FIG. 14 showing the scanning system in a perspective view.

Registration

As shown in FIG. 14, comb-shaped flag members 306, 307 are mounted on a support member for the first mirror 24 for integral displacement therewith, respectively for controlling the registration and the scanning system. The flag member 306 is provided with five light-interrupting teeth 1-5, while the flag member 307 is provided with two teeth. Also provided are a photointerrupter 304 for generating signals upon passage therebetween of the teeth 1-5 of the flag member 306, and photointerrupters 302, 303 and 305 for generating signals upon passage therebetween of the teeth 1, 2 of the flag member 307. The photointerrupters 302 and 303 are mutually connected electrically and commonly connected to the input port i8 (FIG. 3-1) of the microcomputer Q101, while the photointerrupters 305 and 304 are respectively connected to the ports i6 and i7.

The photointerrupters or sensors 302 and 303 are principally used for terminating the forward motion and initiating the backward motion of the optical system, while the sensor 305 is used for stopping the optical system and the sensor 304 is used for the control of registration timing.

When the first flag of the flag member 306 passes the sensor 304 after the start of the forward movement of the optical system in the aforementioned manner, the optical system is positioned at the start position of the exposure of the original image (step 276-1). At this point the registering roller 15 is stopped in order to prepare for the front end registration of the sheet (step 276-2). Then, after counting of 18 drum clock pulses by the microcomputer, the feed roller clutch previously switched on is now switched off to cause the feed roller to perform the remaining half turn (step 276-3), in order that the sheet impinging on the stopped registering roller forms a loop of an appropriate length. Thereafter the sheet is maintained in the stopped state in impinging position on said registering roller.

In the real-size copying mode, the registering roller 15 is activated upon detection of the third tooth of the flag member 306 by the sensor 304 (step 370-3). Also said activation in the first reduced copying mode takes place upon detection of the fourth tooth (step 370-1), in the second reduced copying mode upon detection of the fifth tooth (step 370-2) and in the enlarged copying mode upon detection of the second tooth (370). In this manner the timing of start of rotation of the registering roller 15 is regulated according to the sheet feeding speed and the scanning speed of the optical system which are variable corresponding to the image magnification, in such a manner that the front end of the sheet always coincides with the front end of the image on the drum.

The second to fifth teeth are confirmed by counting the pulses generated from the sensor 304 during the forward displacement of the optical system, starting from the first flag of the flag member 306. This counting operation can be achieved by providing an interruption program for said counting on the read-only memory and by connecting the output of said sensor 304 to an interruption port iNT2 of the microcomputer Q101, rather than by making a plurality of routine programs of said counting. Said interruption port iNT2 should preferably have a high priority than the interruption port iNT.

Reversing

Toward the end of the forward motion of the optical system, the teeth 1, 2 of the flag member 307 reaches the sensors 302 and 303. The optical system is reversed at three different reversing positions corresponding to the sizes A4, B4 and A3. Said sensors 303 and 302 are mutually connected to generate pulse signals upon passage of the teeth of the flag member 307 through the sensor 302 or 303.

The first and second teeth of the flag member 307 is distanced by 44 mm equal to the difference between the sizes A3 and B4, and the sensors 303 and 302 are respectively provided at the reversing positions for the sizes A4 and B4 along the path for the optical system.

The reversing position for the A4 size is defined by the passage of the second tooth of the flag member 307 through the sensor 303, while that for the B4 size is defined by the passage of the first tooth through the sensor 302, and that for the A3 size is defined by the passage of the second tooth through the sensor 302. Stated differently the 2nd, 3rd and 4th signals supplied from the mutually connected sensors 302 and 303 respectivley define the reversing positions for the sizes A4, B4 and A3. The above-mentioned procedure is represented in a step 372.

The identification of the 2nd, 3rd or 4th pulse is achieved by counting the pulses from the sensors 302 and 303 according to the input signal from the cassette of a size A4, B4 or A3.

The use of the above-mentioned two connected sensors is based on the following reason. It is also possible to define three reversing positions by a flag member having three teeth, combined with a sensor. In such case, however, the maximum distance between the teeth becomes as large as 210 mm corresponding to the difference between the sizes A3 and A4, so that the maximum moving distance of a tooth reaches (A3 +210)=430 mm, requiring a significant excess length in the scanning direction.

On the other hand, the detection of three positions by the combinations of two sensors and two teeth employed in the present embodiment only requires an excess length of 44 mm, thus enabling to compactize the copier. Also in this manner it is rendered possible to define many reversing positions with a limited number of sensors and to increase the number of reversing positions further by adding some sensors and teeth of the flag member. Furthermore it is possible to detect the undesirable overrunning of the optical system. The foregoing is applicable not only to the scanning system with the movable optical system but also to the scanning system in which an original carriage performs reciprocating motion while the optical system is fixed.

Blank exposure lamp and original exposure lamp

The reversing is controlled in the above-mentioned manner regardless of the image magnification, but it is possible to reduce the time required for copying and to peactically the speed of repetitive copying in case of the half-size copying in the reduction mode because of the scanning speed is different.

Subsequent to the detection of the reversing position, the function of the aforementioned timer for detecting abnormality in the optical system is cancelled (step 372-1) and the blank exposure lamp is lighted in advance (step 372-2) in order to stabilize the function of said lamp. In the real-size copying mode the forward clutch 22*a* is turned off and the backward clutch 22*b* is turned on after counting 3 drum clock pulses from the turning on of the blank exposure lamp (step 373).

Also in the reduced copying mode the forward clutch 22*a* is turned off and the backward clutch 22*b* is turned on after the counting of 3 drum clock pulses from the detection of the reversing position (step 372-3), and the original exposure lamp 23 is turned off after further 5 clock pulses (step 373-1). In this manner the original exposure lamp 23 is still lighted in the initial period of the reversing motion.

In this manner the original exposure and the blank exposure partially overlap each other to achieve black erasure or to avoid copying of the marginal area around the original image in the reduced copying mode. Said overlapping is also effective in cancelling the eventual unevenness in the erasure resulting form he uneven intensity of small lamps used for this purpose. It is also possible to reduce the intensity of the exposure lamp to ca. ½ from the reversing point or from the end of image exposure prior to said reversing until said lamp is turned off, in order to decrease the damage to the lamp caused by the shock at the reversing.

Repeated sheet feeding and stopping at home position

The preparation for the next sheet feeding is made (step 373-3) at the passage of the second tooth of the flag member 307 through the sensor 303 at the reversing of the scanning system. Although according to the flow chart this operation is executed 13 clock pulses after the reversing, it is in face executed simultaneously with the start of the reversing motion. For any size the sheet feed timing is determined by the aforementioned pulse counting through the combination of the sensor 303 and the flag member 307, thereby forming a determined amount of loop in front of the registering roller for all the sizes. Then confirmed is the copy start data (digit 2 in ST2 shown in FIG. 10) serially transferred from the control microcomputer Q102 in order to identify if the copying operation is to be continued (step 374). Said data are released from a copy counter provided in said microcomputer Q102 and are shifted to zero when the copy count increases to the preselected copy number, thus advising that the copying operation is not longer continued. Said counter is step advanced upon detection of the aforementioned reversing by the serial data (digit 1 in ST2) from the sequence microcomputer Q101 to the control microcomputer Q102.

Upon completion of said counting the program shown in FIG. 7-5 is executed, and, upon arrival of the optical system at the home position, the sensor 305 detects the second tooth of the flag member 307 to turn off the backward clutch 22*b* to stop the optical system (step 470), in case of the reduced or enlarged copying mode (step 468). On the other hand, in case of the real-size copying mode the backward clutch 22*b* is turned off in advance upon detection of the first tooth of the flag member 306 by the sensor 304, and the optical system is thereafter displaced to the home position by inertia. Said detection is achieved by counting 5 pulses from said sensor 304 during the reversing motion (step 469).

The process speed, and, thus the speed of the optical system at the reversing motion, are made different in the real-size copying and the reduced or enlarged copying. For this reason in the reduced or enlarged copying mode the optical system causes little shock even if the backward clutch 22*b* is switched off after the home position is detected, but in the real-size copying mode such switching causes the collision of the optical system with a stopper positioned behind the home position, and the above-mentioned switching off in advance prevent such trouble.

After the repeated copying operation is confirmed in the step 374 shown in FIG. 7-4, the program returns to the flow shown in FIGS. 7-2 and 7-3 to repeat the same sheet pick-up control as in the first copying cycle. However, for the second copy and thereafter the routine after a step 274-4 shown in FIG. 7-3 becomes different. Steps 274-4 to 275-1 are same as the routine for switching off the backward clutch for the optical system shown in FIG. 7-5, performing control according to the selected image magnification.

After the detection of the home position (step 275), the forward clutch 22*a* is again switched on (step 276) to control the registering roller and the feed rollers in the aforementioned manner.

Since each cycle of the optical system takes approximately 4 seconds, the timer A initialized at the sheet feeding never counts beyond 4 seconds. Thus a timer count beyond 5 seconds indicates an abnormality in the optical system, in which case the process loads such as the fixing heater, high-voltage supply, main motor etc. other than display are immediately turned off to terminate the copying operation and a display is given indicating an abnormality in the optical system. These functions are executed in a step 598 in FIG. 7-6.

In this case said routine of stop and display is repeated unless the main switch is cut off.

In the real-size copying mode, however, in case said timer A counts ca. 1 second from the turning off of the backward clutch in the reversing motion or 4 seconds from the start of sheet feeding (step 275-2), the backward clutch 22*b* is again switched on to bring the optical system to the home position (step 275-3) in consideration of the possible loss in inertia due for example to an increased friction on the rail supporting the mirror. Then if the optical system does not reach the home position after the lapse of 5 seconds from the start of said timer A, the copying operation is interrupted and a display for abnormality is given in the manner as explained in the foregoing (step 275-4). Said timer A is cleared at the detection of the home position.

In this manner there is provided a safe and highly precise copier.

The sub-routine shown in FIG. 7-6, provided in each closed loop in FIG. 7, performs step decrement of the aforementioned sheet counter in the copier in response to a signal from the ejection sensor 18 (FIG. 1) upon ejection of a sheet. By said counter it is possible to know the number of sheets remaining in the copier when it is stopped by a jamming or an abnormality in the optical system, and said number is stored in the random access memory as the power supply for display and microcomputers is maintained even when the copying operation is interrupted, and is subtracted from the copy count for display in such interruption. In case the main switch is turned off (step 608) during said interruption, said number and the display are cancelled since the random access memory clearing step is executed as shown in FIG. 7-1. It is however possible also to continue said memory and display by a timer only in such interruption even after the main switch is turned off and to automatically turn off said memory and display thereafter, by providing an internal timer function corresponding to said timer between the steps 608 and A in the routine I1 shown in FIG. 7-6. Said timer and the time thereof can be selected same as the automatic shut-off timer and the time thereof (step 572) shown in FIG. 7-5.

When the repeated copying operations are completed and the optical system is stopped at the home position as shown in FIG. 7-5, the developing bias and the high-voltage transformers are turned off (step 570) after counting after 64 drum clock pulses, then the high voltage for the secondary corona discharge is reduced after further 90 clock pulses, and said high voltage is turned off after further 169 clock pulses. Then, upon detection of the ejection of the rear end of the sheet from the ejection sensor (step 570-1) the main motor and the blank exposure lamp are turned off and the stand-by timer is started by corresponding serial data transferred to the control microcomputer Q102. In case the copy start key is thereafter actuated, the sequence microcomputer Q101, in response to data indicating the lapse of 2 hours from the control microcomputer Q102, forcedly turns off the main switch by a plunger CIL1 shown in FIG. 3-3. Upon identification of the turning off of the main switch, the sequence microcomputer Q101 turns off the regulators VR1, VR2, thus deactivating all the loads including the display.

In case the copy start key is actuated before the lapse of 2 hours, the routine B or C shown in FIG. 7-1 is executed according to whether said actuation is within 60 seconds from the turning off of the main motor, thus restarting the copying operation.

The data for example indication an abnormality in the optical system are transferred serially to the control microcomputer which provides a corresponding error display on the display unit 68.

The drum clock pulses are generated by a disk shown in FIG. 13 and integrally rotating with the drum 1 and a photointerrupter 205, and the sequence microcomputer Q101 identifies if the intervals of said clock pulses are normal according to a routine I2 shown in FIG. 7-6 for taking measures similar to those in case of an abnormality in the optical system.

However, upon detection of a failure in the thermistor for measuring the temperature of the fixing roller and thus controlling the power supply thereto, the sequence microcomputer Q101 executes a different process in order to ensure the safety of the system. More specifically, as shown in the routine I0, the microcomputer repeats NOP steps after executing the turning off control as explained in the foregoing, thus electrically locking the copier in order that the program does not return to the initial routine even when the main switch is turned off. It is therefore easily identifiable, even without the display, that there exists an extremely dangerous trouble since the copier does not return to the initial step unless the power connector is disconnected.

Lens setting

Figure 15:
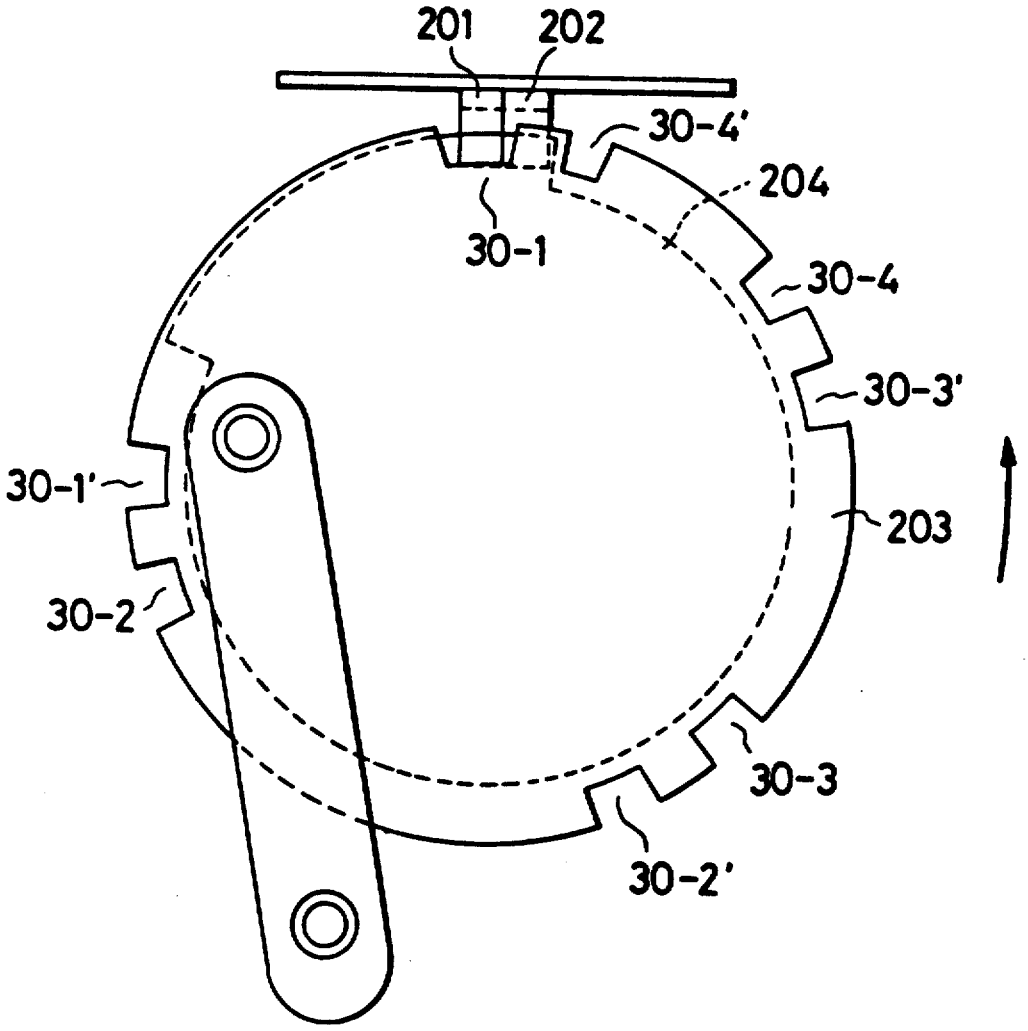
FIG. 15 is a plan view of the lens control disk.

Now reference is made to FIG. 13 showing the optical system and lens in a schematic cross-sectional view, FIG. 15 showing a lens control element in a plan view and FIGS. 16-1 and 16-2 showing a control timing chart therefor, of which functions will be explained according the flow chart for lens displacement control by the control microcomputer Q102 shown in FIG. 6-4.

In FIGS. 13 and 15 there are shown coaxial disks 203, 204 for detecting the position of the lens 30 and rotated corresponding to the lens displacement among the positions 30-1 to 30-4; photointerrupters 201, 202 respectively for detecting apertures or notches on said disks 203, 204 to generate signals and respectively called the counter sensor and real-size copying sensor, wherein the signals from the sensor 201 are counted by the microcomputer Q102; a locking plate 207 for blocking the movement of the lens; a plunger 208 for releasing said locking plate by attracting the same in a direction indicated by arrow; and a clutch 209 for causing the lens displacement and the rotation of the disks 203, 204 and linked to the main motor for drum drive. Notches 30-1 to 30-4 provided on the disk 203 as shown in FIG. 15 respectively correspond to the lens positions shown in FIG. 13, and a protruding portion on the disk 204 corresponds to the real-size lens position 30-1.

The lens displacement is conducted in the order of positions 30-1 for real-size copying, 30-4 for the second reduced copying, 30-3 for the first reduced copying and 30-2 for enlarged copying.

In the real-size copying position of the lens, the sensor 201 faces the notch 30-1 of the disk 203, and the sensor 202 faces said protruding portion of the disk 204 as shown in FIG. 15.

Now there will be an explanation on the procedure of displacing the lens to the real-size copying position from an another position in which reference is also made to FIG. 16-1.

In the routine shown in FIG. 6-4 executed in a step 74 etc. of the control flow chart of the control microcomputer shown in FIG. 6-1, the lens lock releasing plunger 208 is at first energized (step 74-1) to enable the lens displacement. Then a timer TB for measuring the time required for the descent of the lens locking plate 207 is cleared and started for a set time T1 of 200 msec. (step 74-2). Also prior to said setting the aforementioned timer TA (7 sec.) for detecting the abnormality in the lens displacement is also started. After the lapse of said time T1 a lens displacing clutch 209 is switched on to initiate the lens displacement (step 74-3). As the real-size copying mode is not designated, the following procedure is executed by sensing a real-size flag (step 74-4). When the lens approaches the real-size copying position, the sensor 202 is shielded by the protruding portion of the disk 204 to release an H-level signal, in response to the leading end thereof (step 74-5) the microcomputer Q102 sets a number "7" in a counter area provided in the random access memory and deactivates the plunger 208, thereby lifting the locking plate 207 in order that the lens does not travel beyond the real-size copying position (step 74-6). Upon completion of said locking operation, the signal from the sensor 201 is identified (step 74-7). At said completion the sensor is just freed from the shielding by the disk 203. Stated differently the lens is at the real-size copying position exactly at the changeover from said shielding. Since the sensors 201 and 202 are connected as shown in FIG. 3-3, the steps 74-5 and 74-7 can be executed by inspecting the level change at the input port.

However, if the lens displacing clutch 209 is turned off at this point, the sensor 201 positioned now at the brim of the aperture of the disk 203 may be displaced from said aperture by reaction of the disk at the stopping.

For this reason a timer TB is set to a ca. 900 msec. (T2) (step 74-8) and the lens clutch is turned off after a delay of said time (step 74-9), thereby securely fixing the lens in the real-size copying position. The foregoing procedure is conducted regardless of the lens position prior to the displacement, and independent from the lens counter. Thereafter the program returns to the main flow shown in FIG. 6-1.

Now there will be given an explanation on the procedure of changing the lens position from the real-size copying to the second reduced copying, while making reference also to FIG. 6-2.

The lens displacement is initiated by switching on the locking plunger 208 and the clutch 209 in succession in the same manner as in the displacement to the real-size copying position. At the next aperture 30-4' of the disk 203 the signal from the sensor 201 is again shifted to the L-level indicating that the lens is positioned immediately before the position for the second reduced copying, whereby the plunger 208 is turned off as a preparation for stopping the lens.

This is achieved by step advancing the counter from the previously set value "7" to "8" at the trailing end of the signal from the sensor 201 corresponding to the aperture 30-1 (step 74-10), then further step advancing said counter from "8" to "1" corresponding to the aperture 30-4, and executing the locking operation (step 74-6) upon identification of said counter shift (step 74-11).

When the succeeding aperture 30-4 is detected the lens arrives at the second reduced copying position, so that the clutch 209 is turned off through the timer TB after the lens locking operation is confirmed in the same manner as explained in the lens displacement to the real-size copying position (step 74-9).

Also the displacement and fixing of the lens to the first reduced copying position from the real-size copying position is conducted by turning off the plunger 208 upon detection of the third aperture 30-3' by the sensor 201 and turning off the clutch upon detection of the fourth aperture 30-3. This is achieved by step advancing the counter at each signal from the sensor 201 and detecting that said counter a value "3" (step 74-12).

Furthermore the lens displacement from the real size copying position to the enlarged copying position is similarly achieved by utilizing the fifth and sixth apertures 30-4' and 30-4 and detecting the counter value "5" (step 74-13) as shown in FIG. 16-2.

On the other hand, in case of the lens displacement from the second reduced copying position to the enlarged copying position, the aperture 30-4' and 30-4 for said position are respectively third and fourth from the second reduced copying position. In such case a number "2" is already set in the lens counter so that the preparation for stopping the lens is conducted when the lens counter reaches "5" after increment by 3 counts obtained from the sensor.

Other displacements are conducted in a similar manner.

In this manner the present embodiment not only enables control for displacement and fixing of the lens with a simple structure but also allows direct switching from the first reduced copying position to the second reduced copying position or to the enlarged copying position without complicated manual operation going through the real-size copying position.

Although the present embodiment employs two disks 203 and 204, it is also possible to provide the disk 203 with an optically or magnetically detectable concentric track for providing the signals from the sensor 202. Also such method is applicable to the displacement and fixing of color filters and developing devices in a color copier or to the setting of mirrors 24, 25 if required in the copying with a modified magnification.

In case the routine shown in FIG. 6-4 is still in execution, i.e. the lens is not yet fixed at the desired position after the lapse of 7 seconds from the energization of the locking plunger 208, the program is shifted to the routine X (step 74-14) to set data indicating the abnormality of the lens in the register for serial transfer to the sequence microcomputer (step 74-15), to control the display segments a-g for displaying "E0" on the display unit 68, and to latch said state until the main switch is turned off. In response to said data the sequence microcomputer interrupts the copying operation. Upon turning off of the main switch the random access memory and the input/output ports are cleared and the program proceeds to the routine (step 63) for identifying the turning on of the main switch shown in FIG. 6-1 and reaches a stand-by state. Consequently a temporary trouble in the execution of the program can be resolved by turning on the main switch again and repeating the change in the image magnification.

Also the lens timer TA can be started in synchronization with the entry of request for the real-size copying lens position from the sequence microcomputer (for example step 67 in FIG. 6-1) or the actuation of the copy start key.

Total counter

In the following there will be given an explanation on the function of the total counter for cumulatively counting the number of copies, while making reference to FIG. 17, wherein a key counter CNT1 is insertable and extractable by a user for counting the number of copies for each user and is adapted to give a count for each copy regardless of the sheet size.

A total counter CNT2, an L-counter CNT3 and an S-counter CNT4 are firmly fixed to the copier and utilized for calculating the copy fees, wherein the total counter CNT2 gives a count for each copy regardless of the sheet size while the L-counter CNT3 gives a count for each copy of a large-sized B4 or A3 size, and the S-counter CNT4 gives a count for each copy of a small sheet of A4 size or smaller.

In response to a copying of a small size, the microcomputer Q102 releases an H-level signal SCNTD to turn on transistors Q201 and Q202 through a resistor R206 thereby driving the counters CNT1, CNT2 and CNT4.

Also in response to a large-sized copying, the microcomputer Q102 releases an H-level signal LCNTD to turn on transistors Q203 and Q204 through a resistor R208 thereby driving the counters CNT1, CNT2 and CNT3 (step 271 in FIG. 7-3). A diode D205 is provided for synchronizing the functions of the counters CNT1 and CNT2, and diodes D207 and D208 are provided for forming an OR circuit for the small-size drive signal and the large-size drive signal to drive the counters CNT1 and CNT2, and diodes D206 and D209 are provided for detecting the absence of the key counter.

In case the key counter CNT1 is removed prior to the actuation of the copy start key, the power of 24 V supplied through said key counter to the counters CNT2, CNT3 and CNT4 are cut off to shift a key counter signal CCNTi to the L-level in response to which the microcomputer Q102 forbids the entry of the copy start signal.

Also in case the key counter is removed during a copying operation, there is reached a state identical to after the completion of the copying operation of the preselected number of copies (step 76-1 in FIG. 6-1).

Also since the power supply to sheet feed solenoids SL1, SL2 of the upper and lower sheet feed rollers is realized through said key counter, the removal thereof after the start of copying operation terminates the function of said solenoids, thus hindering proper sheet feeding. In this manner normal copies cannot be obtained in the improper use of the key counter.

Diodes D201, D202, D210 and D211 are provided to absorb inverse potential when the solenoids and the counters are driven, thus protecting the drive elements.

Also in case the key counter is removed after the sheet feed solenoid SOL1 etc. is activated subsequent to the actuation of the copy start key, the sheet feeding is interrupted while the sheet is still present at the feed roller since the power supply to said solenoid is interrupted. Consequently the copies cannot be improperly obtained even in case the key counter is step advanced after the completion of the sheet feeding.

If the key counter is again mounted and the copy start key is actuated in the above-mentioned state of interrupted sheet feeding, the suspended sheet restarts advancement without jamming at the determined timing, and is properly fed by the registering roller for image transfer.

Also in case of an interruption copying mode, the insertion of the key counter (step 76-1) cancels said mode (step 82) to restore the prior copying mode and to enable key entry (step 77). Also the aforementioned 60-second and 2-hour timers are started.

In this manner the present embodiment is particularly effective in case the signal indicating the state of the key counter is supplied to the microcomputer for sequence control.

Furthermore, in case the key counter is removed after it is step advanced, the copying cycle is continued until completion and the succeeding cycle is suspended.

Temperature control circuit

Figures 18, 19:
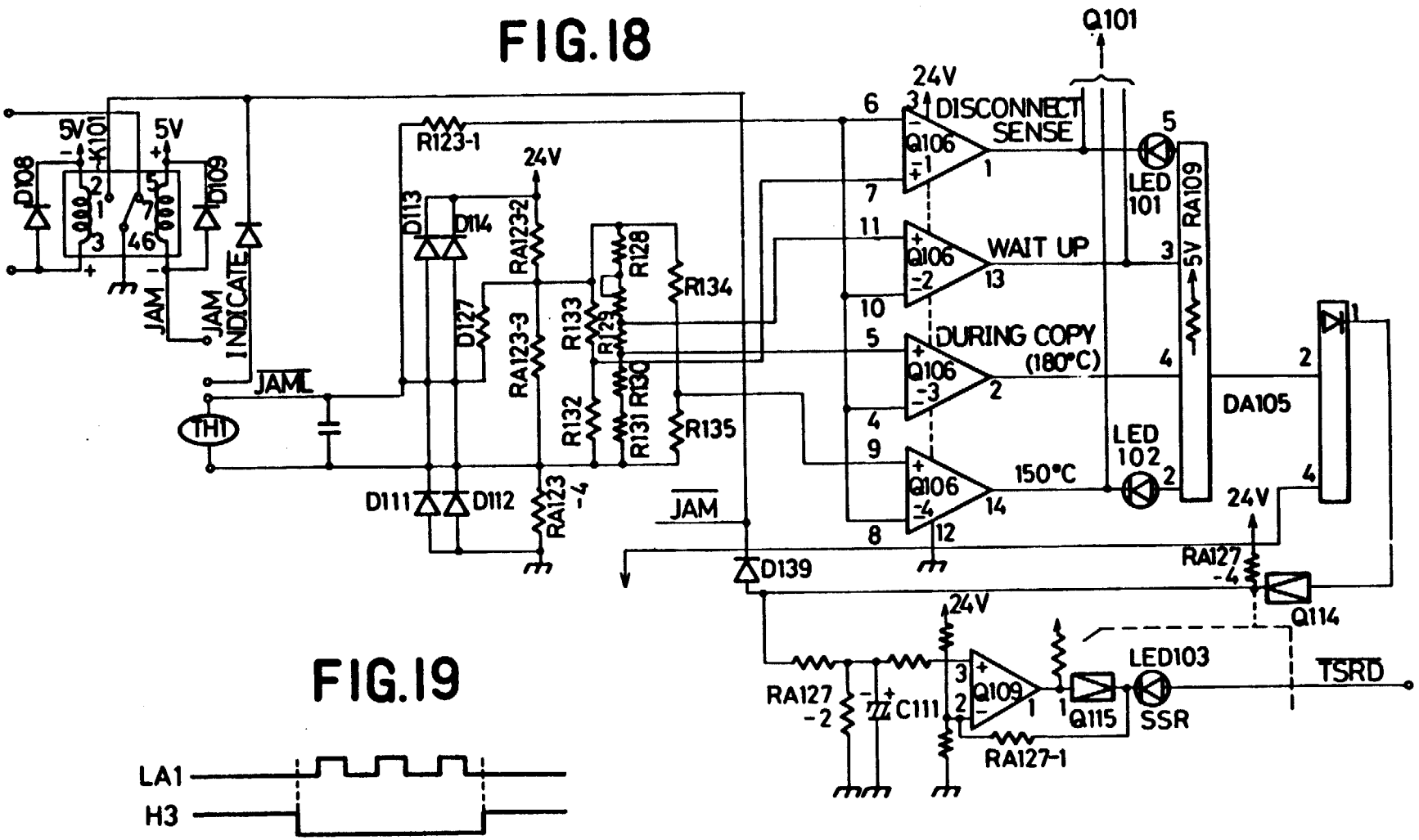
FIG. 19 is a timing chart showing the function of the circuit shown in FIG. 18.

Now reference is made to FIG. 18 showing a temperature control circuit for the fixing heater, wherein a comparator Q106 is provided with independent four circuits Q106-1 to Q106-4, and a thermistor TH1 is positioned in contact with or in the vicinity of the fixing rollers to detect the temperature thereof. Said thermistor shows a higher resistance at a lower temperature.

The comparator Q106-1 is connected to a first bridge circuit composed of the thermistor TH1 and resistors R127, R133 and R132 to provide an output voltage of ca. 0 V in case said thermistor TH1 does not exceed ca. 50° C. or has a failure thereby turning on a light-emitting diode LED101 and transmitting to the microcomputer Q101 the information of the low temperature or the failure in the thermistor, said information being identified in a step 596 shown in FIG. 7-6.

The comparator Q106-2 is connected to a second bridge circuit composed of the thermistor TH1 and resistors R127, R128, VR102, R129, R130 and R131 to provide an H-level signal in case said thermistor is of a temperature exceeding 170° C. thereby transmitting to the microcomputer Q101 the information of the sufficiently high temperature, which is identified in a step 73-1 shown in FIG. 7-1.

Figure 17:
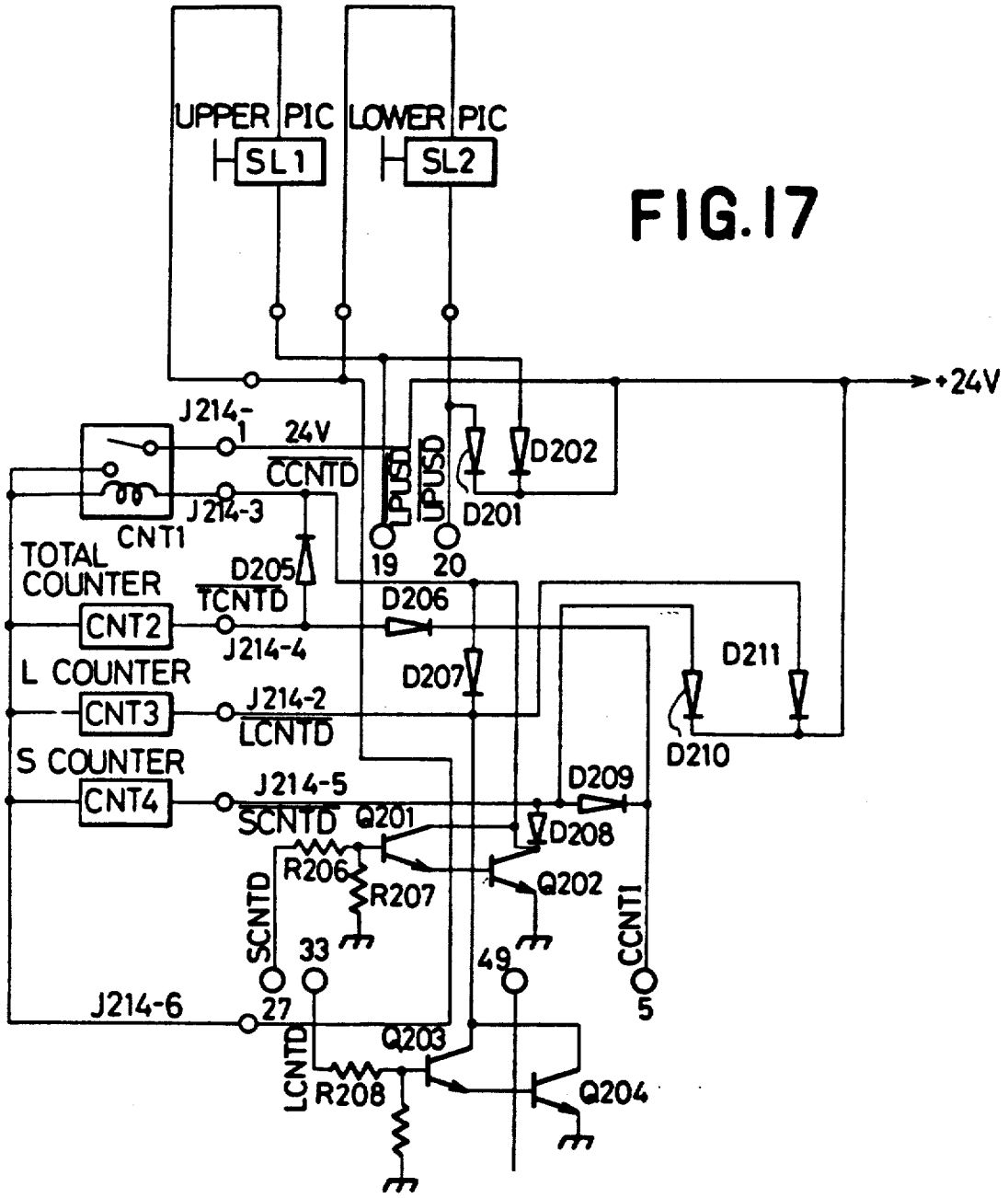
FIGS. 17 and 18 are diagrams showing other embodiments of the control circuit.

The comparator Q106-4 is connected to a bridge circuit composed of the thermistor TH1 and resistors R127, R134 and R135 to provide an L-level signal in case said thermistor indicates a temperature not exceeding 150° C. thereby turning on a light-emiting diode LED102 and transmitting to the microcomputer Q101 the information of a fixing roller temperature not exceeding 150° C., which is identified in a step 71 shown in FIG. 17-1.

The comparator Q106-3 is connected to a bridge circuit composed of the thermistor TH1 and resistors R127, R128, VR102, R129. R130 and R131 to provide an H-level signal in case said thermistor indicates a temperature exceeding 180° C. There are also provided a noise absorbing condenser C126 connected parallel to the thermistor TH1; protecting diodes D113, D114, D111 and D112; a protecting resistor R123-1 for the comparators Q106; and resistors R123-2, R123-4 and R123-3 constituting a constant current source for supplying a stable electric power to the thermistor TH1 and to the aforementioned bridge circuits.

In case the fixing roller does not exceed 180° C., the comparator Q106-3 provides an L-level output to give an H-level output signal from a driver Q114, thus charging a condenser C111 through a resistor RA126-4. Also Q109 provides an H-level output while Q116 provides an L-level output. A resistor RA127-1 constitutes a positive feedback circuit for supplying the output of Q116 to the inverted input port of the comparator Q109.

The L-level output signal from Q116 activates a light-emitting diode LED103 and turns on the fixing heater through a control SSR. THen when the fixing roller exceeds 180° C., the comparator Q106-3 provides an H-level output to turn on Q114, thereby discharging the condenser C114. Thus the non-inverted input port of the comparator Q109 receives is reduced to release an L-level output therefrom, thus turning off Q116 and SSR to deactivate the fixing heater. In this manner the fixing roller is constantly maintained at 180° C. by the on-off control of the heater.

At the start of power supply the comparator Q106-3 causes the comparator Q109 to turn on the heater, but the output of Q109 is not immediately shifted to H-level because of the presence of a time-constant circuit composed of resistors RA126-4, RA127-2 and a condenser C111. In this manner the surge current after the start of power supply can be prevented.

Also said time-constant circuit prevents noises and rapidly repeated on-off action of the heater in the vicinity of 180° C.

In case of a jam detection a relay K101 is energized to retain the contact thereof to the side 1 by an output signal from the output port 05 shown in FIG. 3-1. Said relay K101 is a latching relay so constructed that the contact thereof is mechanically retained when once energized and is reset by the energization of another coil. Thus, in case of sheet jamming the contact of said relay 101 is retained at the side 1 until said jamming is reset to discharge the condenser C111 through a diode D133 and a resistor R126-4, whereby the comparator Q109 releases an L-level signal to turn off the fixing heater. In this manner an overcurrent is prevented due to the absence of abrupt switching off at the sheet jamming. Also a surge current can similarly be prevented by the condenser C111 at the re-start of the copying operation after the sheet jamming is resolved.

Also in case of an abnormality in the microcomputer Q101 or Q102, Q114 is turned on through a diode DA105 to switch off the fixing heater in the aforementioned manner.

As explained in the foregoing, the fixing heater control circuit of the present embodiment is capable of stably controlling the fixing rollers at 180° C. and to automatically turn off the fixing heater with a sample circuit in case of an abnormality in the control system or of sheet jamming. Besides it is possible to safely execute detailed control for the waiting cycle and for optimum sequence as shown in FIG. 7-1 since the signals representing the heater temperature are supplied to the microcomputer for identification of the heater status.

Now there will be explained the AC drive control circuit shown in FIG. 3-3, wherein the commercial line power is supplied through a plug P1 and a noise filter LF1 to a service switch SW1 which is provided for shutting off all the power supply at the maintenance service. From said switch SW1 the power is supplied through a circuit breaker CB-1 to a power transformer T2 of which low-voltage AC output is supplied to a DC power supply circuit shown in FIG. 11 for obtaining a power of DC 5 V. Also from said switch SW1 the power is supplied through door switches MS1, MS2, a circuit breaker CB2 and a photo-SCR Q309 in an AC driver circuit 300 to a drum heater H1 for maintaining the temperature of the photosensitive drum.

An exhaust fan FM1 for removing the heat from the fixing station, and transformers T1 and T3 are powered through a switch SW2 (502), and said transformer T1 alone is powered through a circuit breaker CB3. The output from said transformer T1 is rectified by a diode bridge D1 and is supplied as DC current to the DC power supply circuit shown in FIG. 11. Also said transformer T3 functions as the power source for an unrepresented document feeder. A web motor M2 for gradually winding a cleaning web maintained in contact with the fixing roller for removing the developer deposited thereon, a blower motor FM2 principally for cooling the original carriage glass and a conveyor fan FM3 principally for maintaining the copy sheet in contact with the conveyor belt during the transportation of said copy sheet from the image transfer station to the fixing station, are mutually connected parallel and are driven by a solid-state relay Q306 in the AC driver circuit 300 during the copying operation.

The original exposure lamp LA1 is connected at a terminal thereof to a power supply line through a temperature fuse FU2 and at the other terminal to a normally open contact of a relay K301. Also the lower heater H3 provided principally for maintaining the temperature in the fixing station is connected at a terminal thereof to a power supply line through a temperature fuse FU2 and at the other terminal to the normally closed terminal of said relay K301, of which the common terminal is connected to the other power supply line through a triac Q-C1 provided in an AC constant voltage regulating unit CVR1. The above-mentioned circuit functions to prevent the increase in the total power consumption by simultaneous lighting of the heater He and the lamp LA1, to protect the contacts of the relay K301 by switching the same only when the triac Q-C1 is turned off, and to stabilize the voltage supplied to LA1 and to H3 with a single voltage regulating unit CVR1. The lower heater H3 and the upper heater H2 respectively heat the lower and upper fixing rollers, on which provided is the thermistor TH1 for temperature detection and control by a solid-state relay Q1 switched according to the signal from the comparator Q109 as explained in the foregoing. In the vicinity of the upper roller there is provided a temperature fuse FU1 wired as shown in FIG. 3-3 to prevent an excessive temperature, but such control and protection are not provided for the lower roller in consideration of the cost. For this reason the heater H3 has to be of a low nominal power having a sufficient temperature margin in consideration of the eventual fluctuation in the power supply voltage and in the heater itself, but the aforementioned power supply circuit to said heater H3 compensates this drawback and allows to use a high-powered heater as long as it does cause damage to the rollers. In this manner there can be achieved a very high efficiency. Moreover this circuit allows automatic power control responding to the room temperature and other factors, utilizing a fact that the output voltage itself from the regulating unit CVR1 is controllable as will be explained in the following.

The AC constant voltage regulating unit CVR1, of which structural details are omitted, receives potentials +24 V and 0 V respectively at the terminals 1 and 2 thereof and provides, by phase control function of the triac Q-C1 therein, a constant effective voltage of 50 V in response to a DC voltage not exceeding 10 V received at the terminal 5, or a constant effective voltage of 80 V in response to a DC voltage higher than 16 V, or an effective voltage varying linearly in a range from 50 V to 80 V in response to a DC input voltage from 10 to 16 V, whereby the current supplied to the coil of the relay K301 for switching the lamp La1 and the heater H3 is controlled in relation to the voltage supplied to the regulating unit CVR1. Also the aforementioned thermistor TH1 is connected through two terminals J51-2 and J51-5 in order to reduce the probability of incomplete contact. In synchronization with the turning off of the regulating unit CVR the microcomputer Q101 releases a signal LHSRD for switching the heater and lamp. For a determined period before and after the changeover of the relay K301 the CVR is turned off as shown in FIG. 19 to prevent an excessive surge current in said relay. Also in case the heater has to be powered during the lamp is lighted, it is possible in this manner to prohibit to turning on the heater or switching thereof during the function of the lamp.

We claim:

1. A copier with variable magnification capability, comprising:

input means for setting a desired image magnification;

means for displacing an optical system to a determined position in accordance with said input means setting, wherein said position determines the size of a reproduced image;

said displacing means having means for detecting a reference position of said optical system and means for detecting the position of said optical system correspondingly to the magnification set by said input means; and timer means to be started in synchronism with the start of displacement of said optical system or with the entry of a signal for said displacement; wherein an error signal is generated, when said detection means does not detect the arrival of said optical system at the position corresponding to the set magnification even after the lapse of the time set by said timer means.

2. A copier with variable magnification capability according to claim 1, further comprising means for displaying a failure indication in response to said error signal when the displacement of said optical system takes more time than that of said timer means.

3. A copier with variable magnification capability according to claim 1, further comprising means for compulsorily terminating the displacement of said optical system in response to said error signal when the displacement of said optical system takes more time than that set by said timer means.

4. A copying apparatus, comprising:

means for forming an image on a material that comprises a rotatable medium on which an image to be transferred is formed;

input means for setting a desired image magnification;

means for displaying an optical system including an optical lens to a determined position which corresponds to the desired image magnification input by said input means, said position determining a size of a reproduced image;

means for issuing an error signal when said optical system does not reach said determined position within a predetermined period after the start of the displacement of said optical system to said determined position;

means for operating said displacing means during a predetermined period of a preliminary operation prior to the image forming cycle after a start instruction for image formation, said preliminary operation including a pre-preparing operation for stabilizing said rotatable medium;

said operating means being adapted to execute an operation of said displacing means and said pre-preparing operation of said rotatable medium in parallel, said pre-preparing operation being a pre-rotation of said rotatable medium; and means for inhibiting the start of said image forming cycle in response to the error signal.

5. A copying apparatus according to claim 4, wherein said rotatable medium and said optical system are driven by the same driving source.

6. A copying apparatus according to claim 4, further comprising means for changing a control of said preliminary operation in accordance with modified image magnification.

7. A copying apparatus according to claim 4, further comprising scan means for illuminating and scanning an original to reproduce an original image onto said rotatable medium, and control means for initiating a scan operation by said scan means successively after said optical system reaches a position according to a desired magnification.

8. An apparatus according to claim 4, further comprising an instruction key for instructing the start of a copying operation regardless of the selected image magnification, wherein said means for operating is responsive to the instruction from said instruction key.

9. A copying apparatus, comprising:

process means for forming on a copying material an image of a size different from that of an original;

input means for selecting an image magnification;

first control means for controlling said process means for conducting the copying operation at an image magnification selected by said input means;

means for detecting the size of the copying material;

means for comparing the size of the copying material detected by said detecting means with a size of an image reproduced at the image magnification selected by said input means;

second control means associated with said comparing means for conducting the copying operation even when the size detected by said detecting means is different from the size of the reproduced image formed with said image magnification; and display means responsive to the comparison result by said comparing means for displaying that said detected size and said size of the reproduced image size are different from each other.

10. A copying apparatus according to claim 9, wherein said display means statically displays said detected size and flashes a size of copying material suitable for said size of the reproduced image, when said detected size is different from said size of the reproduced image.

11. An apparatus according to claim 9, further comprising an instruction key for instructing the start of a copying operation regardless of the selected image magnification, wherein said process means is controlled to conduct the copying operation on the basis of the instruction from said instruction key.

12. A copying apparatus, comprising:

plural process means for forming an image of an original at a modified image magnification on a recording member, said process means including an optical system adapted for effecting a variable magnification copying;

instruction means for instructing a start of a copying operation;

first manual input means for selecting said image magnification;

second manual input means for selecting the number of copies; and means for controlling said process means for executing the copying operation according to the input data entered by said first and second input means, said control means controlling said optical system to set at a position corresponding to the inputted image magnification after instruction of the start of the copying operation by said instruction means;

wherein the time period allowing a change in the image magnification to be entered by said first input means is different from the time period allowing a change in the copy number to be entered by said second input means, modification of magnification by said first input means is prohibited after operation of said instruction means, and the change in the copy number to be entered by said second input means is allowed before said optical system is set at the position corresponding to the inputted image magnification.

13. A copying apparatus according to claim 12, wherein said process means includes a movable lens, and wherein a copying sheet number changes by the second input means is prohibited when the copying operation starts and said lens reaches a predetermined position.

14. A copying apparatus, comprising:

process means for forming on a copying material an image of a size different from that of an original;

input means for selecting the image magnification;

executing means for operation, during interruption of a copying operation of a first magnification, for executing another copying operation of a second magnification entered from said input means and enabling, after the completion of said other copying operation, the execution of the remainder of the copying operation of the first magnification;

control means for completing said remainder of the copying operation by providing copying material from a storage unit to complete the copying operation of said first magnification even when a size of copying material of the storage unit for the remainder of the copying operation of said first magnification after said interruption is different from the size of the copying material used during the copying operation of said first magnification before said interruption; and display means for displaying a size of copying material of the storage unit mounted on said copying apparatus, either before or after said interruption.

15. A copying apparatus according to claim 14, wherein said first-mentioned copying operation is a reduction or enlargement of the original and said another copying operation is an enlargement or reduction of the original.

16. A copying apparatus according to claim 14, further comprising display means adapted to display magnification information, and to interrupt the display of information associated with the copying operation of said first magnification during said other operation, and to restore said display upon completion of said other copying operation.

17. A copying apparatus according to claim 14, further comprising first mounting means for mounting one of the storage units on said apparatus and second mounting means for mounting another of the storage units on said apparatus, wherein said control means is adapted to store in predetermined memory means data associated with the mounting means used during the copying operation of said first magnification when said interruption is instructed.

18. A copying apparatus, comprising:

process means for forming an image of a size different from that of an original document on a copying material;

input means for selecting an image magnification;

first display means for displaying the selected image magnification;

input means for selecting a desired number of copies;

second display means for displaying the number of copies;

executing means, for operation during interruption of a copying operation of a first magnification, for executing another copying operation and for enabling, upon completion of said other copying operation, the execution of the remainder of the copying operation of said first magnification, wherein said other copying operation is capable of executing a second magnification different from said first magnification, and wherein said other copying operation is capable of selecting a number of copies different from that selected in response to the copying operation of said first magnification; and control means for switching said second display means from the number of sheets related to the copying of said first magnification to a standard display in response to the instruction for another copying operation by said executing means and retaining said first magnification without changing the display content of said first display means to a standard display notwithstanding the instruction for another copying operation by said executing means.

19. A copying apparatus according to claim 18, further comprising interruption display means for displaying the timer period of interrupt instruction of a copying operation.

20. A copying apparatus according to claim 18, wherein said control means automatically resets said second display means in order to display the number of sheets of the first magnification upon completion of said another copying operation.

* * * * *

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

IN [57] ABSTRACT

Line 18, "the" should read --The--.

SHEET 10 OF 49

FIG. 4-1B, "Scconds" should read --Seconds--.

SHEET 15 OF 49

FIG. 6-1B, "MAGNIFCATION" should read --MAGNIFICATION--.

SHEET 24 OF 49

FIG. 7-1B, "VNIT" should read --UNIT--.

COLUMN 1

Line 9, "now" should read --now abandoned, which was a continuation of application--.

COLUMN 2

Line 51, "of" (first occurrence) should be deleted.

COLUMN 3

Line 11, "location" should read --location.--.
Line 56, "of" should read --if--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 4

Line 44, "have" should read --has--.
Line 45, "shows" should read --show--.

COLUMN 5

Line 8, "reduce" should read --reduced--.

COLUMN 11

Line 1, "Besides" should read --Because--.
Line 3, "and" should be deleted.
Line 9, "contributing" should read --contributing to--.
Line 37, "sequency" should read --sequence--.
Line 53, "FIG. 16-1" should read --FIGS. 16-1--.

COLUMN 12

Line 9, "length 30." should read --lens 30.--.
Line 49, "roller 19 is" should read --roller 19 are--.
Line 66, "read-size" should read --real-size--.

COLUMN 13

Line 3, "conver" should read --convert--.
Line 27, "while" should read --when--.
Line 44, "FIG. 3-1" should read --FIG. 3-1B--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 14

Line 10, "matrix 81" should read --matrix 801--.
Line 28, "cassette 13, 14" should read --cassettes 13, 14--.
Line 37, "switch 807" should read --switch 808--.
Line 42, "keys 59" should read --key 59--.
Line 63, "lamp 32" should read --lamp 23--.

COLUMN 15

Line 4, "entract" should read --entrance--.
Line 21, "faciliating" should read --facilitating--.

COLUMN 16

Line 36, "and" (first occurrence) should read --to--.
Line 43, "FIGS. 4-1 and 7-1)." should read --FIG. 7-1A).--
.
Line 54, "hanger 4" should read --charger 4--.
Line 62, "and" (first occurrence) should read --to--.

COLUMN 18

Line 17, "measurement;" should read --measurement.--.
Line 19, "conducted:" should read --conducted.--.

COLUMN 19

Line 11, "cassette" should read --cassette is--.
Line 16, "n2," should read --u2,--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 19

Line 29, "corresponds" should read --correspond--.
Line 56, "identifies" should be deleted.
Line 64, "of" should read --off--.

COLUMN 20

Line 22, "of" should read --off--.
Line 26, "whether" should be deleted.

COLUMN 21

Line 24, "eliminater," should read --eliminator,--.
Line 30, "allows" should read --provides--.
Line 40, "is" should read --are--.

COLUMN 22

Line 4, "switch 502" should read --switch 501--.
Line 13, "time" should read --timer--.
Line 39, "returned" should read --be returned--.
Line 40, "time" should read --timer--.

COLUMN 23

Line 8, "start" should read --starts--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 25

Line 17, "form" should read --from--.
Line 60, "a" should read --of a--.
Line 63, "determined" should read --determined time--.
Line 67, "a" should read --of a--.

COLUMN 26

Line 29, "transfer," should read --transfers,--.

COLUMN 28

Line 9, "setting" should read --resetting--.
Line 18, "consum" should read --consume--.
Line 57, "Conventionaly" should read --Conventionally--.

COLUMN 30

Line 20, "the" (second occurrence) should read --of the--.

COLUMN 32

Line 12, "(370)." should read --(step 370).--.
Line 30, "high" should read --higher--.
Line 31, "iNT." should read --iNT1.--.
Line 42, "is" should read --are--.
Line 55, "spectivley" should read --spectively--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 33

Line 23, "peactically" should read --increase--.
Line 24, "of" should be deleted.
Line 48, "form he" should read --from the--.
Line 51, "ca. ⅓" should read --ca. ⅔--.
Line 62, "face" should read --fact--.

COLUMN 34

Line 7, "not" should read --no--.
Line 35, "prevent" should read --prevents--.

COLUMN 35

Line 61, "indication" should read --indicating--.
Line 66, "rotating" should read --rotate--.

COLUMN 36

Line 55, "an" should be deleted.

COLUMN 37

Line 68, "a" should read --is a--.

COLUMN 38

Line 8, "aperture" should read --apertures--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 39

Line 24, "are" should read --is--.
Line 43, "solenoid SOL1" should read --solenoid SL1--.

COLUMN 40

Line 35, "FIG. 17-1." should read --FIG. 7-1A.--.
Line 62, "receives" should be deleted.

COLUMN 42

Line 38, "does" should read --does not--.
Line 68, "during" should read --while--.

COLUMN 43

Line 1, "to" should be deleted.

COLUMN 45

Line 12, "changes" should read --change--.

UNITED STATES PATENT AND TRADEMARK OFFICE

CERTIFICATE OF CORRECTION

PATENT NO. : 5,008,712

DATED : April 16, 1991

INVENTOR(S) : TSUNEKI INUZUKA, ET AL.

It is certified that error appears in the above-identified patent and that said Letters Patent is hereby corrected as shown below:

COLUMN 46

Line 44, "timer" should read --time--.

Signed and Sealed this

Seventeenth Day of January, 1995

Bruce Lehman

*Attest:*

BRUCE LEHMAN

*Attesting Officer*

*Commissioner of Patents and Trademarks*

US005008712A

REEXAMINATION CERTIFICATE (2544th)

United States Patent [19]

[11] B1 5,008,712

Inuzuka et al.

[45] Certificate Issued Apr. 18, 1995

[54] VARIABLE MAGNIFICATION COPYING APPARATUS AND AUTOMATIC SHUTDOWN THEREFOR

[75] Inventors: Tsuneki Inuzuka; Katsuyoshi Maeshima; Masahiro Tomosada, all of Tokyo, Japan

[73] Assignee: Canon Kabushiki Kaisha, Tokyo, Japan

Reexamination Request:
No. 90/003,377, Mar. 29, 1994

Reexamination Certificate for:

| | |
|---|---|
| Patent No.: | **5,008,712** |
| Issued: | **Apr. 16, 1991** |
| Appl. No.: | **436,974** |
| Filed: | **Nov. 16, 1989** |

Related U.S. Application Data

[63] Continuation of Ser. No. 940,224, Dec. 8, 1986, abandoned, which is a continuation of Ser. No. 735,387, May 17, 1985, abandoned, which is a continuation of Ser. No. 311,865, Oct. 15, 1981, abandoned.

[30] Foreign Application Priority Data

| | | | |
|---|---|---|---|
| Oct. 17, 1980 | [JP] | Japan | 55-145268 |
| Oct. 17, 1980 | [JP] | Japan | 55-145269 |
| Dec. 27, 1980 | [JP] | Japan | 55-188402 |
| Jan. 19, 1981 | [JP] | Japan | 56-6946 |
| Jan. 21, 1981 | [JP] | Japan | 56-8489 |

[51] Int. Cl.[6] ..... G03G 15/04; G03G 21/00

[52] U.S. Cl. ..... 355/206; 355/208; 355/243; 355/311

[58] Field of Search ..... 355/205, 206, 208, 209, 355/243, 311, 55

[56] References Cited

FOREIGN PATENT DOCUMENTS 55-74552 6/1980 Japan .

*Primary Examiner*—Fred L. Braun

[57] ABSTRACT

This invention relates to a copying apparatus with variable magnification capability, wherein the reduced and enlarged copying operations are achieved by varying the speed of a photosensitive drum, while controlling an optical system. The size of a copying material is compared with the size of a reproduced image at a selected magnification, and the comparison is displayed. Also, the size of copy material and the selected magnification can be changed during an interrupt process, and the scanning stroke and timing for image formation are controlled differently for different magnifications. The size of a copying material is compared with the size of a reproduced image at a selected magnification, and the comparison is displayed. Also, the size of copy material and the selected magnification can be changed during an interrupt process, and the scanning stroke and timing for image formation are controlled differently for different magnifications, the optical system is moved to a determined position for a selected magnification and an error signal is generated when the optical system does not arrive at the determined position within a predetermined time after the selected magnification is input by the operator. The image forming cycle is stopped or inhibited in response to generation of the error signal.

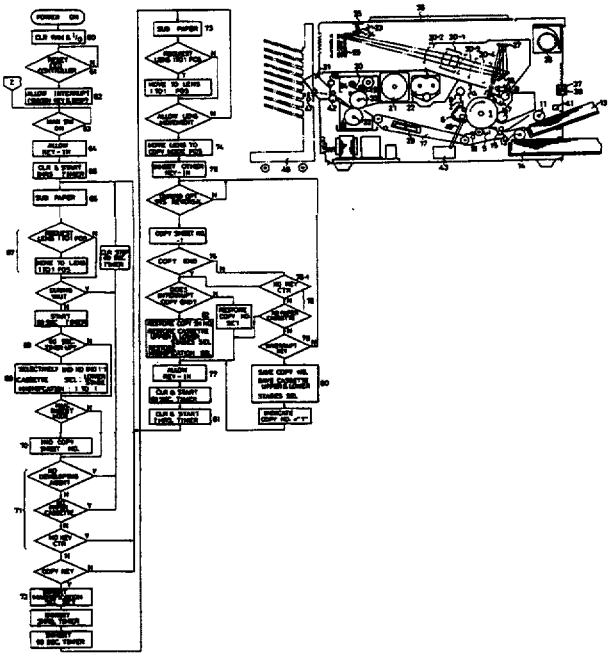

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3, 13–20 is confirmed.

Claims 4, 9 and 11 are determined to be patentable as amended.

Claims 5–8 and 10 dependent on an amended claim, are determined to be patentable.

New claims 21–27 are added and determined to be patentable.

4. A copying apparatus, comprising:

means for forming an image on a material that comprises a rotatable medium on which an image to be transferred is formed;

input means for setting a desired image magnification;

means for [displaying] *displacing* an optical system including an optical lens to a determined position which corresponds to the desired image magnification input by said input means, said position determining a size of a reproduced image;

means for issuing an error signal when said optical system does not reach said determined position within a predetermined period after the start of the displacement of said optical system to said determined position;

means for operating said displacing means during a predetermined period of a preliminary operation prior to the image forming cycle after a start instruction for image formation, said preliminary operation including a pre-preparing operation for stablizing said rotatable medium;

said operation means being adapted to execute an operation of said displacing means and said pre-preparing operation of said rotatable medium in parallel, said pre-preparing operation being a pre-rotation of said rotatable medium; and means for inhibiting the start of said image forming cycle in response to the error signal.

9. A copying apparatus, comprising: *instruction keys for instructing a copying operation of the copying apparatus, said instruction keys including at least a copy start key for instructing the start of the copying operation;* process means for forming on a copying material an image of a size different from that of an original;

input means for selecting an image magnification;

first control means for controlling said process means for conducting the copying operation at an image magnification selected by said input means;

means for detecting the size of the copying material;

means for comparing the size of the copying material detected by said detecting means with a size of an image reproduced at the image magnification selected by said input means;

second control means associated with said comparing means for *automatically* conducting the copying operation *without actuation of any instruction key other than the copy start key* even when the size detected by said detecting means is different from the size of the reproduced image formed with said image magnification; and display means responsive to the comparison result by said comparing means for displaying that said detected size and said size of the reproduced image size are different from each other.

11. An apparatus according to claim 9, [further comprising an instruction key for instructing] *wherein* the start of [a] *the* copying operation *is conducted* regardless of the selected image magnification, *and* wherein said process means is controlled to conduct the copying operation on the basis of the instruction from said [instruction] *copy start* key.

*21. A copying apparatus, comprising:*

*instruction keys for instructing a copying operation of the copying apparatus, said instruction keys including at least a copy start key for instructing the start of the copying operation;*

*image processing means for forming on a copying material an image of a size different from that of an original;*

*input means for selecting an image magnification;*

*first control means for controlling said image processing means to conduct the copying operation at an image magnification selected by said input means;*

*selecting means for selecting the copying material;*

*means for detecting the size of the selected copying material;*

*means for comparing the size of the selected copying material detected by said detecting means with a size of an image reproduced at the selected image magnification;*

*second control means, associated with said comparing means, for automatically controlling the image processing means to conduct the copying operation on the selected copying material without actuation of any instruction key other than the copy start key regardless of whether the size of the copying material detected by said detecting means is different from the size of an image to be reproduced by said selected image magnification; and*

*display means, responsive to the comparison result by said comparing means, for displaying in the case said detected size and said size of the reproduced image are different from each other.*

*22. A copying apparatus according to claim 21, wherein said display means statically displays said detected size and flashes a size of copying material suitable for said size of the reproduced image, when said detected size is different from said size of the reproduced image.*

*23. An apparatus according to claim 21, wherein the start of the copying operation is conducted regardless of the selected image magnification, and wherein said image processing means is controlled to conduct the copying operation on the basis of the instruction from said copy start.*

*24. An apparatus according to claim 21, wherein said image processing means forms the image by means of an electrophotographic process.*

*25. An apparatus according to claim 21, wherein said input means selects the image magnification by setting the size of the image to be reproduced and the size of the copying material.*

*26. An apparatus according to claim 21, wherein said input means includes a key on a control panel.*

*27. An apparatus according to claim 21, wherein said selecting means includes a key on a control panel.*

* * * * *